US012121783B2

(12) United States Patent
Tassistro et al.

(10) Patent No.: US 12,121,783 B2
(45) **Date of Patent: *Oct. 22, 2024**

(54) SET OF GOLF CLUB HEADS AND METHOD OF MANUFACTURE

(71) Applicant: Acushnet Company, Fairhaven, MA (US)

(72) Inventors: Kevin Tassistro, San Marcos, CA (US); Ronald K. Hettinger, Oceanside, CA (US)

(73) Assignee: Acushnet Company, Fairhaven, MA (US)

( * ) Notice: Subject to any disclaimer, the term of this patent is extended or adjusted under 35 U.S.C. 154(b) by 25 days.

This patent is subject to a terminal disclaimer.

(21) Appl. No.: 17/981,883

(22) Filed: Nov. 7, 2022

(65) Prior Publication Data

US 2023/0057513 A1 Feb. 23, 2023

Related U.S. Application Data

(63) Continuation of application No. 17/351,702, filed on Jun. 18, 2021, now Pat. No. 11,504,589, which is a (Continued)

(51) Int. Cl.
*A63B 53/04* (2015.01)
*A63B 53/06* (2015.01)
(Continued)

(52) U.S. Cl.
CPC ..... *A63B 53/0475* (2013.01); *A63B 53/047* (2013.01); *A63B 53/06* (2013.01);
(Continued)

(58) Field of Classification Search
CPC ..... A63B 2053/0479–0483
See application file for complete search history.

(56) References Cited

U.S. PATENT DOCUMENTS 645,942 A 3/1900 Cran
690,940 A 1/1902 Febiger
(Continued)

FOREIGN PATENT DOCUMENTS

EP 189201 A1 2/2008
GB 2451317 1/2009
(Continued)

OTHER PUBLICATIONS

PTAB Decision, Ex parte Nguyen, Appeal 2018-1801, Oct. 22, 2018, USPTO, 7 pages.*
(Continued)

*Primary Examiner* — Eugene L Kim
*Assistant Examiner* — Matthew B Stanczak
(74) *Attorney, Agent, or Firm* — Ryan A. Reis

(57) ABSTRACT

A co-forged iron type golf club is disclosed. More specifically, the present invention discloses an iron type golf club head from a pre-form billet that already contains two or more materials before the actual forging process resulting in a multi-material golf club head that doesn't require any post manufacturing operations such as machining, welding, swaging, gluing, and the like. The resultant golf club head may be capable of achieving center of gravity locations previously unachievable without utilizing this co-forging technique. The resultant golf club head may be used to create a set of golf club heads with center of gravity locations that are more advantageous throughout a set of golf clubs.

6 Claims, 36 Drawing Sheets

Related U.S. Application Data continuation of application No. 16/406,382, filed on May 8, 2019, now Pat. No. 11,065,513, which is a continuation-in-part of application No. 15/713,374, filed on Sep. 22, 2017, now abandoned, which is a continuation-in-part of application No. 15/332,864, filed on Oct. 24, 2016, now Pat. No. 10,391,370, which is a continuation-in-part of application No. 15/188,726, filed on Jun. 21, 2016, now Pat. No. 10,398,951, which is a continuation-in-part of application No. 14/078,380, filed on Nov. 12, 2013, now Pat. No. 9,387,370, which is a continuation-in-part of application No. 13/927,764, filed on Jun. 26, 2013, now abandoned, which is a continuation-in-part of application No. 13/305,087, filed on Nov. 28, 2011, now Pat. No. 8,926,451.

(51) Int. Cl.
*A63B 53/08* (2015.01)
*A63B 53/00* (2015.01)

(52) U.S. Cl.
CPC ..... *A63B 53/08* (2013.01); *A63B 53/005* (2020.08); *A63B 53/0408* (2020.08); *A63B 53/0416* (2020.08); *A63B 53/0433* (2020.08); *A63B 53/0437* (2020.08); *A63B 53/0454* (2020.08); *A63B 2053/0491* (2013.01)

(56) References Cited

U.S. PATENT DOCUMENTS 819,900 A 5/1906 Martin
1,133,129 A 3/1915 Febiger
1,453,503 A 5/1923 Holmes
1,840,924 A 1/1932 Tucker
1,968,626 A 7/1934 Young
2,056,335 A 10/1936 Wettlaufer
2,328,583 A 9/1943 Reach
2,332,342 A 10/1943 Reach
2,360,364 A 10/1944 Reach
2,460,445 A 2/1949 Bigler
2,784,969 A 3/1957 Brandon
2,998,254 A 8/1961 Rains
3,084,940 A 4/1963 Cissel
3,695,618 A 10/1972 Woolley
3,825,991 A 7/1974 Cornell
3,845,960 A 11/1974 Thompson
3,847,399 A 11/1974 Raymont
3,955,820 A 5/1976 Cochran
3,970,236 A 7/1976 Rogers
3,979,122 A 9/1976 Belmont
3,995,865 A 12/1976 Cochran
4,145,052 A 3/1979 Janssen
4,206,924 A 6/1980 Koralik
4,398,965 A 8/1983 Campau
4,523,759 A 6/1985 Igarashi
4,607,846 A 8/1986 Perkins
4,630,825 A 12/1986 Schmidt
4,645,207 A 2/1987 Teramoto
4,650,191 A 3/1987 Mills
4,664,383 A 5/1987 Aizawa
4,715,601 A 12/1987 Lamanna
4,780,948 A 11/1988 Ferguson
4,792,139 A 12/1988 Nagasaki
4,793,616 A 12/1988 Fernadez
4,798,383 A 1/1989 Nagasaki
4,809,977 A 3/1989 Doran
4,824,115 A 4/1989 Walther
4,852,880 A 8/1989 Kobayashi
4,883,274 A 11/1989 Hsien
4,884,812 A 12/1989 Nagasaki
4,928,972 A 5/1990 Nakanishi
5,013,041 A 5/1991 Sun
5,050,879 A 9/1991 Sun
5,062,638 A 11/1991 Shira
5,074,563 A 12/1991 Gorman
5,082,278 A 1/1992 Hsien
5,176,384 A 1/1993 Sata
5,183,255 A 2/1993 Antonious
5,221,087 A 6/1993 Fenton
5,282,624 A 2/1994 Viste
5,301,941 A 4/1994 Allen
5,301,944 A * 4/1994 Koehler ..... A63B 53/04 473/328
5,312,106 A 5/1994 Cook
5,328,175 A 7/1994 Yamada
5,348,302 A 9/1994 Sasamoto
5,377,978 A 1/1995 Lee
5,377,986 A 1/1995 Viollaz
5,386,996 A 2/1995 Hiruta
5,407,202 A 4/1995 Igarashi
5,409,219 A 4/1995 Saksun
5,429,353 A 7/1995 Hoeflich
5,439,223 A 8/1995 Kobayashi
5,482,281 A 1/1996 Anderson
5,485,998 A 1/1996 Kobayashi
5,486,000 A 1/1996 Chorne
5,522,593 A 6/1996 Kobayashi
5,529,543 A 6/1996 Beaumont
5,536,011 A 7/1996 Gutowski
5,570,886 A 11/1996 Rigal
5,584,770 A 12/1996 Jensen
5,613,917 A 3/1997 Kobayashi
5,616,086 A 4/1997 Chappell
5,616,088 A 4/1997 Aizawa
5,669,827 A 9/1997 Nagamoto
5,683,307 A 11/1997 Rife
5,683,310 A 11/1997 Chen
5,697,854 A 12/1997 Aizawa
5,713,800 A 2/1998 Su
5,720,673 A 2/1998 Anderson
5,735,755 A 4/1998 Kobayashi
5,766,091 A 6/1998 Humphrey
5,766,092 A 6/1998 Mimeur
5,766,094 A 6/1998 Mahaffey
5,807,188 A 9/1998 Serrano
5,823,887 A 10/1998 Mikame
5,827,131 A 10/1998 Mahaffey
5,833,551 A 11/1998 Vincent
5,876,293 A 3/1999 Musty
5,885,166 A 3/1999 Shiraishi
5,885,170 A 3/1999 Takeda
5,961,394 A 10/1999 Minabe
5,964,669 A 10/1999 Bloomer
5,967,903 A 10/1999 Cheng
5,993,331 A 11/1999 Shieh
6,015,354 A 1/2000 Ahn
6,045,456 A 4/2000 Best
6,074,309 A 6/2000 Mahaffey
6,077,171 A 6/2000 Yoneyama
6,083,118 A 7/2000 Martins
6,093,112 A * 7/2000 Peters ..... A63B 53/047 473/291
6,095,931 A 8/2000 Hettinger
6,099,414 A 8/2000 Kusano
6,126,556 A 10/2000 Hsieh
6,183,381 B1 2/2001 Grant
6,200,228 B1 3/2001 Takeda
6,257,603 B1 7/2001 Busch
6,290,607 B1 * 9/2001 Gilbert ..... A63B 53/047 473/291
6,299,548 B1 10/2001 Lin
6,299,648 B1 10/2001 Lin
6,302,804 B1 10/2001 Budde
6,406,382 B1 6/2002 Deshmukh
6,434,811 B1 8/2002 Helmstetter
6,450,894 B1 9/2002 Sun
6,454,665 B2 9/2002 Antonious
6,482,104 B1 11/2002 Gilbert
6,497,629 B2 12/2002 Takeda
6,508,722 B1 1/2003 Mccabe
6,530,846 B1 3/2003 Mase

(56) References Cited

U.S. PATENT DOCUMENTS 6,533,679 B1 3/2003 Mccabe
6,551,200 B1 4/2003 Golden
6,569,029 B1 5/2003 Hamburger
6,616,547 B2 9/2003 Vincent
6,666,779 B1 12/2003 Iwata
6,695,712 B1 * 2/2004 Iwata ..... A63B 53/047 473/345
6,729,209 B1 5/2004 Chen
6,743,117 B2 6/2004 Gilbert
6,773,361 B1 8/2004 Lee
6,777,640 B2 8/2004 Takeda
6,881,158 B2 4/2005 Yang
6,921,343 B2 7/2005 Solheim
6,923,734 B2 8/2005 Meyer
6,932,875 B2 8/2005 Cheng
6,984,180 B2 1/2006 Hasebe
7,014,568 B2 * 3/2006 Pelz ..... A63B 53/047 473/331
7,018,303 B2 3/2006 Yamamoto
7,040,000 B2 5/2006 Takeda
7,048,647 B2 5/2006 Burrows
7,169,062 B2 1/2007 Chen
7,192,361 B2 * 3/2007 Gilbert ..... A63B 53/00 473/331
7,207,899 B2 4/2007 Lmamoto
7,232,380 B2 6/2007 Nakahara
7,303,485 B2 12/2007 Tseng
7,309,297 B1 12/2007 Solari
7,316,623 B2 1/2008 Lmamoto
7,326,472 B2 2/2008 Shimazaki
7,338,388 B2 3/2008 Schweigert
7,361,099 B2 4/2008 Riceet
7,371,188 B2 5/2008 Chen
7,380,325 B2 6/2008 Takeda
7,448,961 B2 11/2008 Lin
7,462,110 B2 12/2008 Yamamoto
7,530,902 B2 5/2009 Nakamura
7,559,854 B2 7/2009 Harvell
7,585,232 B2 9/2009 Krumme
7,614,962 B1 11/2009 Clausen
7,744,484 B1 6/2010 Chao
7,794,335 B2 9/2010 Cole
7,815,523 B2 10/2010 Knutson
7,828,674 B2 11/2010 Kubota
7,867,105 B2 1/2011 Moon
7,914,394 B2 3/2011 Cole
7,938,739 B2 5/2011 Cole
7,976,403 B2 7/2011 Gilbert
8,042,253 B2 10/2011 Su
8,062,150 B2 11/2011 Gilbert
8,088,023 B2 1/2012 Kubota
8,133,129 B2 3/2012 Boyd
8,187,120 B2 5/2012 Gilbert
8,206,237 B2 6/2012 Gilbert
8,235,843 B1 8/2012 Rice
8,257,198 B2 9/2012 Gilbert
8,337,325 B2 12/2012 Boyd
8,342,985 B2 1/2013 Hirano
8,376,878 B2 2/2013 Bennett
8,409,032 B2 4/2013 Myrhum
8,434,671 B1 5/2013 Su
8,449,405 B2 5/2013 Jertson
8,491,405 B2 7/2013 Joraensen
8,535,177 B1 9/2013 Wahl
8,540,589 B2 9/2013 Bezilla
8,632,419 B2 1/2014 Tang
8,663,027 B2 3/2014 Morales
8,840,485 B2 9/2014 Jorgensen
8,876,624 B2 11/2014 Ban
8,894,508 B2 11/2014 Myrhum
8,911,302 B1 12/2014 Lvanova
8,911,304 B1 12/2014 Dawson
8,915,797 B1 12/2014 Kuhar
8,926,451 B2 1/2015 Desmuhk
8,936,518 B2 1/2015 Takechi
9,079,081 B2 7/2015 Shimazaki
9,211,450 B2 12/2015 Nelson
9,220,959 B2 12/2015 Roach
9,295,887 B2 3/2016 Radcliffe
9,387,370 B2 7/2016 Hebreo
9,421,435 B2 8/2016 Jertson
9,427,633 B2 8/2016 Oldknow
9,504,887 B2 11/2016 Ines
9,616,303 B2 4/2017 Wu
9,616,304 B2 4/2017 Deshmukh
9,630,072 B2 4/2017 Finn
9,713,751 B2 7/2017 Hettinaer
9,718,119 B2 8/2017 Zimmerman
9,750,993 B2 9/2017 Ritchie
10,086,238 B1 10/2018 Roach
10,207,162 B2 2/2019 Desmuhk
11,065,513 B2 * 7/2021 Tassistro ..... A63B 53/06
11,504,589 B2 * 11/2022 Tassistro ..... A63B 53/06
2001/0055996 A1 12/2001 Iwata
2002/0016214 A1 2/2002 Hueser
2002/0019265 A1 2/2002 Allen
2002/0019266 A1 2/2002 Yabu
2002/0061788 A1 5/2002 Marcase
2002/0068645 A1 6/2002 Vincent
2002/0082118 A1 6/2002 Iwata
2002/0095762 A1 7/2002 Takeda
2003/0013545 A1 1/2003 Vincent
2003/0015015 A1 1/2003 Takeda
2003/0022729 A1 1/2003 Pergande
2003/0032499 A1 2/2003 Wahl
2003/0139226 A1 7/2003 Cheng
2003/0176231 A1 9/2003 Hasebe
2003/0176232 A1 9/2003 Hasebe
2003/0181257 A1 9/2003 Yamamoto
2003/0181259 A1 9/2003 Shimazaki
2003/0228928 A1 12/2003 Yabu
2003/0236134 A1 12/2003 Nishitani
2004/0023729 A1 2/2004 Nagai
2004/0023730 A1 2/2004 Nagai
2004/0033846 A1 2/2004 Caldwell
2004/0038746 A1 2/2004 Wahl
2004/0043830 A1 3/2004 Lmamoto
2004/0157679 A1 8/2004 Poincenot
2004/0198533 A1 10/2004 Mitsuba
2004/0214654 A1 10/2004 Pelz
2004/0214655 A1 10/2004 Reed
2004/0231132 A1 11/2004 Takeda
2005/0020378 A1 1/2005 Krumme
2005/0044691 A1 3/2005 Su
2005/0054458 A1 3/2005 Chen
2005/0070371 A1 3/2005 Chen
2005/0096151 A1 5/2005 Hou
2005/0197208 A1 9/2005 Lmamoto
2005/0209018 A1 9/2005 Yamamoto
2005/0266931 A1 12/2005 Hou
2005/0277484 A1 * 12/2005 Reed ..... A63B 53/047 473/332
2006/0003852 A1 1/2006 Hou
2006/0089206 A1 4/2006 Lo
2006/0172822 A1 8/2006 Liang
2006/0205533 A1 9/2006 Chen
2006/0223652 A1 10/2006 Hou
2006/0234808 A1 * 10/2006 Gilbert ..... A63B 53/047 473/291
2006/0234811 A1 * 10/2006 Gilbert ..... A63B 60/54 473/349
2006/0281582 A1 12/2006 Sugimoto
2007/0129165 A1 6/2007 Matsunaga
2007/0129166 A1 6/2007 Shimazaki
2007/0129168 A1 6/2007 Matsunaga
2007/0144241 A1 6/2007 Ban
2007/0149305 A1 6/2007 Ban
2007/0281796 A1 12/2007 Gilbert
2007/0287556 A1 12/2007 Nakamura
2007/0293339 A1 12/2007 Burnett
2008/0022502 A1 1/2008 Tseng
2008/0032815 A1 2/2008 Yamamoto
2008/0076595 A1 3/2008 Lai
2008/0085782 A1 4/2008 Kubota

(56) References Cited

U.S. PATENT DOCUMENTS

2008/0102982 A1 5/2008 Wahl
2008/0194374 A1 8/2008 Diosi
2008/0293516 A1 11/2008 Yamamoto
2008/0305887 A1 12/2008 Lin
2008/0318705 A1* 12/2008 Clausen ..... A63B 53/047 473/332
2008/0318708 A1 12/2008 Clausen
2009/0023513 A1 1/2009 Shibata
2009/0062032 A1 3/2009 Boyd
2009/0075751 A1 3/2009 Gilbert
2009/0137339 A1 5/2009 Nakano
2009/0181789 A1 7/2009 Reed
2009/0239681 A1 9/2009 Sugimoto
2009/0288282 A1 11/2009 Chao
2009/0291772 A1 11/2009 Boyd
2009/0298615 A1 12/2009 Moon
2009/0305815 A1 12/2009 Hirano
2010/0029401 A1 2/2010 Nakamura
2010/0041493 A1 2/2010 Clausen
2010/0048318 A1 2/2010 Clausen
2010/0093460 A1 4/2010 Gilbert
2010/0130306 A1 5/2010 Schweigert
2010/0273570 A1 10/2010 Ines
2010/0279789 A1* 11/2010 Beaulieu ..... A63B 53/047 473/331
2010/0304883 A1* 12/2010 Gilbert ..... A63B 53/04 473/324
2010/0304887 A1 12/2010 Bennett
2010/0304890 A1* 12/2010 Dill ..... A63B 53/04 473/349
2010/0317461 A1 12/2010 Jertson
2010/0323816 A1 12/2010 Nakano
2011/0021285 A1 1/2011 Shimazaki
2011/0021290 A1 1/2011 Kubota
2011/0028235 A1 2/2011 Nakano
2011/0028236 A1 2/2011 Takechi
2011/0086723 A1 4/2011 Gilbert
2011/0201444 A1* 8/2011 Stokke ..... A63B 53/047 473/409
2011/0256953 A1 10/2011 Jorgensen
2011/0294597 A1 12/2011 Teramoto
2012/0064997 A1 3/2012 Sato
2012/0071270 A1 3/2012 Nakano
2012/0122606 A1 5/2012 Yamamoto
2012/0129628 A1* 5/2012 Nelson ..... A63B 60/02 473/349
2012/0157222 A1 6/2012 Kli
2012/0186060 A1 7/2012 Su
2012/0196702 A1 8/2012 Shimazaki
2012/0231897 A1 9/2012 Hettinger
2012/0244958 A1* 9/2012 Beaulieu ..... A63B 53/047 473/331
2013/0017903 A1 1/2013 Takechi
2013/0109497 A1 5/2013 Ban
2013/0119599 A1 5/2013 Byrne
2013/0137532 A1 5/2013 Deshmukh
2013/0267346 A1 10/2013 Jertson
2013/0281229 A1 10/2013 Su
2013/0288823 A1 10/2013 Hebreo
2013/0305801 A1 11/2013 Liang
2013/0344989 A1 12/2013 Hebreo
2014/0038737 A1 2/2014 Roach
2014/0073447 A1 3/2014 Golden
2014/0073450 A1 3/2014 Hebreo
2014/0123471 A1 5/2014 Su
2014/0148271 A1 5/2014 Myrhum
2014/0274441 A1 9/2014 Greer
2014/0274442 A1 9/2014 Honea
2014/0329614 A1 11/2014 Ines
2014/0357397 A1 12/2014 Franz
2015/0005099 A1* 1/2015 Hettinger ..... A63B 60/02 473/350
2015/0024864 A1 1/2015 Jertson
2015/0045130 A1* 2/2015 Roach ..... A63B 60/02 473/226
2015/0126301 A1 5/2015 Taylor
2015/0151175 A1 6/2015 Lytle
2015/0165281 A1 6/2015 Ines
2015/0182816 A1 7/2015 Radcliffe
2015/0182817 A1 7/2015 Oldknow
2015/0217364 A1 8/2015 Zimmerman
2015/0258396 A1 9/2015 Mendoza
2016/0101330 A1* 4/2016 Harrington ..... A63B 53/047 473/338
2016/0184665 A1 6/2016 Nakamura
2016/0184669 A1 6/2016 Deshmukh
2016/0193508 A1* 7/2016 Issertell ..... A63B 60/00 473/349
2016/0199705 A1 7/2016 Oldknow
2016/0296808 A1* 10/2016 Harrington ..... A63B 60/52
2016/0317886 A1 11/2016 Jertson
2017/0065858 A1 3/2017 Tassistro
2017/0120112 A1 5/2017 Stokke
2018/0036605 A1 2/2018 Tassistro
2018/0169492 A1 6/2018 Jertson
2018/0256946 A1 9/2018 Stokke
2018/0280768 A1 10/2018 Ritchie
2019/0015716 A1 1/2019 Abe
2019/0118049 A1 4/2019 Tassistro
2019/0151728 A1 5/2019 Hebreo
2019/0217162 A1 7/2019 Seagram
2019/0262674 A1* 8/2019 Tassistro ..... A63B 53/0475
2019/0374828 A1 12/2019 Jertson
2020/0282269 A1 9/2020 Oldknow
2021/0339095 A1* 11/2021 Tassistro ..... A63B 53/047

FOREIGN PATENT DOCUMENTS

JP 06-304273 11/1994
JP 07-222830 8/1995
JP 11-089980 4/1996
JP 08-308964 11/1996
JP 08-308965 A 11/1996
JP 10-192459 A 7/1998
JP 11-047325 A 7/1998
JP 11-047323 A 2/1999
JP H11-70191 3/1999
JP 11-137738 A 5/1999
JP 11-137741 A 5/1999
JP 11-347159 12/1999
JP 2000-005355 A 1/2000
JP 2000-342726 A 12/2000
JP 4351772 4/2001
JP 2003-169870 6/2003
JP 2004-130125 4/2004
JP 2004-329335 A 11/2004
JP 2004-350949 12/2004
JP 2005-143761 6/2005
JP 2006-167033 A 6/2006
JP 2011-194266 10/2011
JP 2012-010768 1/2012
JP 2012-040311 3/2012
JP 2013-202186 10/2013
WO WO 9920358 4/1999

OTHER PUBLICATIONS

Ralph Maltby, Golf Club Design, Fitting, Aleration & Repair, 1995, Ralph Maltby Enterprises, inc., 3rd, 508.*

Coefficient of Linear Thermal Expansion Data—Repair Engineering.

Office Action, Decision on Appeal 2021-005169 dated, Jul. 27, 2022. of U.S. Appl. No. 15/821,194, 15 pages.

* cited by examiner

SET OF GOLF CLUB HEADS AND METHOD OF MANUFACTURE

CROSS-REFERENCE TO RELATED APPLICATIONS

The present application is a Continuation of U.S. patent application Ser. No. 17/351,702, filed Jun. 18, 2021, which is a Continuation of U.S. patent application Ser. No. 16/406,382, filed May 8, 2019, now U.S. Pat. No. 11,065,513, which is a Continuation-In-Part of U.S. patent application Ser. No. 15/713,374, filed on Sep. 22, 2017, which is a Continuation-In-Part of U.S. patent application Ser. No. 15/332,864, filed on Oct. 24, 2016, now U.S. Pat. No. 10,391,370, which is a Continuation-In-Part of U.S. patent application Ser. No. 15/188,726, filed on Jun. 21, 2016, now U.S. Pat. No. 10,398,951, which is a Continuation-In-Part of U.S. patent application Ser. No. 14/078,380, filed on Nov. 12, 2013, now U.S. Pat. No. 9,387,370, which is a Continuation-In-Part of U.S. patent application Ser. No. 13/927,764, filed on Jun. 26, 2013, which is a Continuation-In-Part of U.S. patent application Ser. No. 13/305,087, filed on Nov. 28, 2011, now U.S. Pat. No. 8,926,451, the disclosures of which are all incorporated by reference in their entirety.

FIELD OF THE INVENTION

The present invention relates generally to a co-forged golf club head formed from two or more materials and the method of manufacture for such a golf club head. More specifically, the present invention relates to the creation of an iron type golf club head from a pre-form billet that already contains two or more materials before the actual forging process; resulting in a multi-material golf club head that doesn't require any post manufacturing operations such as machining, welding, swaging, gluing, and the like.

BACKGROUND OF THE INVENTION

Golf is hard! When your average golfer swings a golf club, he or she may have dramatic variations in his or her golf swing, resulting in numerous off-center hits, which result in diminished performance when compared to a direct center hit. However, in an attempt to make this very difficult game more enjoyable for the average golfer, golf club designers have came up with unique golf club designs that will mitigate the harsh realities of a less than perfect golf swing.

In one early example, U.S. Pat. No. 4,523,759 to Igarashi discloses a perimeter weighted hollow golfing iron having a foam core with an effective hitting area concentrated toward the center of moment in an attempt to help make the game of golf easier. Distributing the weight of a golf club to the perimeter allow the moment of inertia (MOI) of a golf club head to be increased, reducing the undesirable twisting a golf club as it impacts a golf ball.

U.S. Pat. No. 4,809,977 to Doran et al. shows another example of an attempt to increase the moment of inertia of a golf club head by placing additional weights at the heel and toe portion of the golf club head. This increase in the moment of inertia of the golf club head achievable by increased heel and toe weighting could further prevent the golf club from twisting in a heel and toe direction, which mitigates the undesirable effect of sending a golf ball off the intended trajectory.

Although the initial attempts at increasing the forgiveness and playability of a golf club for an average golfer are admirable, it does not take advantage of the extreme forgiveness that can be achievable by utilizing different materials to form different portions of the golf club head. In one example, U.S. Pat. No. 5,885,170 to Takeda shows the advantage of using multi-materials to create more extreme adjustment of the mass properties. More specifically, U.S. Pat. No. 5,885,170 teaches a body having a face formed of one material while a hosel is formed from another material having different specific gravity from that of the head body. U.S. Pat. No. 6,434,811 to Helmstetter et al. shows another example of utilization of multiple materials to improve the performance of a golf club head by providing a golf club head with a weighting system that is incorporated after the entirety of the golf club head has been formed.

More recently, the improvements in incorporating multi-materials into a golf club head has matured significantly by incorporating numerous multiple materials of different characteristics by machining cavities into the golf club head. More specifically, U.S. Pat. No. 7,938,739 to Cole et al. discloses a golf club head with a cavity integral with the golf club head, wherein the cavity extends from the heel region to the toe region; extending along a lower portion of the back face of the golf club head; extends approximately parallel to the strike face; and is approximately symmetrical about a centerline that bisects the golf club head between the heel region and the toe region.

However, as multiple materials are introduced into the golf club after the body has been completed, the tolerances of the interfaces between the different materials could potentially cause undesirable side effects of altering the feel of the golf club head. U.S. Pat. No. 6,095,931 to Hettinger et al. identifies this specific undesirable side effect of sacrifice in the feel by the usage of multiple different components. U.S. Pat. No. 6,095,931 addresses this issue by providing an isolation layer between the golf club head and the main body portion that comprises the striking front section.

U.S. Pat. No. 7,828,674 to Kubota recognizes the severity of this problem by stating that hollow golf club heads having viscoelastic element feels light and hollow to the better golfer, hence they do not prefer such a golf club. U.S. Pat. No. 7,828,674 address the deficiencies of such a multi-material golf club by incorporating a block of magnesium to be embedded and or press-fitted into the recess formed in the metal only to be sealed with a metallic cover.

Despite all of the above attempts to improve the performance of a golf club head all while trying to minimize the sacrifice in feel of a golf club, all of the methodologies require a significant amount of post manufacturing operation that creates cavities and recesses in the club head for the secondary material to be incorporated. These type of secondary operations are not only expensive, but the ability to maintain a tight enough tolerance between the various components make is very difficult to maintain the solid feel generally associated with an unitarily formed golf club head.

Hence, it can be seen from above, despite all the development in creating a golf club head that's more forgiving without sacrificing the feel associated with a conventional club head, the current art is incapable of creating such a club without utilizing severe post manufacturing machining that causes bad feel.

BRIEF SUMMARY OF THE INVENTION

In one aspect of the present invention is a forged golf club head comprising a body portion having a striking surface made out of a first material, and at least one weight adjustment portion made out of a second material encased within the body portion; wherein the at least one weight adjustment portion is encased monolithically within the body portion of the golf club head without any secondary attachment operations.

In another aspect of the present invention is a method of forging a golf club head comprising of the steps of creating a cylindrical billet out of a first material, machining one or more cavities within the cylindrical billet, partially filling the one or more cavities with a second material to create a weight adjustment portion, filling the remaining volume of the one or more cavities with the first material to encase the weight adjustment portion, and forging the cylindrical billet to create a body portion of the golf club head; wherein the body portion monolithically encases the weight adjustment portion within a body of the golf club head without any secondary attachment operations.

In another aspect of the present invention is a forged golf club head comprising a body portion having a striking surface made out of first material, and at least one weight adjustment portion made out of a second material encased within the body portion; wherein the at least one weight adjustment portion is encased monolithically within the body portion without any secondary attachment operations. The first material has a first flow stress at a first forging temperature and the second material has a second flow stress at a second forging temperature, wherein the first flow stress and the second flow stress are substantially similar to one another, and the first forging temperature and the second forging temperature are substantially similar to one another and the first forging temperature and the second forging temperature are substantially similar to one another. The first material has a first thermal expansion coefficient and the second material has a second thermal expansion coefficient, wherein the first thermal expansion coefficient is greater than or equal to the second thermal expansion coefficient.

In yet another aspect of the present invention is a forged golf club head comprising of a body portion made out of a first material having a face cavity and at least one weight cavity, at least one high density weight adjustment portion made out of a second material encased within the weight cavity, a lightweight weight adjustment portion made out of a third material encased within the face cavity, and a striking face insert made out of the first material adapted to cover the face cavity; wherein the lightweight weight adjustment portion further comprises of a plurality of two or more cutouts, and wherein the high density weight adjustment portion is encased monolithically within the weight cavity.

In another aspect of the present invention, the pluralities of two or more cutouts are of a circular shape, and the circular shapes have a diameter of between about 1.0 mm to about 3.0 mm.

In another aspect of the present invention, the plurality of two or more cutouts may be at least partially filled with a polymer.

In yet another aspect of the present invention is a method of forging a golf club head comprising of first pre-forging a cylindrical billet to create a body portion of the golf club head wherein the body portion of the golf club head comprises of a face cavity and at least one weight cavity. Once the pre-forging is done, the at least one weight cavity is at least partially filled with a second material to create a high density weight adjustment portion and the face cavity is at least partially filled with a third material to create a lightweight weight adjustment portion. Then a cap is provided to at least partially encase the high density weight adjustment portion and a striking face insert is provided to cover the lightweight weight adjustment portion. Finally, the body portion containing the high density weight adjustment portion and the lightweight weight adjustment portion is post forged to create a golf club head wherein the post forging process deforms an internal surface of the striking face insert into the plurality of two or more cutouts.

In another aspect of the present invention, both said face cavity and the at least one weight cavity have an opening towards a frontal portion of the golf club head such that the striking face insert completely covers both the face cavity and the at least one weight cavity.

In another aspect of the present invention, the lightweight weight adjustment portion further comprises a plurality of two or more cutouts, and the plurality of two or more cutouts form a draft angel to create a countersink.

In another aspect of the present invention is a plurality of two or more golf club heads comprising, a first golf club head having a first loft, a first bounce angle, and a first CG height location from a leading edge of the first golf club head, a second golf club head having a second loft, a second bounce angle, and a second CG height location from a leading edge of the second golf club head, wherein if the first loft and the second loft are substantially the same, then the first CG height location from the leading edge and the second CG height location from the leading edge are the same.

In another aspect of the present invention the CG height is kept the same even if the first loft and the second loft are substantially different.

In another aspect of the present invention, the golf club head has a more forward CG-C-SA location that satisfied the relationship CG-C-SA<0.1907*Loft+11.17.

In another aspect of the present invention, the golf club head has a more forward CG-C-SA location that satisfies the relationship CG-C-SA≤0.0879*Loft+11.66.

In another aspect of the present invention, the golf club head has a CG-C-SA number of between about 13 mm and about 14 mm, when the loft of the golf club head is greater than about 56 degrees.

These and other features, aspects and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
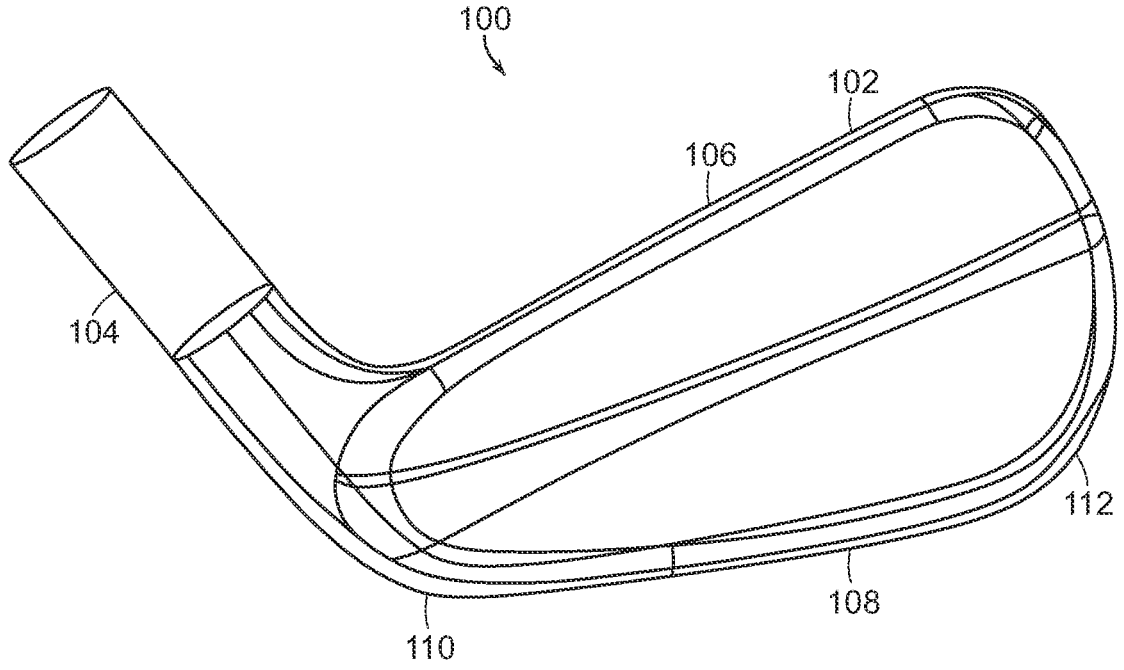
FIG. 1 of the accompanying drawings shows a perspective view of a co-forged golf club head in accordance with an exemplary embodiment of the present invention.

FIG. 1 of the accompanying drawings shows a perspective view of a golf club head 100 in accordance with an exemplary embodiment of the present invention. The golf club head 100 shown in FIG. 1 may generally comprise of a body portion 102 and a hosel portion 104, with the body portion 102 having several individually identifiable components such as a topline portion 106, a sole portion 108, a heel portion 110, and a toe portion 112. The golf club head 100 in accordance with an exemplary embodiment of the present invention may generally be comprised of at least one weight adjustment portion that is encased within the body portion 102 of the golf club head 100. In a preferred embodiment, the weight adjustment portion may be monolithically encased within the body portion 102 to ensure that the weight adjustment portion is secured within the body portion 102 without departing form the scope and content of the present invention. Because the weight adjustment portion is monolithically encased within the body portion 102 of the golf club head 100, these weights are not visible in FIG. 1 of the accompanying drawings. However, these weight adjustment portions will be shown in more detail in later figures, when various different views are presented.

Before moving onto subsequent figures, it is worthwhile here to emphasize that the current golf club head 100 is created using a forging process and the weights are incorporated without any post finish machining operations. This is an important distinction to establish because the same result of a monolithically encasing a weight adjustment portion is extremely difficult to achieve using alternative manufacturing processes such as casting. "Monolithically encased", as referred to in the current patent application, may generally be defined as a having a specific internal component placed inside a separate external component without joints or seams in the finished product. With respect to the current invention, having weight adjustment portions "monolithically encased" within the body portion 102 of the golf club head 100 may generally refer to the ability to have weight adjustment portions placed inside the body portion 102 of the golf club head without joints or seams that are generally required by post manufacturing processes such as milling, welding, brazing, gluing, or swaging.

It should also be noted here that a weight that is "monolithically encased" within the current definition of the present invention could potentially have certain aspect of the internal weights exposed in the finish product to illustrate the existence of a weight adjustment portion without departing from the scope and content of the present invention. More specifically, "monolithically encased" refers to the methodology used to create the ultimate product as described above, and may not necessarily be limited to visually concealing the weight adjustment member.

FIGS. 2A-2D illustrate the methodology used to create a co-forged golf club head 200 in accordance with an exemplary embodiment of the current invention. More specifically, FIGS. 2A-2D illustrate the steps involved in the forging of a golf club head from its rudimentary billet 201 shape into the final product of a golf club head 200.

Figure 2D:
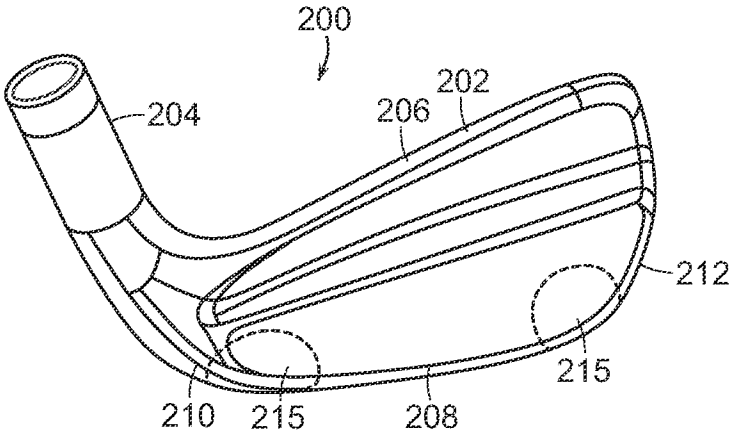
FIGS. 2A-2D shows perspective views of pre-formed billets used to create a golf club head in accordance with an exemplary embodiment of the present invention.
Figure 2A:
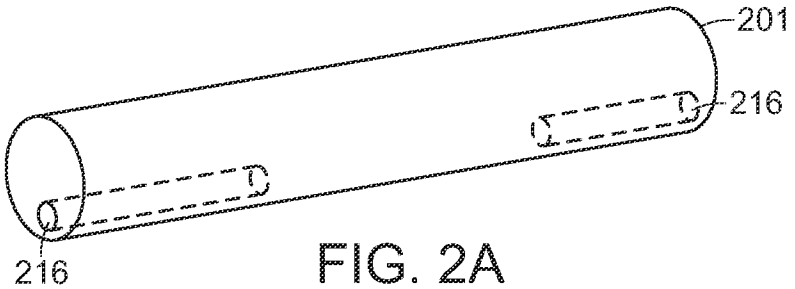

FIG. 2A shows a pre-formed billet 201 in accordance with an exemplary embodiment of the present invention. As it can be seen from FIG. 2A, the pre-form billet 201 may generally begin as a cylindrical rod formed from a first material, as it is common with the forging of a golf club head 200. In order to create a weight adjustment portion 215 that can be monolithically encased within the body portion 202 of the golf club head 200, one or more cavities 216 are machined into the pre-form billet 201. In this current exemplary embodiment shown in FIG. 2A, two cavities 216 are machined into the terminal ends of the pre-form billet 201. The location and geometry of the cavities 216 within the pre-form billet 201 are important, as it correlates directly with the ultimate location of the weight adjustment portion 215 in the golf club head 200 after forging.

Figure 2B:
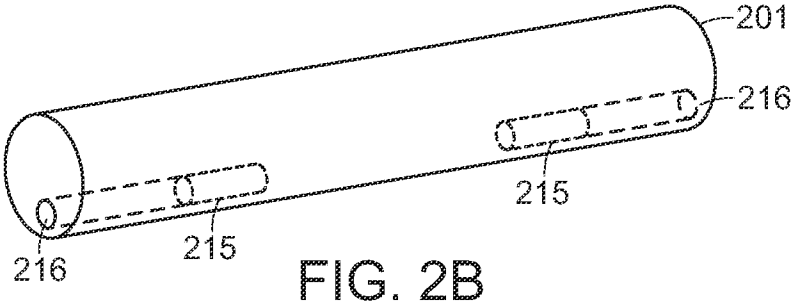

Moving onto FIG. 2B, it can be seen that once the cavities 216 are machined, the cavities 216 are partially filled with a second material that has a density different from the density of the first material in order to create the weight adjustment portion. 215. Similar to the discussion above, the location, size, and shape of the weight adjustment portion 215 is just as critical as the location, size, and shape of the cavities 216, as the weight adjustment portion 215 within the pre-form billet 201 correlates with the ultimate resting place of the weight adjustment portion 215 in the golf club head.

Figure 2C:
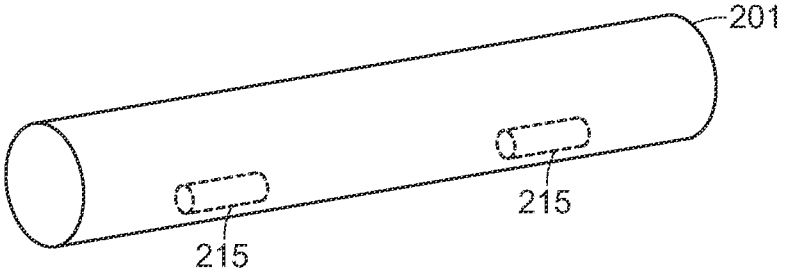

Finally, FIG. 2C shows the final phase of the pre-form billet 201 as the remaining volume of the cavities 216 are filled with the first material and sealed through traditional joining methods such as welding, brazing, and swaging. Sealing the cavities 216 allows the weight adjustment portion 215 to be monolithically encased within the body of the pre-form billet 201, which will allow the same weight adjustment portion 215 to be monolithically encased in the body 202 of the golf club head 200 after the forging process. After the cavities 216 are filled, the pre-form billet 201 is subjected to the normal forging process associated with the forging of a golf club head 200. Although the basic steps involved in forging a golf club head 200 are important to the understanding of the current invention, it involves a relatively archaic and established technique, which the present application will not dive into much detail. More information regarding the steps involved in the forging of a basic golf club head without monolithically encased weight adjustment portions can be found in U.S. Pat. No. 3,825,991 to Cornell, and U.S. Pat. No. 6,666,779 to Iwata et al., the disclosure of which are all incorporated by reference in its entirety.

Although the above discussion regarding the forging of a golf clubs incorporated by reference do a good job describing the actual forging process, it fails to address the additional concerns with the co-forging process of the current invention wherein two different materials are involved in this forging process. More specifically, because a weight adjustment portion 215 is made out of a second material that could be different from the first material used to create remainder of the pre-form billet 201, special care must be taken to ensure that the different materials can be forged together to form a golf club head 200. Hence, in order to select two cohesive materials that are capable of being co-forged together, the first material and the second material may generally have to have very specific material properties requirements with respect to their flow stress and their thermal expansion coefficient. Although it is most preferential for the two materials to have identical material properties yielding in consistency in forging, the usage of identical materials may not offer any weight adjustment benefits required for the basis of the current invention.

First off, in order for metallic materials to have the capabilities of being co-forged together, the respective flow stress' of each of the materials needs to be properly considered. Flow stress of a material, may generally be defined as the instantaneous value of stress require for continued deforming the material (i.e. to keep the metal flowing); and the creation of a cohesive forged component from two different materials will require them to flow at relatively the same speed when subjected to the stresses of the forging process. It is commonly known that the flow stress of a material is generally a function of the yield strength, the flow stress of a material may generally be summed up by Eq. (1) below.

$$Y_f = Ke^n \quad \text{Eq. (1)}$$

wherein $Y_f$=Flow Stress (MPa)

K=Strain Coefficient (MPa)

N=Strain Hardening Exponent

In addition to the above equation, it is worthwhile to mention here that the flow stress of a material may not be construed in vacuum, but rather, it is a function of the forging temperature of the material as well. Hence, in a current exemplary embodiment of the present invention, a first flow stress of the first material at its first forging temperate is substantially similar but not identical to the second flow stress of the second material at its second forging temperature; with the first forging temperature and the second forging temperature being substantially similar. More specifically, in a more detailed embodiment, the first material may be 1025 steel having a first flow stress of about 10 ksi (kilo-pound per square inch) at a forging temperature of about 1,200° C., while the second material may a Niobium material having a second flow stress of also about 12 ksi at a forging temperature of about 1,100° C.

Although in the exemplary embodiment of the present invention described above, the first material may be a 1025 steel and the second material may be a Niobium material, various other materials may also be used without departing from the scope and content of the present invention so long as their flow stresses are similar at a similar forging temperature. Alternatively speaking, any two materials may be used in the current co-forging process so long as the second flow stress is no more than 20% greater or no less than 20% lesser than the first flow stress.

As mentioned before, other than flow stress, the thermal expansion coefficient of the first and second materials are also important to the proper co-forging of two distinct materials. More specifically, a first thermal expansion coefficient of the first material may generally need to be greater than or at least equal to the second thermal expansion coefficient of the second material. Because the thermal expansion coefficient also relate to the shrinkage of the material after forging, it is important that the first material that monolithically encases the second material have a higher thermal expansion coefficient to prevent gaps from forming at the interface portion of the materials. In a more detailed embodiment of the present invention, the first material may be 1025 steel having a thermal expansion coefficient of about 8.0 μin/in ° F., while the second material may be Niobium having a second thermal expansion coefficient of about 3.94 μin/in ° F.

It should be noted that although in the above exemplary embodiment the second thermal expansion coefficient is smaller than the first thermal expansion coefficient, the numbers can be identical to achieve perfect mating of the two materials without departing from the scope and content of the present invention. In fact, in one exemplary embodiment of the present invention, it may be preferred for the first material and the second material to have the same thermal expansion coefficient, as excessive shrinkage of the outer material upon the inner material could potentially create additional stresses at the interface portions of the two materials.

Alternatively, in an attempt to provide different weighting characteristics, the second material could be made out of a 6-4 Titanium material to reduce the weight of the weight adjustment portion 215. The Titanium material may generally have a flow stress of about 10 ksi at a forging temperature of about 1,100° C. and a thermal expansion coefficient of about 6.1 μin/in ° F.

Now that the forging process, and the specific concerns involving the co-forging of different materials have been discussed, FIG. 2D of the accompanying drawings shows a perspective view of a finished golf club head 200 created using the co-forging process above, wherein the golf club head 200 monolithically encases at least one weight adjustment portion 215 within the body portion 202. More specifically, in the current exemplary embodiment of the present invention, the weight adjustment portions 215 are placed near a heel portion 210 and a toe portion 212 of the golf club head 200. The placement of the weight adjustment portion 215 near a heel portion 210 and the toe portion 212 allow the golf club head 200 to have an increase in the Moment of Inertia (MOI) without the need for any secondary attachment operations; which will result in a more consistent feel upon impact with a golf ball.

Before moving onto a discussion regarding different embodiments of the present invention, it is worthwhile here to note that the exact placement of the weight adjustment portion 215 within the body portion 202 of the golf club head 200 is slightly different in every single different club head, this is the outcome of the current inventive co-forging process involves different materials. More specifically, the exact placement of the weight adjustment portion 215 may differ with each single golf club 200, as the flow stress of the first material and the second material will help determine the final location of the weight adjustment portion 215. In addition to the above, it should be noted that the interface between the weight adjustment portion 215 and the body portion 202 of the golf club head 200 may generally be an irregular interface, with the boundaries jagged to indicate that the entire golf club head 200 has been co-forged. This is dramatically different from a cavity created via a post machining secondary operations such as milling and drilling; which generally have clean bifurcation lines of the two different materials.

FIGS. 3A-3D of the accompanying drawings shows an alternative embodiment of the present invention wherein two separate weight adjustment portions 314 and 315 are placed at different portions of the pre-form billet 301 to create a golf club head 300 with a different performance criteria. More specifically, the golf club head 300 shown in FIG. 3D may have a lightweight weight adjustment portion 314 near a topline portion 306 of the golf club head 300 and a heavyweight weight adjustment portion 315 near a sole 308 of the golf club head 300 to help shift the Center of Gravity (CG) of the golf club head 300 lower to help with launch and spin characteristics of the current inventive golf club head 300.

Figure 3D:
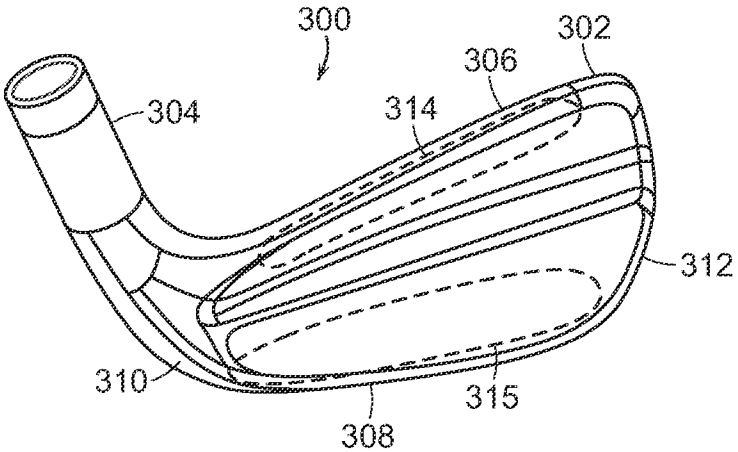
FIGS. 3A-3D shows perspective views of pre-formed billets used to create a golf club head in accordance with an exemplary embodiment of the present invention.
Figure 3A:
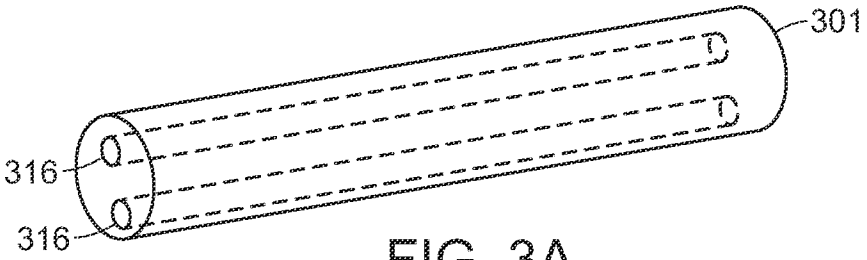
Figure 3B:
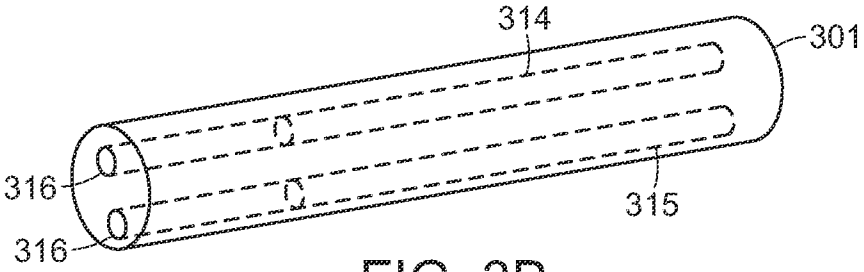
Figure 3C:
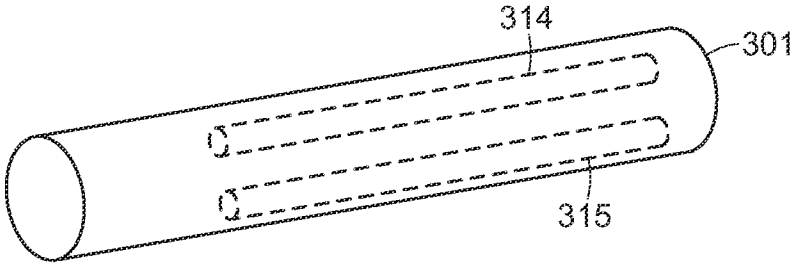
Figure 4D:
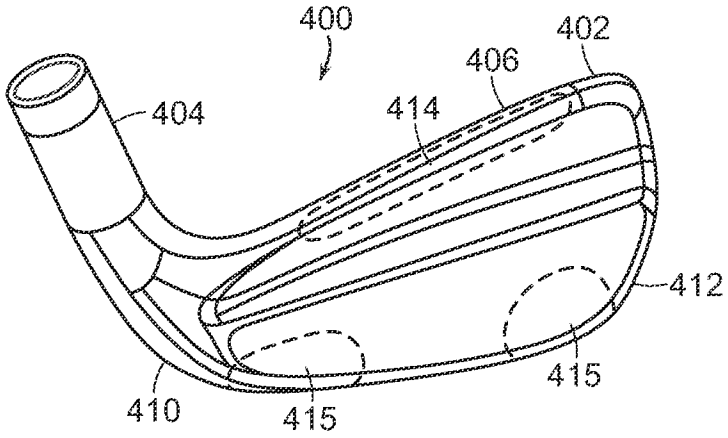
FIGS. 4A-4D shows perspective views of pre-formed billets used to create a golf club head in accordance with an exemplary embodiment of the present invention.
Figure 4A:
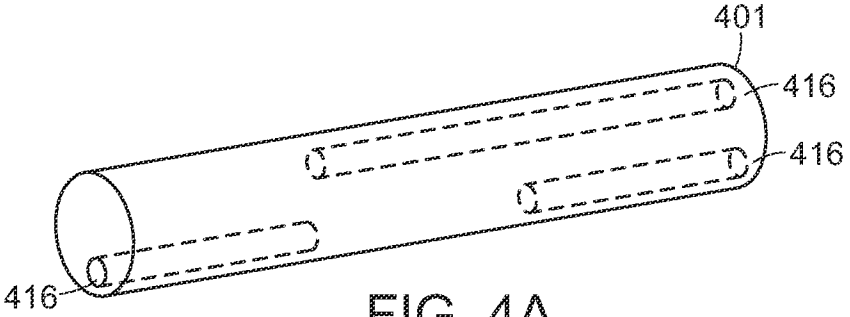
Figure 4B:
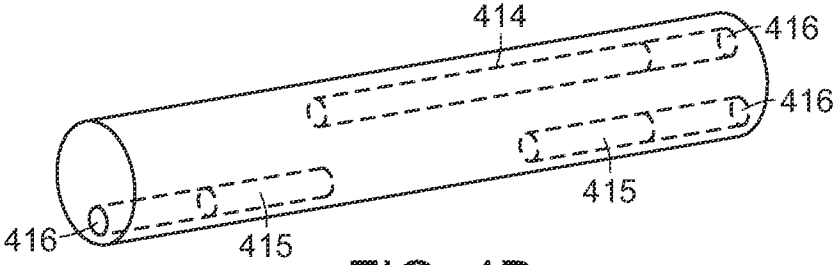
Figure 4C:
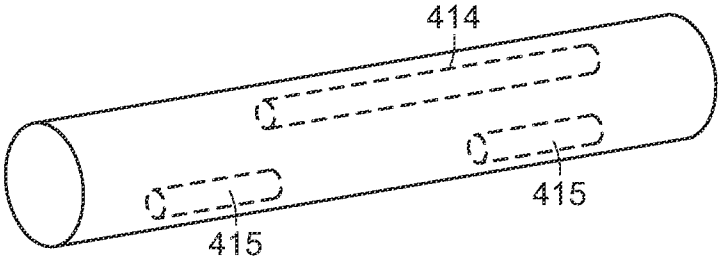

FIG. 3A-3C, similar to before, show the formation process of the current inventive golf club head 300, starting from a pre-form billet 301. More specifically, FIG. 3A shows a perspective view of a pre-form billet 301 in accordance with an exemplary embodiment of the present invention wherein a plurality of cavities 316 are drilled at strategic locations within the billet 301. It should be noted that in this current exemplary embodiment the plurality of cavities 316 are drilled near a top portion and a bottom portion of the pre-form billet 301 instead of at each of the terminal ends, as this specific embodiment focuses on lowering the CG of the golf club head 300 by removing weight from the top line portion 306 of the golf club head 300 and shifting it towards a sole portion 308 of the golf club head 300.

FIG. 3B of the accompanying drawings shows two weight adjustment portions 314 and 315 being placed inside the cavities 316 created in FIG. 3A. Although it may generally be desirable to minimize the weight near a top portion of a golf club head 300 when one desires to lower the CG, top cavity 316 can not be left completely blank in this current embodiment of the present invention, as the entire pre-form billet 301 will eventually be forged into the shape of a golf club head 300, causing any empty cavity 316 to collapse upon itself. Hence, in this current exemplary embodiment of the present invention, the top cavity 316 may be filled with a lightweight weight adjustment portion 314, while the lower cavity 316 may be filled with a heavyweight weight adjustment portion 315. The lightweight weight adjustment portion 314 may generally be made out of a third material having a third density, wherein the heavyweight weight adjustment portion 315 may generally be made out of second material having a second density. In one exemplary embodiment of the present invention, the third density may generally be less than about 7.0 g/cc, wherein the second density may generally be greater than about 7.8 g/cc; while the first material used to form the body portion 302 of the golf club head 300 may generally have a first density of about 7.8 g/cc.

FIG. 3C of the accompanying drawings shows the final stage of the pre-form billet 301 that has monolithically encased the weight adjustment portions 314 and 315 within the internal cavities 316 of the pre-form billet 301. More specifically, the creation of the pre-form billet shown in FIG. 3C involves filling in the remaining volume of the cavities 316 with a first material to encase the weight adjustment portions 315 and 316 within the pre-form billet 301. Similar to the above discussion, the pre-form billet 301, is subsequently forged to create a golf club head 300 as shown in FIG. 3D, wherein the weight adjustment portions 314 and 315 are monolithically encased within the body portion 302 of the golf club head 300.

Similar to the methodology described above, the co-forging of the third material within the cavity created within the first material, the third material may generally need to have a third flow stress that is similar with the first flow stress of the first material and a third thermal expansion coefficient less than the first thermal expansion coefficient of the first material. More specifically, in one exemplary embodiment of the present invention, the third material may be a 6-4 Titanium material having a third flow stress of about 10 ksi at a forging temperature of about 1,100° C. and a third thermal expansion coefficient of about 6.1 μin/in ° F.

Although FIGS. 2A-2D and FIGS. 3A-3D show different embodiments of the present invention used to achieve a higher MOI and a lower CG respectively, these features are not mutually exclusive from one another. In fact, in a further alternative embodiment of the present invention shown in FIGS. 4A-4D, features may be taken from both embodiments discussed above to create a co-forged golf club head with a higher MOI as well as a lower CG all without departing from the scope and content of the present invention. More specifically, in FIGS. 4A-4D, the steps needed to incorporate a lightweight weight adjustment portion 414 near a top portion 406 of a golf club 400 together with two or more heavyweight weight adjustment portions 415 near a toe portion 412 and a heel portion 410 of the golf club head 400 to create a golf club with higher MOI and a lower CG.

FIG. 5A-5D of the accompanying drawings shows a further alternative embodiment of the present invention wherein the body portion 502 of the golf club head 500 may be comprised of a monolithically encased weight adjustment portion 514. In this current exemplary embodiment of the present invention, the weight adjustment portion 514 may be relatively large in size, allowing it to replace a majority of the body portion 502 of the golf club head 500 once the forging process is completely. In this current exemplary embodiment of the present invention, the monolithically encased weight adjustment portion 514 may generally be made out of a third material having a third density that is significantly lower than the first density of the first material used to form the body portion 502 of the golf club head 500; allowing weight to be taken out from the body portion 502 of the golf club head 500. Because the lightweight third material used to form the weight adjustment portion 514 may generally be relatively soft compare to the first material, it is generally desirable to monolithically encase the weight adjustment portion 514 within the internal body of the golf club head 500, allowing significant weight savings to be achieved without sacrificing feel.

Figure 5D:
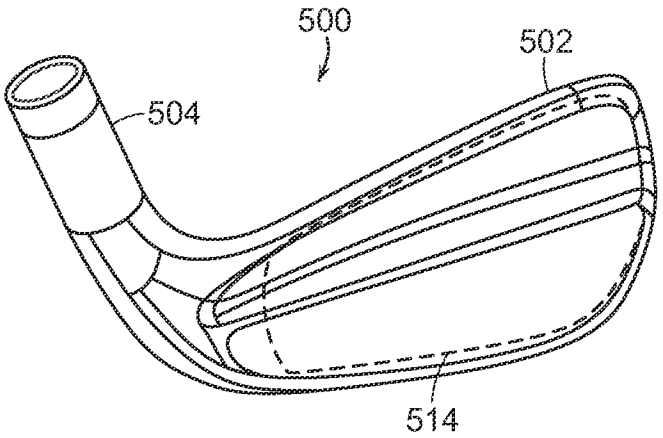
FIGS. 5A-5D shows perspective views of pre-formed billets used to create a golf club head in accordance with an exemplary embodiment of the present invention
Figure 5A:
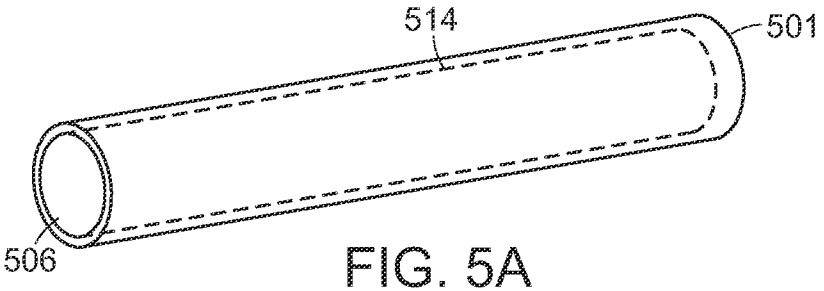
Figure 5B:
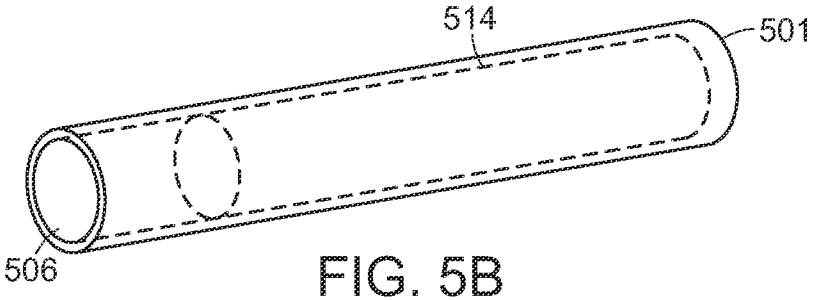
Figure 5C:
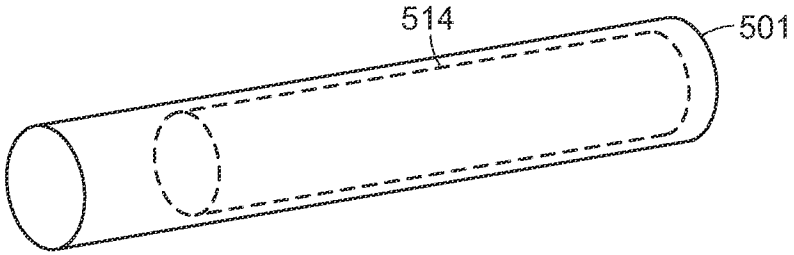

More specifically FIG. 5A of the accompanying drawings shows a pre-form billet 501 similar to the previous figures. However, in this current exemplary embodiment, the cavity 506 is significantly larger within the pre-form billet 501 itself. This large cavity 506 can then be used in FIG. 5B to be filled with a weight adjustment portion 514 to adjust the weight, density, and overall feel of the golf club head 500. In FIG. 5C, similar to described above, the remaining volume of the cavity 516 is filled with the original first material before the entire pre-form billet 501 is subjected to the forging process to create a golf club head 500.

It is worth noting here that in this current exemplary embodiment, the hosel portion 504 of the golf club head 500 is deliberately made from the conventional first material, as the bending characteristics of the second material used to form the weight adjustment portion 514 may generally not be suitable for the bending requirements of an iron type golf club head 500. More specifically, the third material used to form the weight adjustment portion 514 could be a lightweight iron-aluminum material having a density of less than about 7.10 g/cc, more preferably less than about 7.05 g/cc, and most preferably less than about 7.00 g/cc, all without departing from the scope and content of the present invention. However, numerous other materials can also be used as the third material used to form the weight adjustment portion 514 without departing from the scope and content of the present invention so long as the third material has a density within the range described above.

Figure 6:
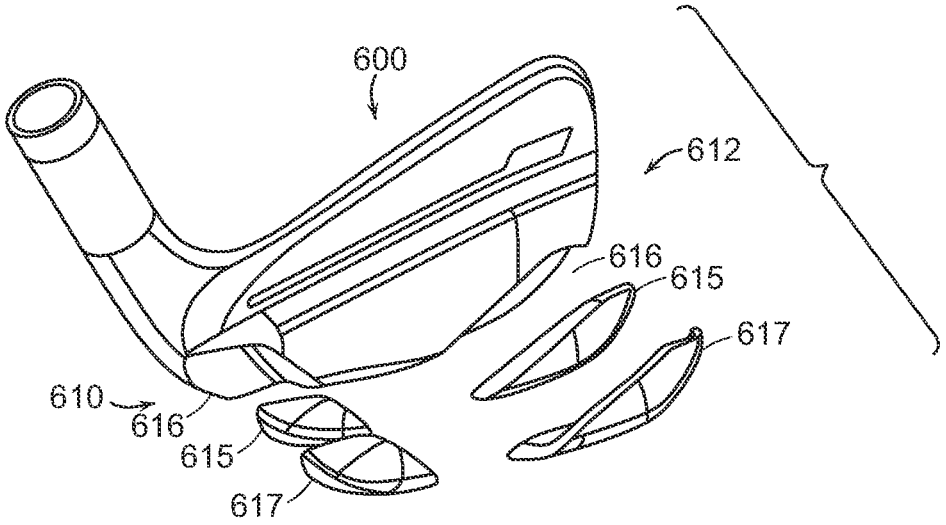
FIG. 6 shows an exploded rear perspective view of a golf club head created using a multi-step co-forging method in accordance with a further alternative embodiment of the present invention.

FIG. 6 of the accompanying drawings shows an exploded rear perspective view of a golf club head 600 in accordance with a further alternative embodiment of the present invention utilizing a multi-step co-forging process. This multi-step co-forging process, the details of which will be described subsequently in FIGS. 8-14, allows for an improvement in the ability to precisely place different weight members within different parts of the golf club head 600. This improvement in the ability to precisely place weighting members not only opens the door to allow multiple different materials to be forged together that were previously impossible due to their inherent material limitations, but it also allows for more improvements in the performance characteristics of a golf club 600 than previously discussed.

More specifically, FIG. 6 of the accompanying drawings shows a co-forged golf club head 600 created using the multi-step co-forging process. The golf club head 600 have heavier density weight adjustment portions 615 at the heel 610 and toe 612 portion of the golf club head 600 corresponding to their respective cavities 616. The weight adjustment portions 615 are then combined with caps 617 to retain the weight adjustment portions 615 together with the body of the golf club head 600 during the co-forging process. It should be noted that the current exemplary golf club head 600 utilizes a multi-step co-forging process to install the heavy weight adjustment portions 615 without the need of post manufacturing finishes such as welding, brazing, swaged, or the like. As previously mentioned, the benefit of utilizing such a co-forged process is the uniformity and consistency of the material, resulting in superior performance and feel. However, in addition to the benefit articulated above, the current embodiment of the present invention allows the heavy weight adjustment portions 615 to be placed at the extremities of the golf club head 600, further improving the center of gravity location as well as the moment of inertia of the golf club head 600.

Figure 7:
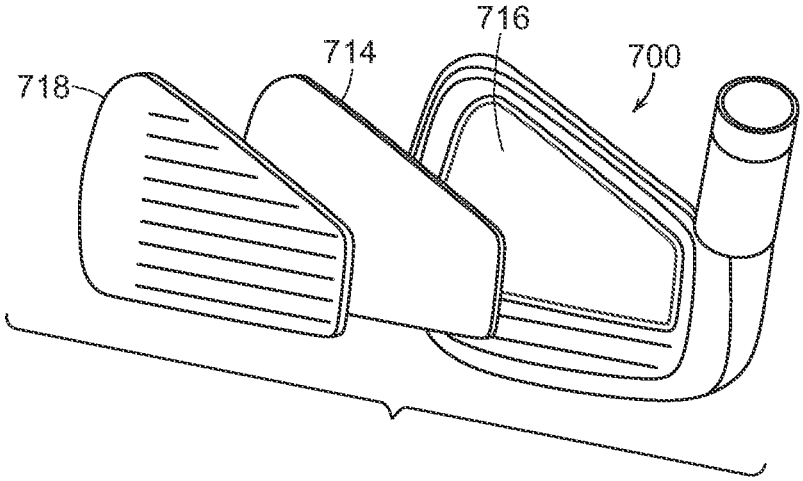
FIG. 7 shows an exploded frontal perspective view of a golf club head created using a multi-step co-forging method in accordance with a further alternative embodiment of the present invention.

FIG. 7 of the accompanying drawings shows an exploded frontal perspective view of a golf club head 700 in accordance with a further alternative embodiment of the present invention. More specifically, golf club head 700 incorporates a lightweight weight adjustment portion 714 behind a striking face 718 portion of the golf club head 700 within a cavity 716 in a multi-step co-forging process. In this current exemplary embodiment of the present invention, due to the precision co-forging process discussed above, the location and placement of the lightweight weight adjustment portion 714 can be more precisely placed, hence creating the opportunity to reduce weight from the striking face 718 portion of the golf club head 700. In order to understand the current multi-step co-forging process, FIGS. 8-14 have been presented below, detailing the steps involved in this multi-step co-forging process.

Figure 8:
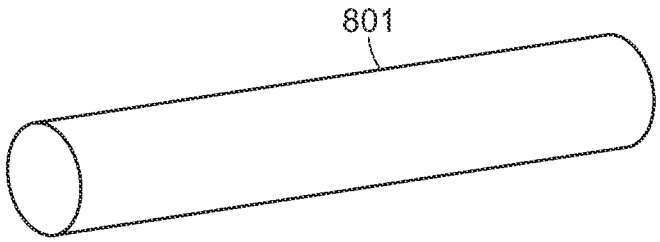
FIG. 8 shows a pre-formed billet used in a multi-step co-forging method to create a golf club head in accordance with an alternative embodiment of the present invention.
Figure 9:
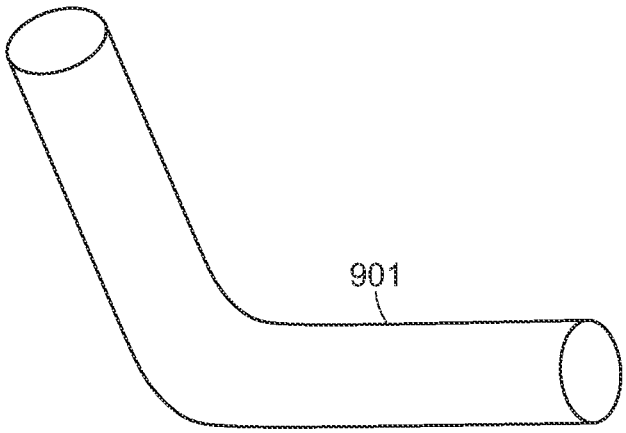
FIG. 9 shows a bent pre-formed billet during one of the multi-step co-forging process in accordance with an alternative embodiment of the present invention.
Figure 10B:
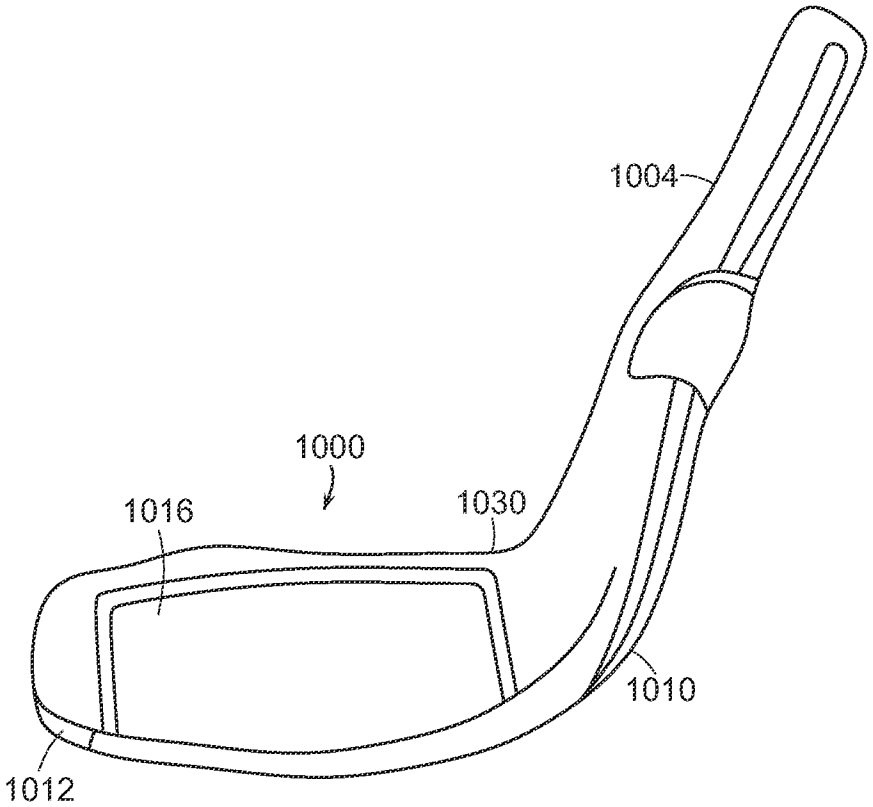
FIGS. 10*a* and 10*b* shows a rear and frontal view of a golf club head during one of the multi-step co-forging process in accordance with an alternative embodiment of the present invention.
Figure 10A:
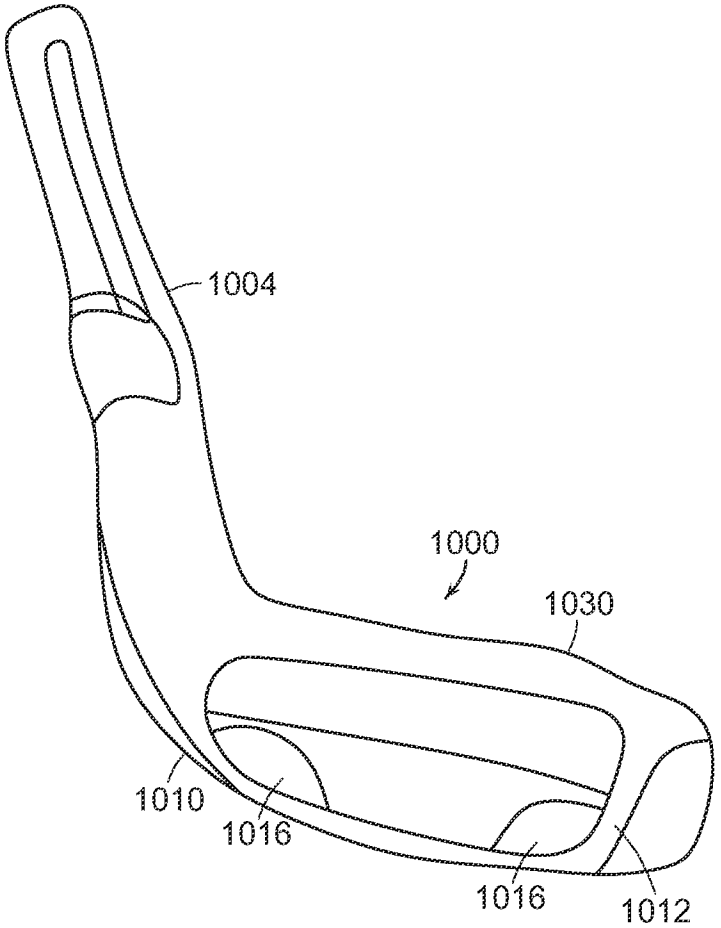

FIG. 8 of the accompanying drawings, similar to FIGS. 2-5 above, show a pre-form billet 801 used to create a forged golf club head. This forged billet 801, is then bent to an L-shape as shown in FIG. 9 to prepare the billet 901 for the die that begins the forging process. FIGS. 10*a* and 10*b* shows the frontal and rear view of a golf club head 1000 that's been subjected to the first step of the multi-step co-forging process. In this preliminary step, the billet has been forged to a shape that roughly resembles that of a golf club head 1000. In fact, even in this early stage, the shape of the golf club 1000 can be seen, as it already has a hosel portion 1004, a heel portion 1010, and a toe portion 1012. In the rear view of the golf club head 1000 shown in FIG. 10*a*, preliminary imprints of the cavity 1016 can already be seen in the heel 1010 and toe 1012 portion of the golf club head; while in the frontal view of the golf club head 1000 shown in FIG. 10*b*, the cavity 1016 can already be seen near the striking face.

Subsequent to the initial forging step, the excess trim 1030 may be removed from the golf club head 1000 and subsequent to that, subjected to another rough forging step. During the forging process, the excess material may flow outside of the confines of the die, resulting in what is commonly known as "flash". This flash material, as previously discussed, may be trimmed off in between the individual multi-forging steps to improve the adherence to the die in subsequent steps.

Figure 11B:
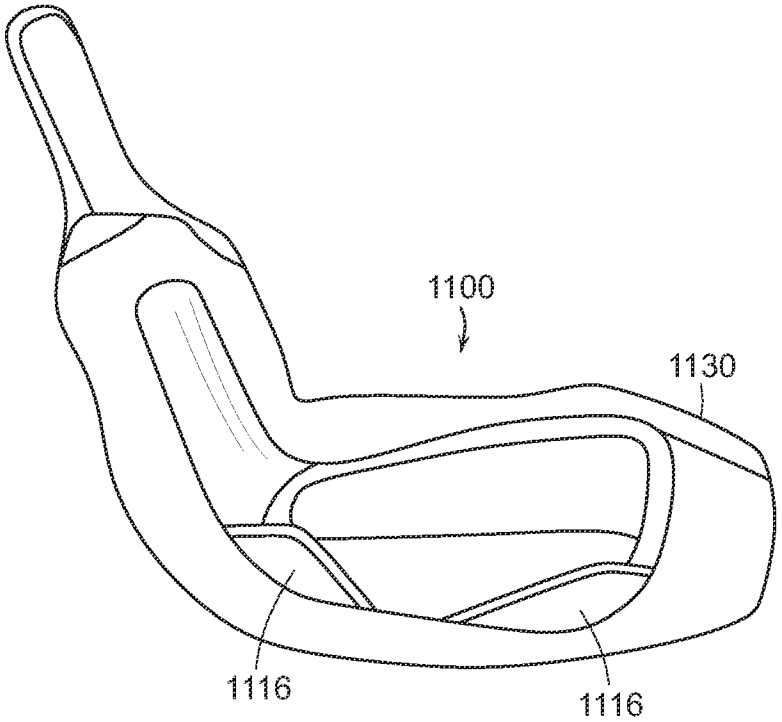
FIGS. 11*a* and 11*b* shows a rear and frontal view of a golf club head during one of the multi-step co-forging process in accordance with an alternative embodiment of the present invention.
Figure 11A:
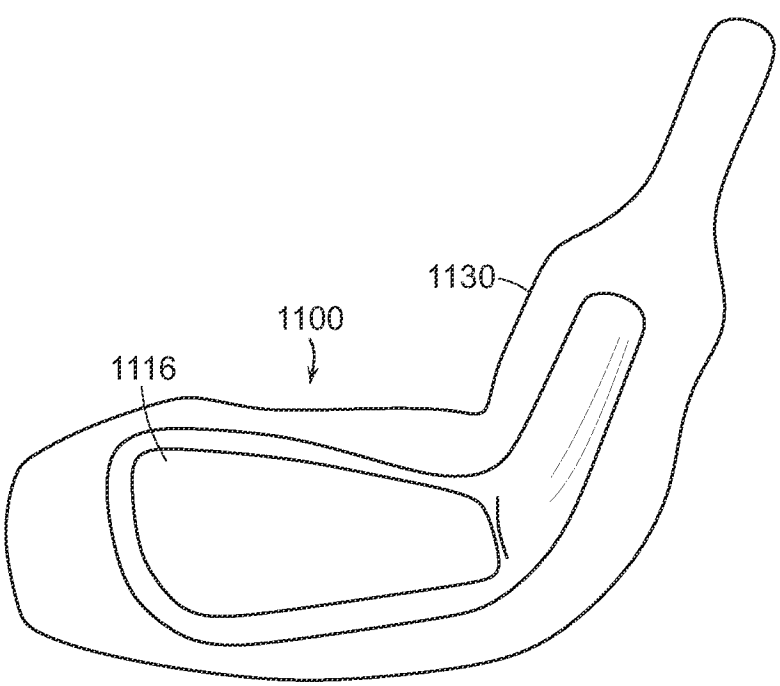

The results of this secondary forging step can be shown in FIGS. 11*a* and 11*b*. As it can be seen from FIGS. 11*a* and 11*b*, the golf club head 1100 in this current state, is starting to take on a shape that more closely resembles that of a finished product. In addition to the overall shape being more defined, the boundaries and shapes of the cavities 1116 are also starting to take on their respective shape as well. Subsequent to this secondary forging step, the weight adjustment portions can be added into the specific cavities 1116 before the golf club head 1100 is subjected to the final forging step.

Figure 12B:
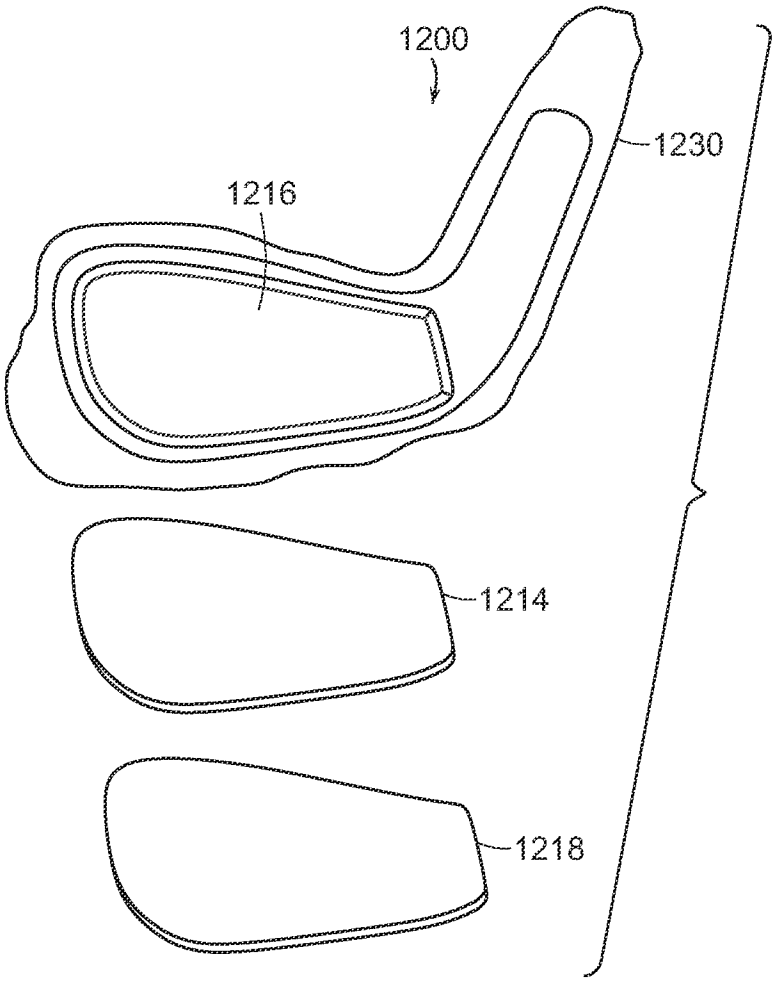
FIGS. 12*a* and 12*b* shows a rear and frontal exploded view of a golf club head during one of the multi-step co-forging process in accordance with an alternative embodiment of the present invention.
Figure 12A:
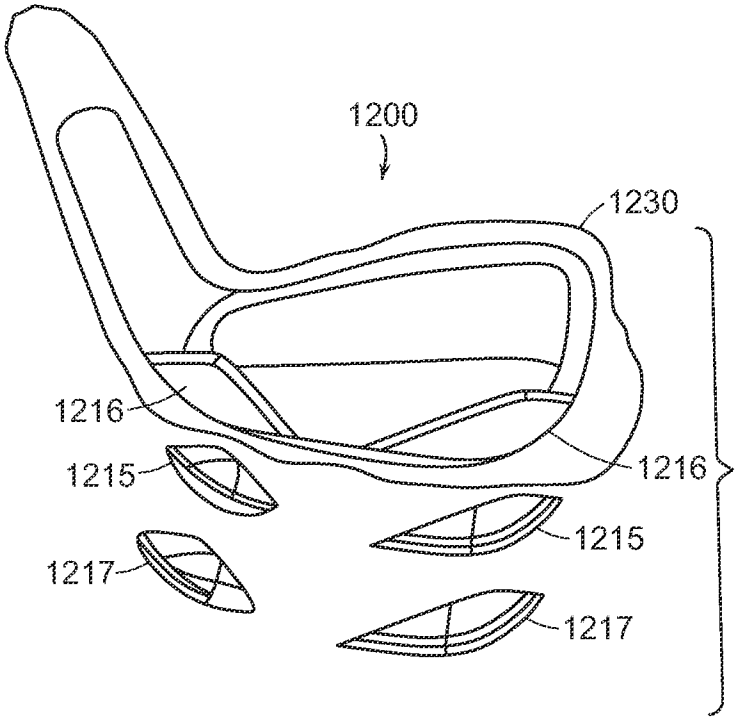

The relationship between the weight adjustment portions to the cavities 1116 on the golf club head 1100 can be shown more clearly in FIGS. 12*a* and 12*b*. Here, in FIGS. 12*a* and 12*b*, it can be seen that the cavity 1216 on the rear portion of the golf club head 1200 may be filled with weight adjustment portions 1215 that may generally have a higher density than the body of the golf club head 1200. The high density weight adjustment portions 1215 may then be covered up with a cap 1217 made out of a similar material as the body of the golf club head 1200, allowing high density weight adjustment portions 1215 to be retained within the cavity 1216. In the front of the golf club head 1200, the cavity 1216 may be filled with a weight adjustment member 1214 having a lower density than the body portion of the golf club head 1200. Similar to the rear, this weight adjustment portion 1214 may be secured in the cavity 1216 with a cap like mechanism that also serves as a striking face 1218. The striking face 1218, similar to the cap 1217, may be made out of a similar material as the body of the golf club head 1200. Having the cap 1217 and the striking face 1218 be made out of the same material as the remainder of the body of the golf club head 1200 is beneficial because it allows these two components to be welded to the body portion of the golf club head 1200. Having these components welded in place allows the weight adjustment portions 1215 to be secured within their own respective cavities 1216 before the final forging step that completes the current multi-step co-forging process.

In an alternative embodiment of the present invention, the cap 1217 may not even be necessarily needed to completely cover up the cavity 1216 and the weight adjustment member 1214. In fact, in an alternative embodiment of the present invention, the cap 1217 only needs to partially cover the weight adjustment portion 1215 to a degree that sufficiently prevents the weight adjustment portion 1215 from separating from the body of the golf club head 1200.

Figure 13B:
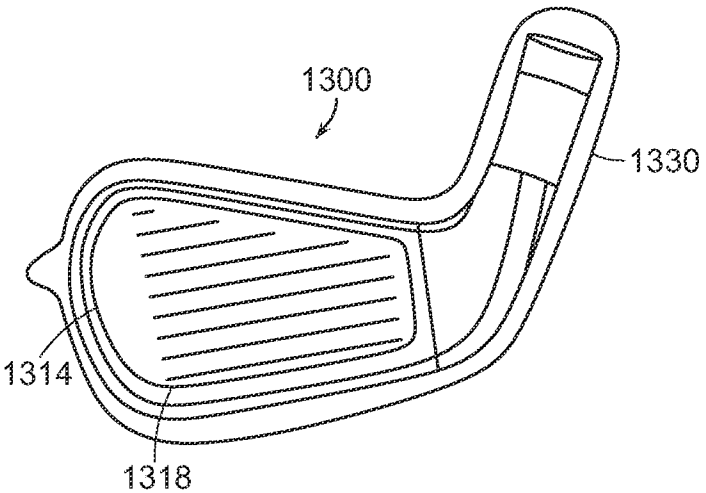
FIGS. 13*a* and 13*b* shows a rear and frontal view of a golf club head during one of the multi-step co-forging process in accordance with an alternative embodiment of the present invention.
Figure 13A:
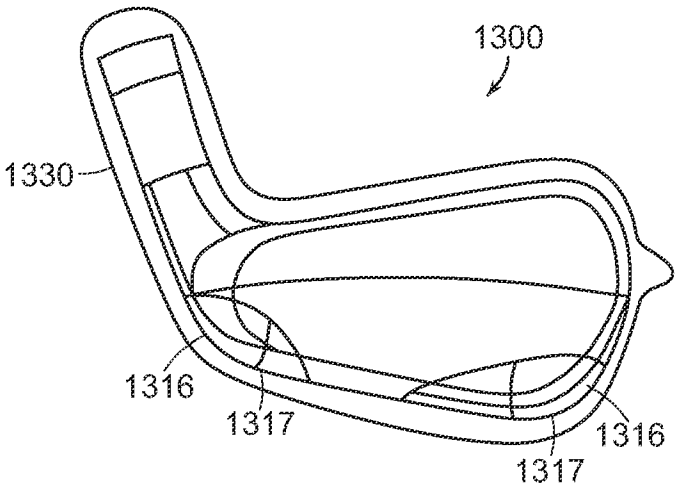

The final forging process involved in this process is generally creates a golf club head 1200 that can be considered "co-forged", as now the golf club head 1200 contains two or more different materials being forged together in this final step. FIGS. 13*a* and 13*b* show the results of the golf club head 1300 after it has completed the final co-forging step. In its current state, the golf club head 1300 has taken its final shape, and the weight adjustment members 1316 and 1314 are all now monolithically enclosed within their respective cavities by the caps 1317 and striking face plate 1318. Although the golf club head 1300 may have taken their form, there are still excessive flash 1330 around the perimeter of the golf club head 1300 that needs to be trimmed before the golf club head 1300 takes its final form.

Figure 14B:
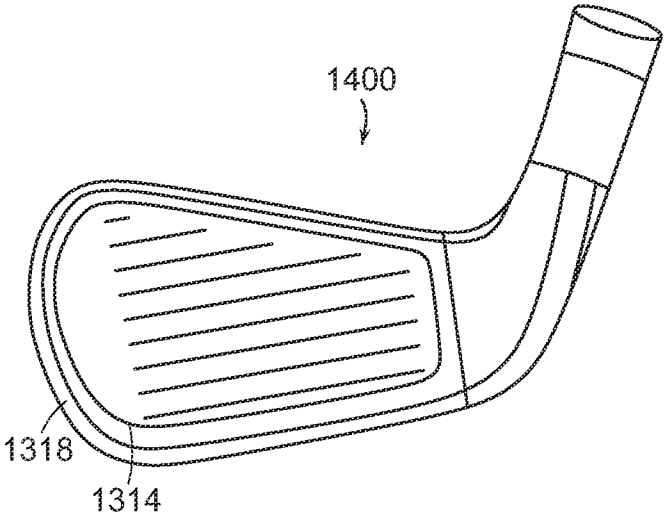
FIGS. 14*a* and 14*b* shows a rear and frontal view of a finished golf club head after the multi-step co-forging in accordance with an alternative embodiment of the present invention.
Figure 14A:
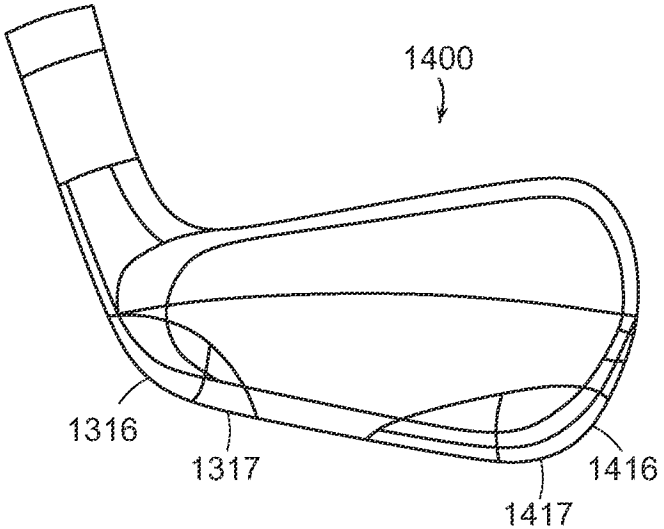

FIGS. 14*a* and 14*b* show the completed golf club head 1400 as a result of this co-forging process. As it can be seen here in FIGS. 14*a* and 14*b*, the excess flash 1330 has already been trimmed, improving the aesthetic appeal of the golf club head 1400. As previously mentioned, as a result of this co-forging process, the weight adjustment portions 1416 and 1418 are seamlessly and monolithically encased with the body of the golf club head 1400 via the cap 1417 and the striking face plate 1318. As previously discussed, the advantage of having the weight adjustment portions 1416 seamlessly and monolithically encased with the body of the golf club head 1400 via this co-forged process is that it prevents rattling, and improves the solid feel of the golf club head 1400. In fact, utilizing this process, the present golf club head can achieve a feel that is almost non-discernible from a unitary forged golf club head utilizing conventional forging methodologies.

Alternatively speaking, it can also be said that this present multi-step co-forging methodology creates a unique relationship between the weight adjustment portions 1416 and 1418 and the cavity 1216 (see FIG. 12) that it sits in. More specifically, it can be said that the outer surface area of the weight adjustment portion 1416 may generally be identical to the inner surface area of the cavity 1216. The cavity 1216 may generally include the surface area of any caps 1217 or face plate 1218 used to complete the cavity 1216 created by the rough forging steps. (See FIG. 12) Although the symmetry in shape and surface area between the cavity 1216 and the weight adjustment portion 1416 may not appear like an innovative achievement initially, the reality of the situation is that unless a co-forged step is involved, such a seamless interface between the two components are impossible to achieve. Given the bonding constraints of the materials used for different parts of the golf club head, the current innovative co-forging method is the only way to achieve such a seamless interface between these components.

Figure 15:
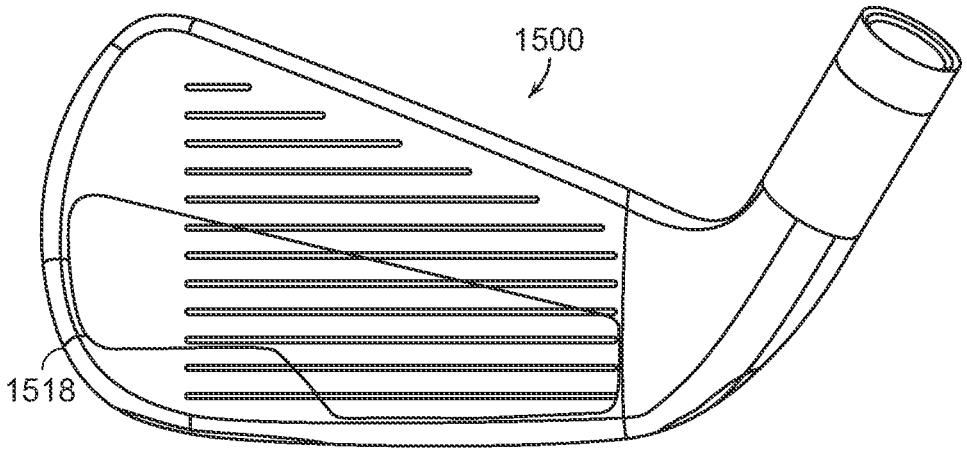
FIG. 15 shows a frontal view of a golf club head in accordance with an alternative embodiment of the present invention.

FIG. 15 of the accompanying drawings shows a frontal view of a finished product golf club head 1500 in accordance with an alternative embodiment of the present invention utilizing the co-forged technology previously described. In this embodiment, the striking face insert 1518 may only partially cover the lower portion of the golf club head 1500, allowing a cavity to be created only in the lower portion of the golf club head 1500. This specific bifurcation of the club head 1500 may be beneficial in improving the performance of the golf club head 1500 in creating a dual cavity design that provides structural support near the central hemisphere of the club head 1500 to provide a more solid feel during impact.

Figure 16:
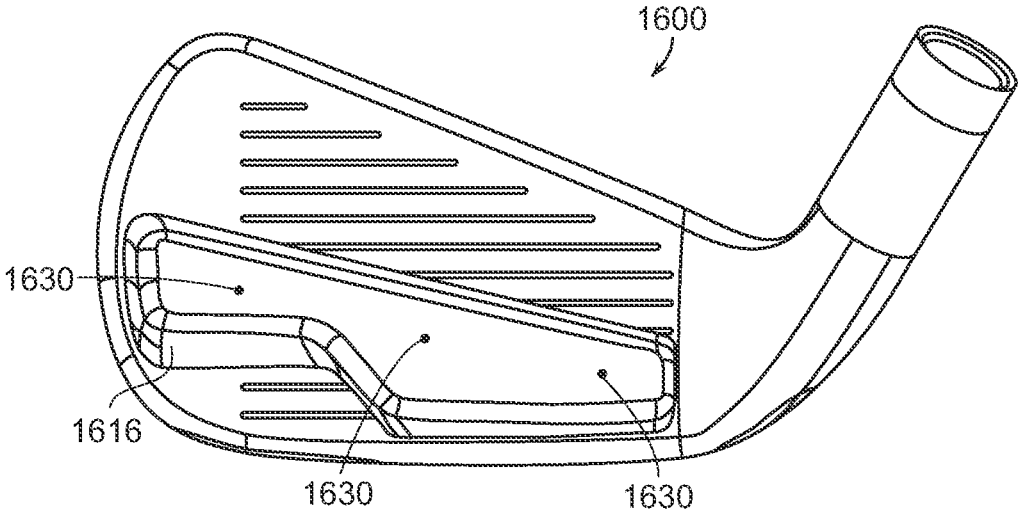
FIG. 16 shows a frontal view of a golf club head in accordance with an alternative embodiment of the present invention without the striking face showing a cavity.

FIG. 16 of the accompanying drawings shows a frontal view of a golf club head 1600 without the striking face insert 1518 (shown in FIG. 15). This view of the golf club head 1600 allows the internal face cavity 1616 to be shown more clearly, illustrating a plurality of support rods 1630 that may be used to further provide structural support to the striking face portion. In one embodiment, the plurality of rods 1630 may be circular rods as shown in FIG. 16 dispersed throughout the internal walls of the face cavity 1616. However, in other embodiments, the plurality of rods 1630 may not even be cylindrical, but be square, rectangular, or any other shape all without departing from the scope and content of the present invention so long as it is provides any sort of localized support for the striking face. In addition to the variation in the geometry of the rods 1630, the placement of the rods 1630 need not be dispersed throughout the internal walls of the face cavity 1616, in fact, the location of the rods 1630 may be placed at any one of many numerous locations all without departing from the scope and content of the present invention. Finally, it should be noted that in an alternative embodiment of the present invention, the face cavity 1616 may not even require any supporting rods 1630, and the face cavity 1616 may be entirely hollow without departing from the scope and content of the present invention.

Figure 17:
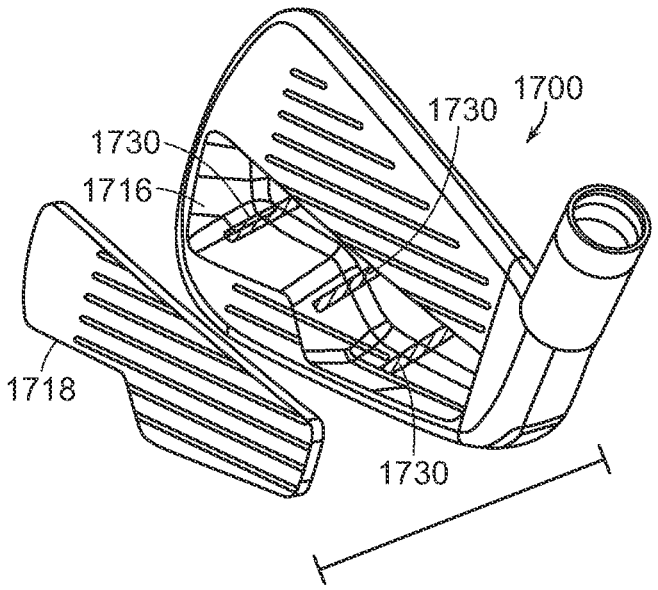
FIG. 17 shows a perspective exploded view of a golf club head in accordance with an alternative embodiment of the present invention.

FIG. 17 of the accompanying drawings shows an exploded perspective view of a golf club head in accordance with the embodiment of the present invention shown in FIGS. 15 and 16. More specifically, this exploded view allows the relationship and fit between the striking face insert 1718 and the face cavity 1716 of the golf club head 1700 to be shown more clearly. It should be noted that although the earlier discussion talk about using a co-forged process to join together different metals that cannot be easily welded together, the connection between the striking face insert 1718 and the body of the golf club head 1700 involves a hollow face cavity 1716 portion that could cause the striking face insert 1718 to deform during a forging process. Luckily, in the current embodiment, the material used for the striking face insert 1718 may be similar to that of the body portion 1700, allowing the two components to be joined together using a conventional welding process after the other components are co-forged together.

Another feature worth identifying is the length of the plurality of rods 1730. The plurality of rods 1730, in order to provide structural support to the striking face insert 1718, may generally touch the rear surface of the striking face insert 1718. Alternatively speaking, it can be said that the terminal ends of the plurality of rods 1716 may contact a rear surface of the striking face insert 1718 to provide the structural enhancement. However, in an alternative embodiment, the terminal ends of the plurality of rods 1716 may terminate just short of the rear surface of the striking face insert 1718 creating a gap; promoting face flexure upon impact with a golf ball while creating a backstop to preserve the elastic deformation of the striking face insert 1718 material.

Figure 18:
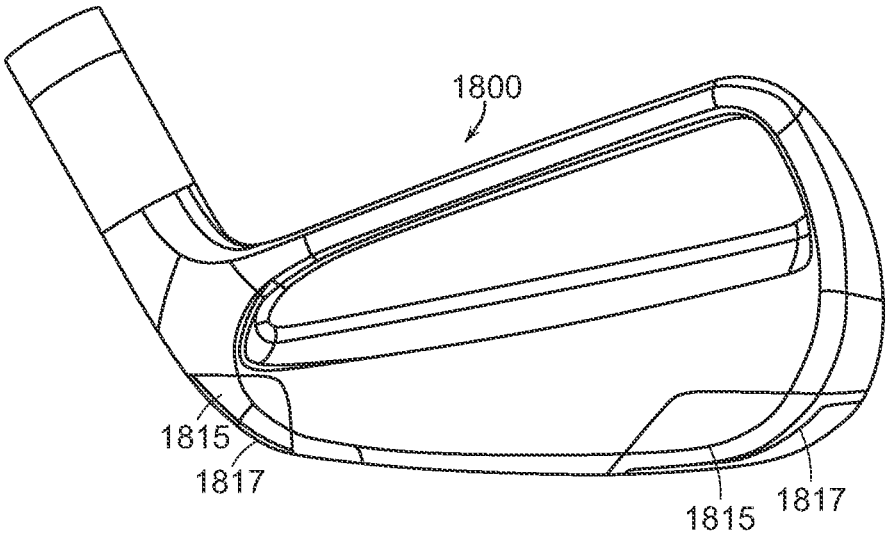
FIG. 18 show a back view of a golf club head in accordance with an alternative embodiment of the present invention.

FIG. 18 of the accompanying drawings shows a back view of a golf club head 1800 having one or more weights 1815 and caps 1817 joined together using the co-forged process described above. Without repeating the process described above, FIGS. 19-20 will show a toe and heel exploded view of the various components that will be created using the co-forged process described above.

Figure 19:
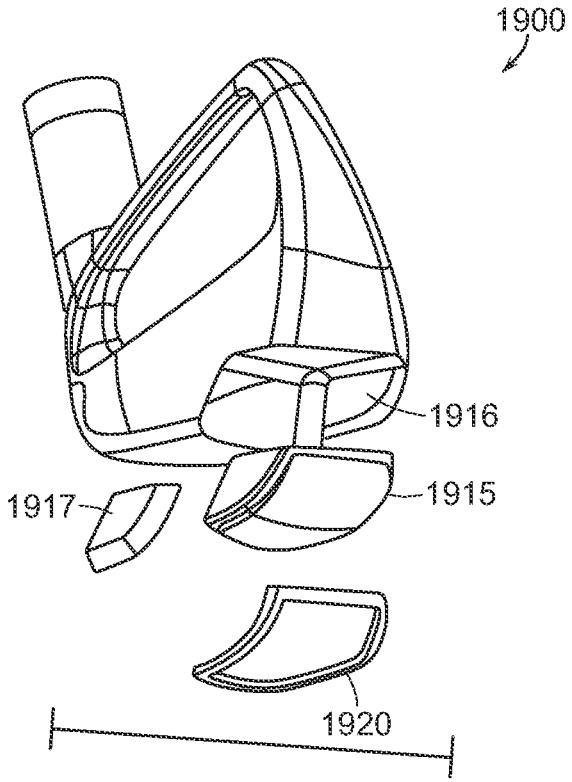
FIG. 19 shows a toe side exploded view of a golf club head in accordance with an alternative embodiment of the present invention.

FIG. 19 shows an exploded toe perspective view of a golf club head 1900 illustrating the various components of the weighting system in accordance with this embodiment of the present invention. The exploded view of the golf club head 1900 is not illustrative of the methodology used to create the weighting system, but rather is only presented here to illustrate how the components could be used together in the co-forging process described above to create the golf club head 1900. More specifically, the weighting system here comprises a weight cavity 1916, a weight 1915, a cap 1979, and welding material 1920. The weight cavity 1916 is formed here in the rough forging step, after which the weight 1915 is tack welded within the weight cavity 1916 with the cap 1917 using the welding material 1920. After the various components are roughly connected to one another, the entire golf club head 1900 is subjected to a final forging step as described above in FIGS. 13*a* and 13*b*.

Figure 20:
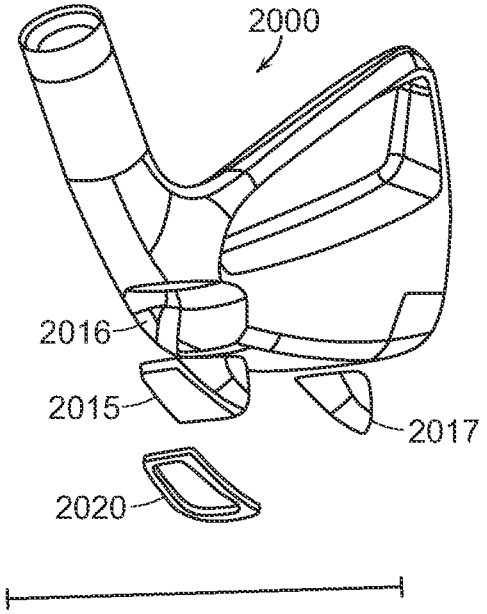
FIG. 20 shows a heel side exploded view of a golf club head in accordance with an alternative embodiment of the present invention.

FIG. 20 shows an exploded heel perspective view of a golf club head 2000 illustrating the various components of the weighting system in accordance with this embodiment of the present invention. Similar to the discussion above for FIG. 19, this view is provided to illustrate the relationship between the components.

In addition to above, the current multi-step co-forging process may differ from the pure co-forging process in that it no longer requires the two materials to have similar flow stresses between the different materials. This elimination of the requirement that the material needs to have similar flow stresses may be beneficial because it allows a wider range of materials to be used, especially when it comes to exotic materials providing extreme weighting benefits such as Tungsten. The current multi-step co-forging process is capable of achieving this by forging the cavity for the weight before using a final cap type material to fill the gap around the cavity to completely enclose the weight adjustment portion within the cap type material. Despite the elimination of the need for the materials to have similar flow stress, the need for the second material to have a smaller thermal expansion coefficient as the first material still stands true in this multi-step co-forging process. This requirement still stands because the second material, although encompassed in a cavity via a cap, is still subjected to the same forging temperature as the external first material. Any excessive expansion of the second material would degrade the structural rigidity of the cap, causing potential failures in the bonding process.

Figure 21:
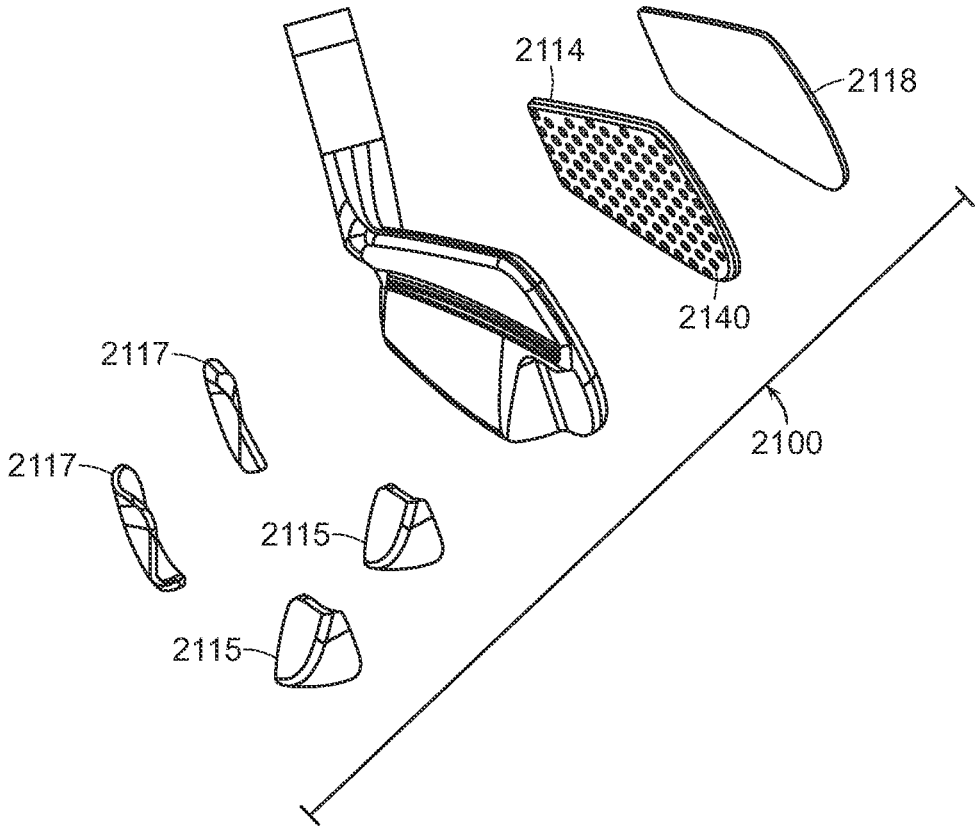
FIG. 21 shows an exploded perspective view of a golf club head in accordance with an alternative embodiment of the present invention.

FIG. 21 of the accompanying drawings shows an exploded view of a golf club head 2100 in accordance with an alternative embodiment of the present invention. In this alternative embodiment of the present invention, the golf club head 2100 may contain very similar components as previously mentioned, such as a plurality of high density weight adjustment portions 2115, a plurality of caps 2117, a lightweight weight adjustment portion 2114, and striking face 2218 similar to the discussion earlier regarding FIGS. 6 and 7. However, it be seen here that the lightweight weight adjustment portion 2214 here looks significantly different from prior art embodiments in that it now incorporates a unique geometry not previously shown. More specifically, a closer examination of FIG. 21 shows the lightweight weight adjustment portion further comprising a plurality of cutouts 2140 across the lightweight weight adjustment portion 2114. It is worth noting here that the plurality of cutouts 2140 shown in this current exemplary embodiment may be substantially evenly distributed across the entirety of the lightweight weight adjustment portion 2114 to promote an even bond between the various components without departing from the scope and content of the present invention. The incorporation of this cutout 2140 feature into the lightweight weight adjustment portion serves to improve the performance of the golf club head in multiple aspects. In one aspect, the most immediate and recognizable benefit of the incorporation of the plurality of cutouts 2140 is the further reduction of weight in the lightweight weight adjustment portion 2114. In addition to the benefit of removing weight from the lightweight weight adjustment portion 2114, the plurality of cutouts 2140 may serve a subtle, but very important purpose of helping the lightweight weight adjustment portion from shifting its position relative to the body of the golf club head 2100 and the striking face 2128.

Understanding that the current golf club head 2100 is created using the co-forging process described above, the ability of the various components to be formed together in a solidary structure is very important to the proper functionality of the overall club head 2100. This structural integrity becomes even more important when an insert is added near the striking face portion 2128 of the golf club head 2100. In order to help preserve the structural integrity of the various components, the plurality of cutouts 2140 allows a little bit of the material of the striking face 2128 to flow into the cutouts 2140, creating a better bond between the different components. This deformation of the material of the striking face 2128 helps improve the bond between the components by prohibiting the materials from shifting relative to one another via a mechanical interface, increasing structural integrity. Finally, because the body portion is made out of a similar material as the striking face portion 2128, this deformation effect exhibited by the striking face portion 2128 may occur at the rear surface of the lightweight weight adjustment portion 2114 together with the body of the golf club head 2100 without departing from the scope and content of the present invention.

In earlier embodiments of the present invention shown in FIGS. 6 and 7, a titanium lightweight face insert 714 would have a total weight of about 21 grams; however, in the current exemplary embodiment of the present invention shown in FIG. 21, the total weight of the lightweight weight adjustment portion 2114 could be reduced by greater than about 13%, more preferably greater than about 15%, and most preferably greater than about 17% all without departing from the scope and content of the present invention. In the same example above wherein a titanium material having a density of about 4.5 g/cm$^3$ is used, the mass of the lightweight weight adjustment could be less than about 18.5 grams, more preferably less than about 17.5 grams, and most preferably less than about 17 grams, all without departing from the scope and content of the present invention.

Figure 22:
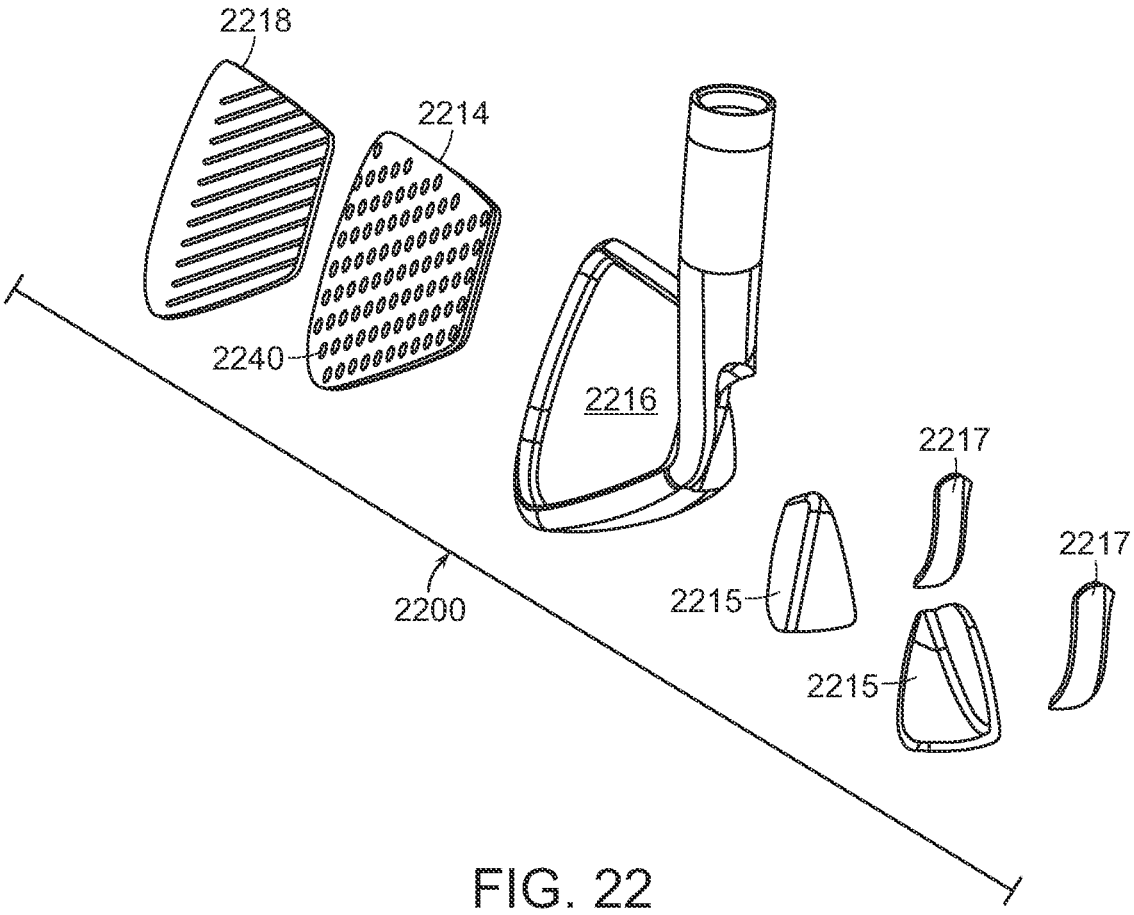
FIG. 22 shows another exploded perspective view of a golf club head in accordance with an alternative embodiment of the present invention.

FIG. 22 of the accompanying drawings shows a reversed exploded view of a golf club head 2200 in accordance with an alternative embodiment of the present invention similar to the discussion in FIG. 21. In this reversed exploded view, the cavity 2216 to which the lightweight weight adjustment member 2214 is situated can be shown more clearly. It is worth noting here that the cutouts 2240 in this exemplary embodiment of the present invention may generally have a circular shape, having a diameter of between about 1.0 mm and about 3.0 mm, more preferably between about 1.50 mm and about 2.5 mm, and most preferably about 2.0 mm. The exact diameter of the cutouts 2240 is critical to the proper function of the lightweight weight adjustment member 2214 because not only does it need to provide a sufficient amount of weight reduction, it needs to properly balance the amount of sandwiching material from seeping into the cutouts 2240. Although the preferred embodiment of the present invention utilizes circular shapes to create the cutouts 2240, numerous other shapes such as oval, triangular, rectangular, or any other shapes capable of removing material from said lightweight weight adjustment member 2214 all without departing from the scope and content of the present invention. Another different way to quantify the importance of finding the right balance of the cutout 2240 dimension is as a function of the amount of surface area removed. In the current exemplary embodiment of the present invention, the amount of frontal surface area removed by the cutouts 2240 may generally be greater than about 15% of the total surface area and less than about 30% of the total surface area, more preferably greater than about 17.5% of the total surface area and less than about 27.5% of the total surface area, and most preferably greater than about 20% of the total surface area and less than about 25% of the total surface area. Given a striking face area of about 2,400 $mm^2$ in the current exemplary embodiment of the present invention, it can be said that the frontal surface area created by the cutouts 2240 in the lightweight weight adjustment member 2214 may generally be between about 360 $mm^2$ and less than about 720 $mm^2$, more preferably greater than about 420 $mm^2$ and less than about 660 $mm^2$, and most preferably greater than 480 $mm^2$ and less than about 600 $mm^2$.

Figure 23:
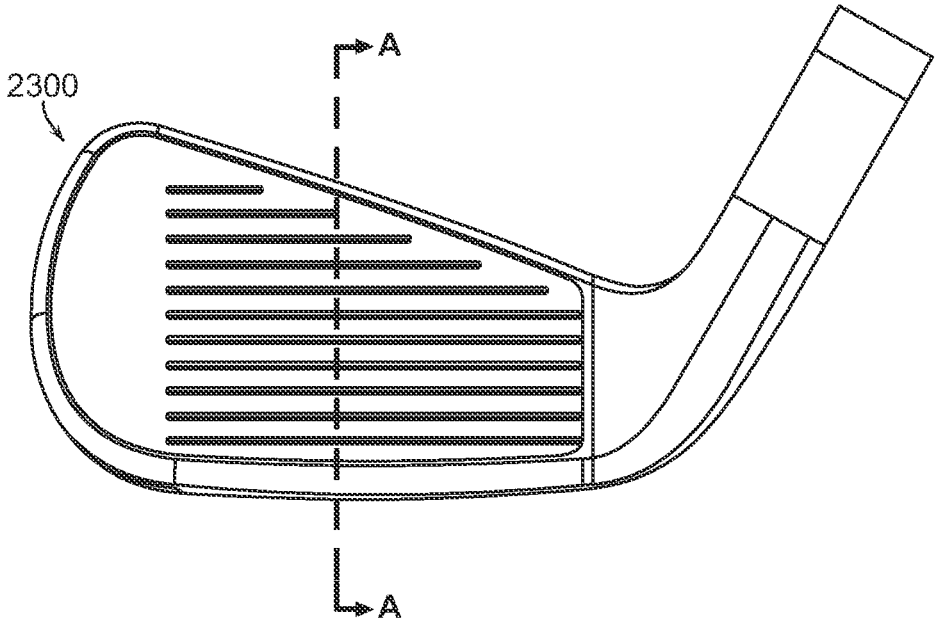
FIG. 23 shows a frontal view of a golf club head in accordance with an alternative embodiment of the present invention allowing cross-sectional line A-A' to be shown.

In order to illustrate the sandwiching material of the striking face 2218 and the body portion of the golf club head 2200 into the cutouts 2240, a cross sectional view of the golf cub head 2200 needs to be provided. However, before a cross-sectional view can be shown, FIG. 23 shows a frontal view of a golf club head 2300 allowing the cross-sectional line A-A' to be shown. Cross-sectional line A-A', as shown in this current exemplary embodiment may generally be taken across a central point of a striking face region of said golf club head 2300.

Figure 24:
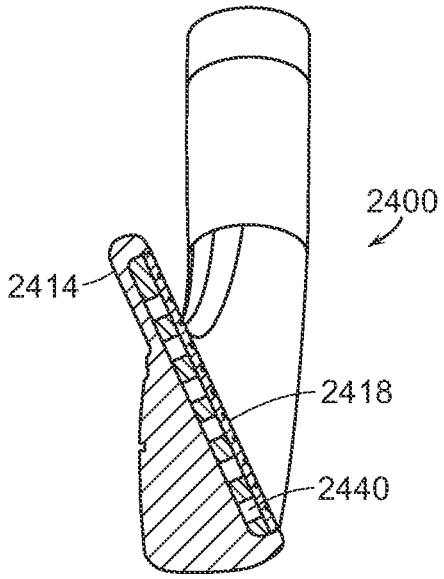
FIG. 24 shows a cross-sectional view of a golf club head in accordance with an alternative embodiment of the present invention.

FIG. 24 shows a cross-sectional view of a golf club head 2400 in accordance with an exemplary embodiment of the present invention taken along cross-sectional line A-A' shown in FIG. 23. In this cross-sectional view of the golf club head 2400 it can be seen that the cutouts 2440 are spread out along the lightweight weight adjustment portion 2414 and is sandwiched between the striking face 2418 and the back portion of the golf club head 2400. Although FIG. 24 provides a very important view allowing the relationship between the various components to be shown more clearly, it is not zoomed in enough to illustrate the subtle flow of material during the final co-forging process described above that helps provide structural rigidity to the overall golf club head 2400. In order to illustrate this, an enlarged cross-sectional view of the golf club head is provided in FIG. 25.

Figure 25:
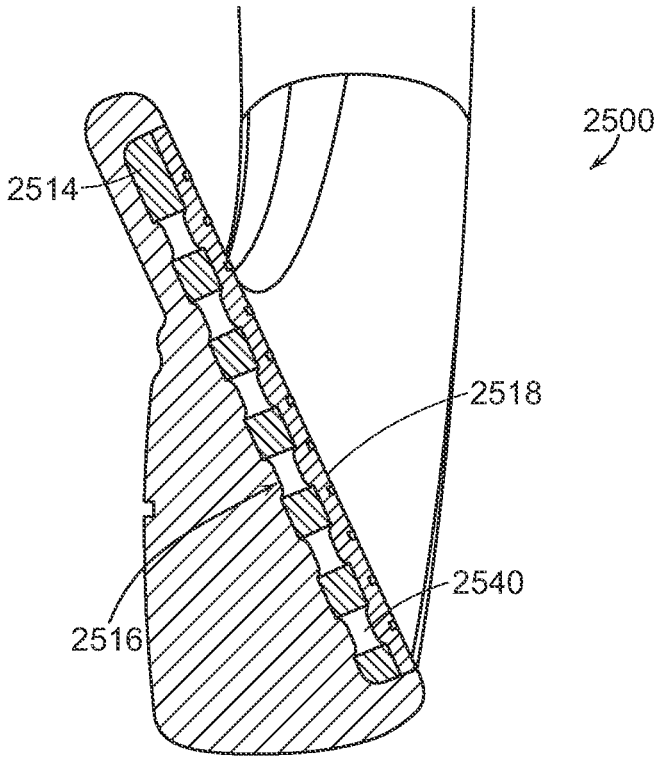
FIG. 25 shows an enlarged cross-sectional view of a golf club head in accordance with an alternative embodiment of the present invention.

FIG. 25 of the accompanying drawings shows an enlarged cross-sectional view of a golf club head 2500 in accordance with an exemplary embodiment of the present invention. In this enlarged cross-sectional view of the golf club head 2500, it can be seen that after the final forging step, a little bit of the material of the striking face 2518 has visibly sunk into the cutouts 2540. It should be noted that the very critical dimension of the cutouts 2540 indicated above allows for this slight deformation in the back of the striking face 2518 without deforming the frontal surface of the striking face 2518. In addition to the deformation of the striking face 2518, FIG. 25 of the accompanying drawings also shows a deformation of the body portion of the golf club head 2500 at the rear of the cavity 2516. It should be noted here that in this current exemplary embodiment of the present invention, the deformation of the striking face 2518 is greater than the deformation of the body portion of the golf club head 2500 at the rear of the cavity 2516 to ensure more structural rigidity. In addition to the front and back difference in the deformation, the striking face 2518 and the body portion of the golf club head 2500 may also have a top to bottom deformation difference. More specifically, a golf club head 2500 in accordance with an alternative embodiment of the present invention may generally have more deformation into the cutouts 2540 at the top near the topline than compared to the bottom near the sole.

In an alternative embodiment of the present invention, the plurality of cutouts 2540 may be completely filled or partially filled or impregnated with a polymer type material. Filling the cutouts 2540 with a polymer type material could improve the structural rigidity of the lightweight weight adjustment member 2514 and improve the feel of the golf club head 2500 during impact with a golf ball by providing vibration damping. The polymer filler could completely fill the cutouts 2540 or partially fill the cutouts 2540 both without departing from the scope and content of the present invention. In this alternative embodiment of the present invention wherein the cutouts 2540 are completely filled with the polymer, it is important to control the hardness of the polymer, as the hardness could impair the ability of the striking face 2518 and the body portion to create a mechanical lock. In one exemplary embodiment of the present invention the polymer filler within the cutouts 2540 may have a shore 00 hardness of 20 and up to a shore D hardness of 60.

Figure 26:
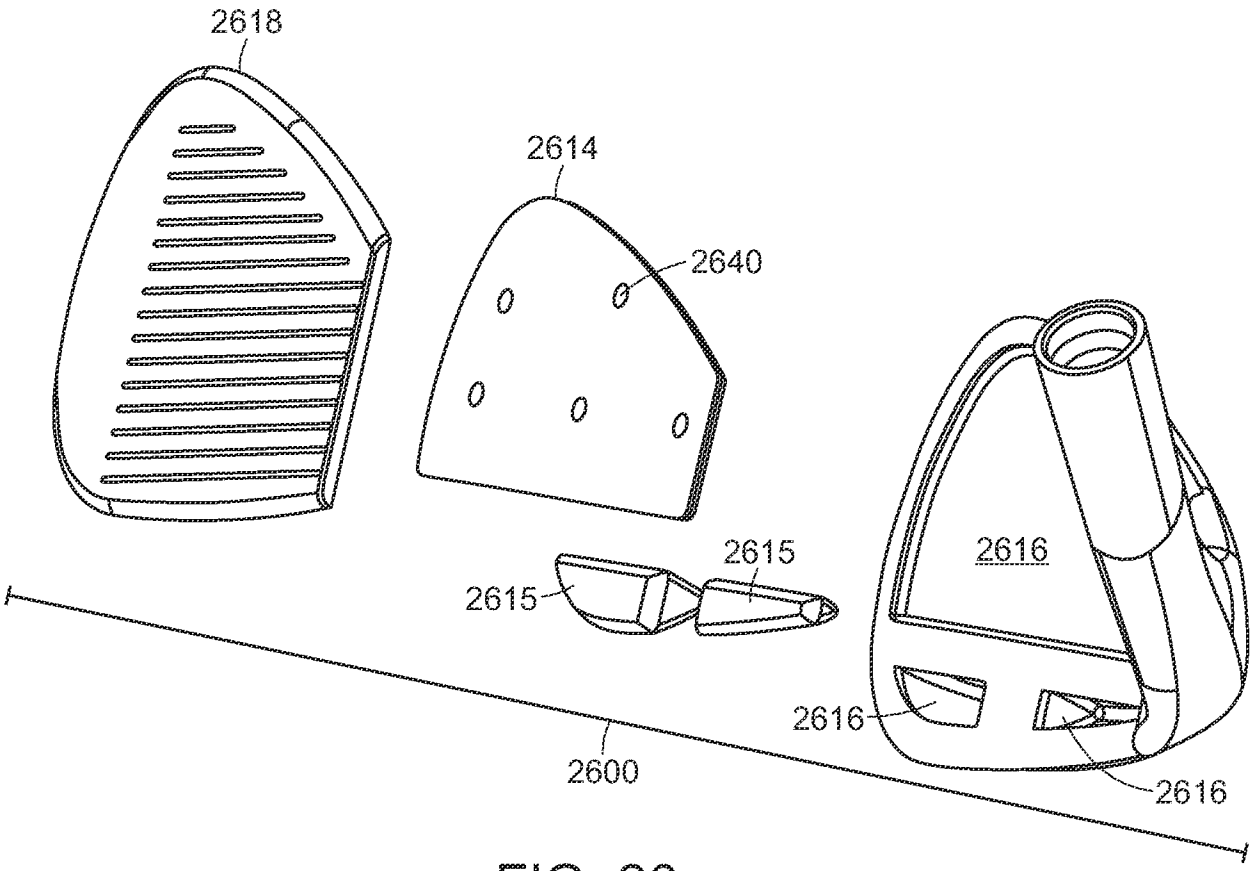
FIG. 26 shows an exploded frontal perspective view of a golf club head in accordance with an alternative embodiment of the present invention.

FIG. 26 of the accompanying drawing shows an exploded perspective view of a golf club head 2600 in accordance with an alternative embodiment of the present invention. In this alternative embodiment of the present invention, the co-forged golf club head 2600 is similar to prior golf club heads that have multiple cavities; however all of the cavities 2616 in this embodiment are generally open towards the frontal portion of the golf club head 2600. This arrangement of the cavities 2616 being opened towards the frontal portion of the golf club head 2600 allows the entirety of the cavities 2616 and their respective insert to be covered using one unitary cover, which in this instance is the striking face 2618. Having the entirety of the cavities 2616 and their respective weight portion inserts being secured by one cover may be preferred as it dramatically simplifies the simplicity of the construction. In addition to the above, it is worthwhile to note here that the welding line between the striking face 2618 and the chassis of the golf club head 2600 occurs around a perimeter of the striking face 2618. This placement of the separation is strategic, as it helps move the welding lines away from the high stress impact location on the striking face 2618.

Focusing on the cavities 2616 shown in FIG. 6, it can be seen that the cavities 2616 may take on different geometric shapes and could be located at different locations within the golf club head 2600 depending on the desired center of gravity location. In this embodiment shown in FIG. 6, the golf club head may have a large cavity 2616 located near the upper portion of the golf club head 2600 adapted to engage a lightweight weight adjustment portion 2614, a lower toe portion cavity 2616 adapted to engage a toe biased heavy density weight adjustment portion 2615, and a lower heel portion cavity 2616 adapted to engage a heel biased heavy density weight adjustment portion 2615. This embodiment allows removal of weight from the upper portion of the golf club head 2600 and addition of weight towards the bottom heel and toe portion of the golf club head 2600 to lower the center of gravity and increase the moment of inertia. Finally. FIG. 26 also shows a plurality of cutouts 2640 being strategically located across the lightweight weight adjustment portion 2614 to help provide structural rigidity of all the components by allowing the material of the striking face 2618 and the chassis to seep into the cutouts 2640 as shown earlier in FIG. 25.

Figure 27:
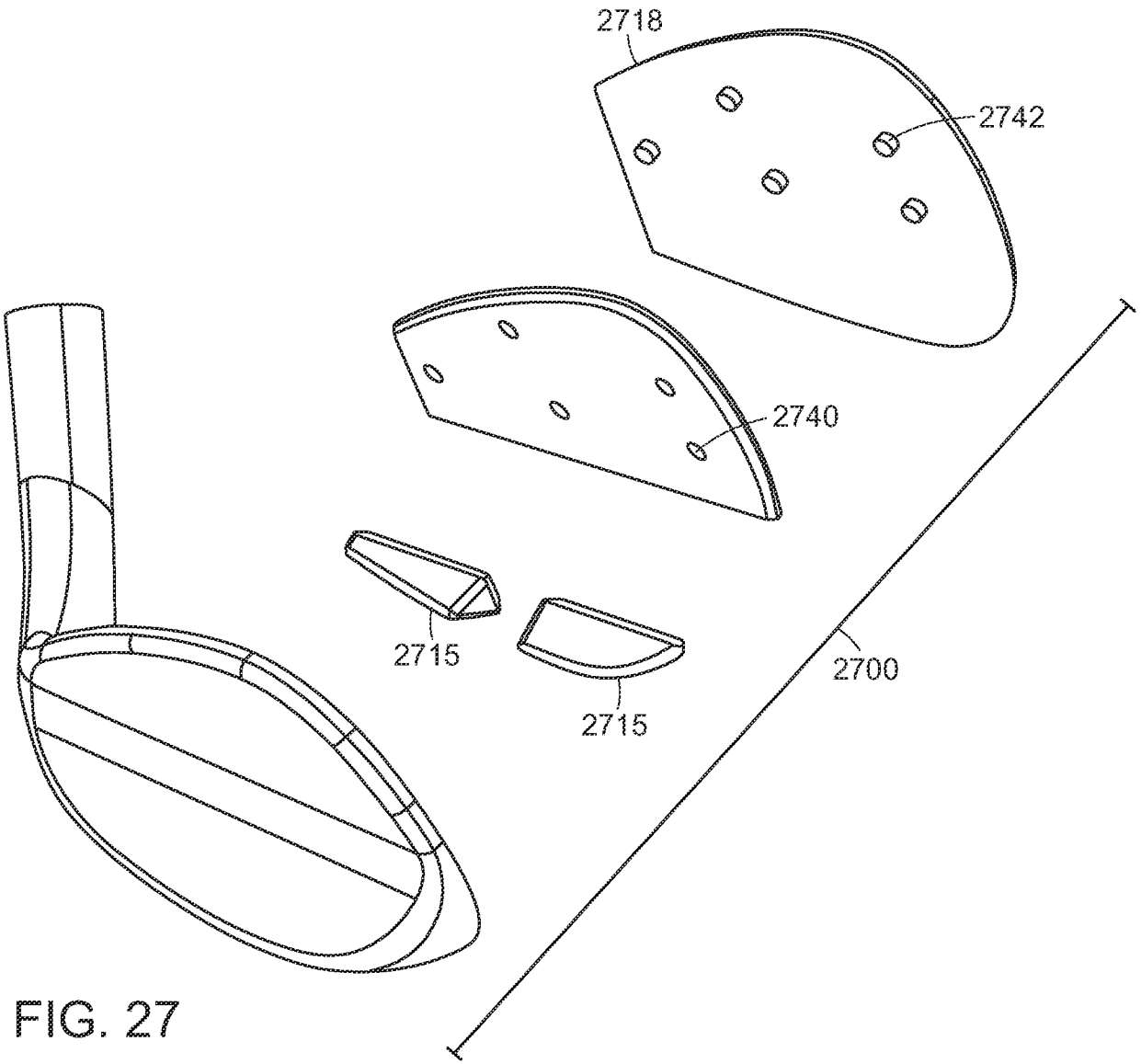
FIG. 27 shows an exploded rear view of a golf club head in accordance with an alternative embodiment of the present invention.

FIG. 27 shows rear exploded perspective view of a golf club head 2700 in accordance with a further alternative embodiment of the present invention. The golf club head 2700 shown in FIG. 27 may be very similar to the golf club head 2600 shown in FIG. 6, but be further comprised out of a plurality of posts 2742 located at the rear surface of the striking face 2718. The plurality of posts 2742 in this embodiment of the present invention is intended to engage the plurality of cutouts 2740 located on the lightweight weight adjustment portion 2714 to further prevent the movement of these components relative to another. These plurality of posts 2742, combined with the plurality of cutouts 2740, serve to create one homogenous part once it undergoes a secondary forging step that co-forges these components together similar to the method described by FIGS. 10 through 13.

In the current exemplary embodiment of the present invention, the plurality of posts 2742 are all located on the striking face 2718 for the ease of illustration. In alternative embodiments, the plurality of posts 2742 may be located on the other side of the lightweight weight adjustment portion 2614 within the upper cavity 2616 (see FIG. 26) without departing from the scope and content of the present invention. In a further alternative embodiment of the present invention, the plurality of posts 2742 may be partially located on the rear surface of the striking face 2718 and partially located on the frontal surface of the upper cavity 2616 (see FIG. 26) also without departing from the scope and content of the present invention.

FIGS. 28-34 of the accompanying drawings all provide cross-sectional views of the golf club head containing this plurality of posts 2742 and their respective plurality of cutouts 2740 in accordance with various different embodiments of the present invention. Before diving into the cross-sectional view of golf club head 2800 shown in FIG. 28, it is worth noting that the cross-sectional view is taken along cross-sectional line A-A' shown in FIG. 23 down the center of the club head 2800. However, in different embodiments of the present invention, various other cross-sectional lines could be used without departing from the scope and content of the present invention so long as it contains the relationship between the plurality of posts 2842 and the plurality of cutouts 2840 illustrated.

Figure 28:
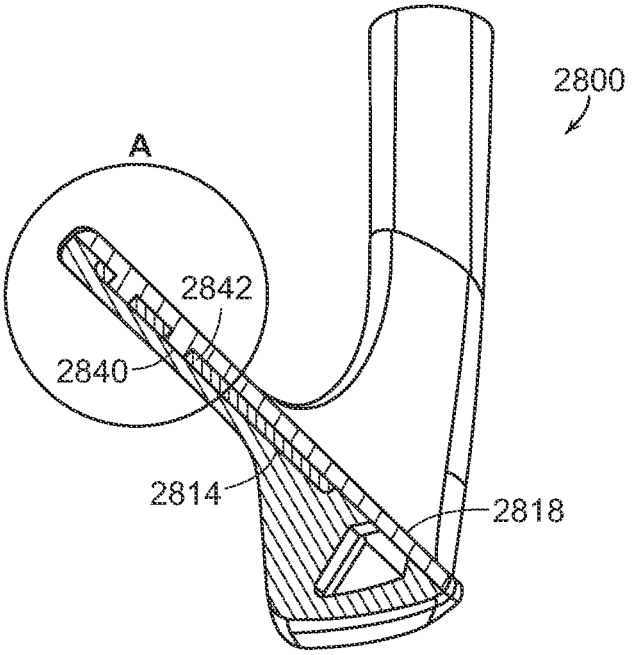
FIG. 28 shows a cross-sectional view of a golf club head in accordance with an alternative embodiment of the present invention.

FIG. 28 shows a cross-sectional view of a golf club head 2800 in accordance with an exemplary embodiment of the present invention wherein the plurality of posts 2842 are located on the rear surface of the striking face 2818, while the plurality of cutouts 2840 are located in the lightweight weight adjustment portion 2814 that is sandwiched by the other components. The plurality of posts 2842 in this exemplary embodiment may all be of the same size to ensure consistent bond between the different posts during the final forging step; however, in alternative embodiments the plurality of posts can have varying diameters depending on the quality of the bond joint required without departing from the scope and content of the present invention. In order to provide a clearer illustration of the relationship between the plurality of posts 2842 and the plurality of cutouts 2840, an enlarged cross-sectional view of the golf club head 2800 focusing on circular region A is shown in FIG. 29.

Figure 29:
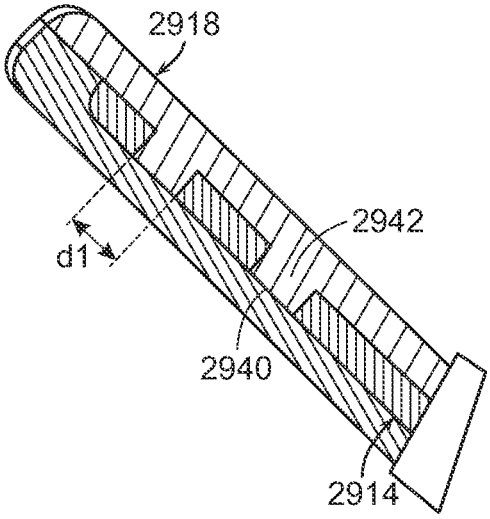
FIG. 29 shows an enlarged cross-sectional view, as illustrated by circular region A, of a golf club head in accordance with an alternative embodiment of the present invention.

FIG. 29 of the accompanying drawings shows an enlarged cross-sectional view of circular region A shown in FIG. 28. In addition to providing a clearer illustration of the relationship between the plurality of posts 2942 on the rear surface of the striking face 2918 and the plurality of cutouts 2940, FIG. 29 allows the diameter d1 of the plurality of posts to be illustrated more clearly. The diameter d1 shown here may generally be between about 0.5 mm and about 5.0 mm, more preferably between about 0.5 mm to about 2.5 mm, and most preferably between about 0.5 mm to about 1.0 mm. Similar to the discussion above regarding the diameter of the plurality of cutouts, the diameter d1 of the plurality of posts 2942 is critical to the proper functionality of the present invention by ensuring proper alignment of the different components without sacrificing feel and weight savings.

It should be noted that in this current exemplary embodiment of the present invention the plurality of posts 2942 terminate before reaching the backing portion of the chassis of the golf club head; however, in alternative embodiments of the present invention, the backing portion of the chassis may have a plurality of cutouts corresponding with the same plurality of cutouts 2940 in the lightweight weight adjustment portion 2914, allowing the plurality of posts 2942 to be longer and extend all the way through to the back surface of the golf club head. Making the plurality of posts longer 2942, combined with plurality of cutouts extending through both surface, allows the plurality of posts 2942 to be welded to the chassis at the rear surface of the golf club head, creating even more structural rigidity between all of the components without departing from the scope and content of the present invention.

Figure 30:
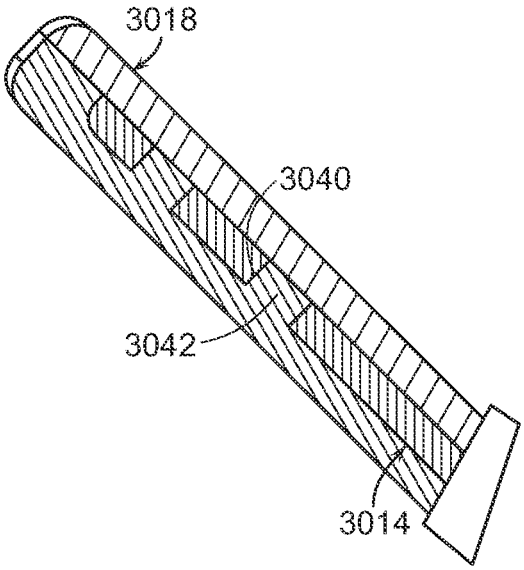
FIG. 30 shows an enlarged cross-sectional view, as illustrated by circular region A, of a golf club head in accordance with an alternative embodiment of the present invention.

FIG. 30 of the accompanying drawings shows an enlarged cross-sectional view of circular region A shown in FIG. 28, but in accordance with an alternative embodiment of the present invention wherein the plurality of posts 3042 are formed on the frontal surface of the cavity 2616 (see FIG. 26) created in the chassis of the golf club head instead of on the rear surface of the striking face 3018 without departing from the scope and content of the present invention. The plurality of cutouts 3040 are still formed in the lightweight weight adjustment portion 3014.

Figure 31:
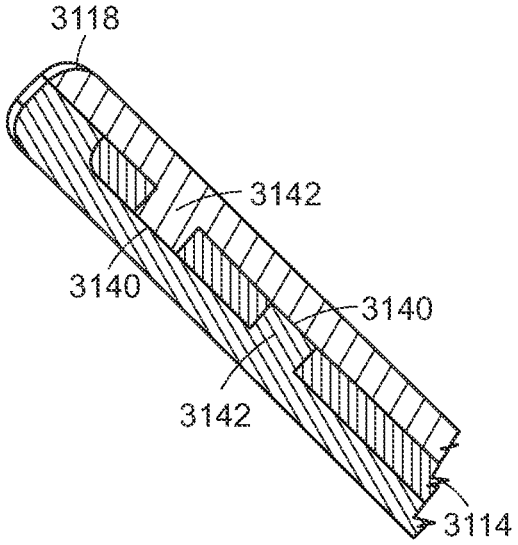
FIG. 31 shows an enlarged cross-sectional view, as illustrated by circular region A, of a golf club head in accordance with an alternative embodiment of the present invention.

FIG. 31 of the accompanying drawings shows an enlarged cross-sectional view of the circular region A shown in FIG. 28, but in accordance with an even further alternative embodiment of the present invention. In this alternative embodiment of the present invention shown in FIG. 31, the plurality of posts 3142 may be placed at both ends of the interface. More specifically, it can be said both the rear surface of the striking face 3118 and the frontal surface of the cavity 2616 (see FIG. 26) contain a plurality of posts 3142 adapted to engage a plurality of cutouts 3140 congruently placed across the lightweight weight adjustment portion 3114.

Figure 32:
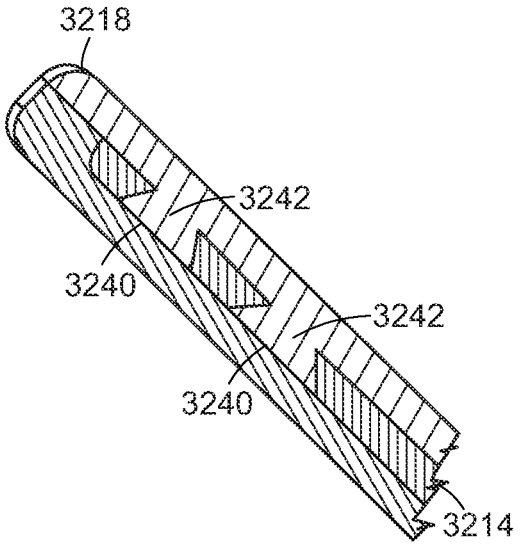
FIG. 32 shows an enlarged cross-sectional view, as illustrated by circular region A, of a golf club head in accordance with an alternative embodiment of the present invention.
Figure 33:
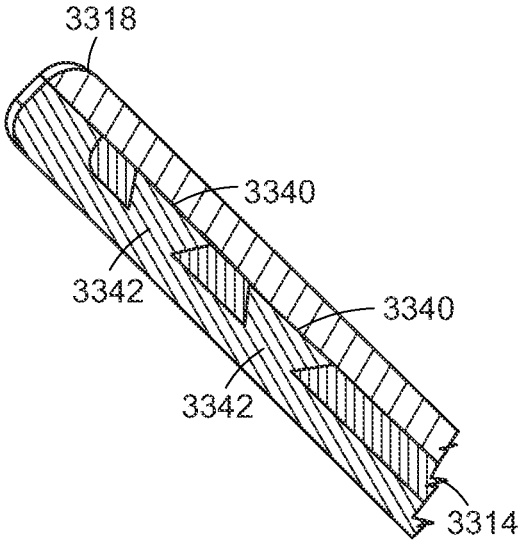
FIG. 33 shows an enlarged cross-sectional view, as illustrated by circular region A, of a golf club head in accordance with an alternative embodiment of the present invention
Figure 34:
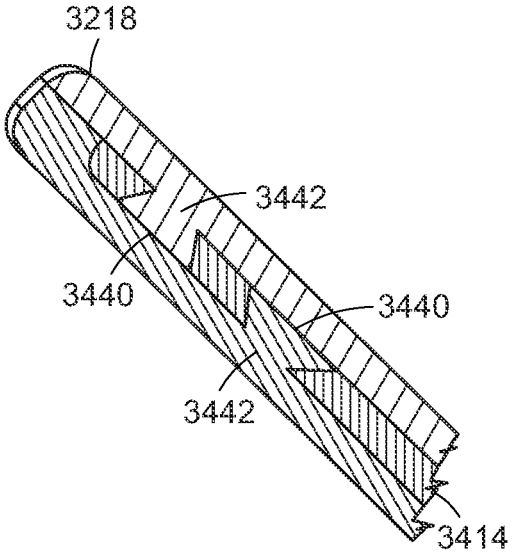
FIG. 34 shows an enlarged cross-sectional view, as illustrated by circular region A, of a golf club head in accordance with an alternative embodiment of the present invention.

FIG. 32 of the accompanying drawings shows an enlarged cross-sectional view of the circular region A shown in FIG. 28, but in accordance with an even further alternative embodiment of the present invention. In this alternative embodiment of the present invention the sidewalls of the plurality of cutouts 3240 may be angled to create a countersink causing the plurality of posts 3242 to mushroom and expand after the final forging process. The mushrooming of the plurality of posts 3242 due to the countersink geometry on the lightweight weight adjustment portion 3214 can help further secure the striking face 3218 to the lightweight weight adjustment portion 3214 as well as the chassis of the golf club head. It should be noted that before the final forging step, the plurality of posts 3242 may generally look like cylindrical posts, but deform with the countersink after the forging step. Lastly, the countersink in this embodiment of the present invention is generally by angling the sidewall of the plurality of cutouts 3240 by an angle of between about 5° to about 25°, more preferably between about 10° to about 20°, and most preferably about 15°. The angle of the draft of the countersink in the plurality of cutouts 3240, combined with the dimension of the plurality of posts 3242 is critical to the proper functionality of the present invention because an insufficient amount of draft angle would not create a strong enough bond between the components; while on the other hand, too much draft angle would leave too much of a void to be filled by the plurality of posts 3240. FIG. 33 of the accompanying drawings shows the countersink to be placed in an opposite orientation, allowing the plurality of posts 3342 to come from the chassis instead to create the enhanced mechanical lock. Finally, FIG. 34 of the accompanying drawings shows that the countersink could be on both sides of the lightweight weight adjustment portion 3414, creating an even better bond across all of the components.

Figure 35:
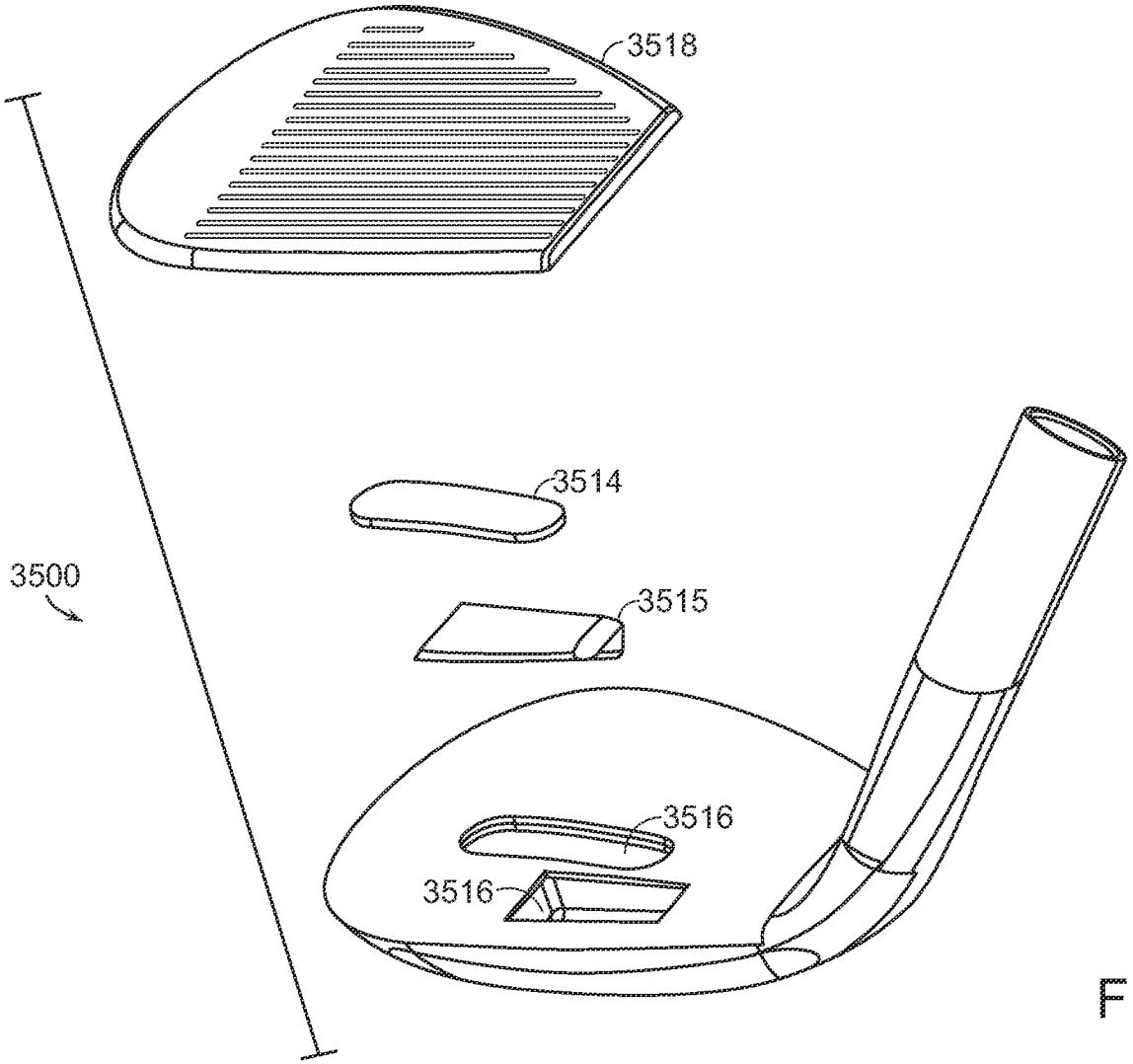
FIG. 35 shows a cross-sectional view of a golf club head in accordance with an even further alternative embodiment of the present invention.

FIG. 35 of the accompanying drawings shows an exploded perspective view of a golf club head 3500 in accordance with an alternative embodiment of the present invention wherein the lightweight weight adjustment portion 3514 and the high density weight adjustment portion 3515 may come in different shapes and be placed at different locations on the golf club head 3500. In this alternative embodiment of the present invention, the lightweight weight adjustment portion 3514 may be smaller and the heavy density weight adjustment portion 3515 may be placed directly below the lightweight weight adjustment portion 3514 in the center of the golf club head 3500. This embodiment may be preferred when the adjustment of center of gravity is not as dramatic, and the moment of inertia of the golf club head 3500 does not need to be increased as dramatically. Obviously, the one or more cavities 3516 remain in proportion to the number of weight adjustment portions that is needed, and the striking face 3518 continue to be used to cover the frontal portion of the golf club head 3500.

Figure 36:
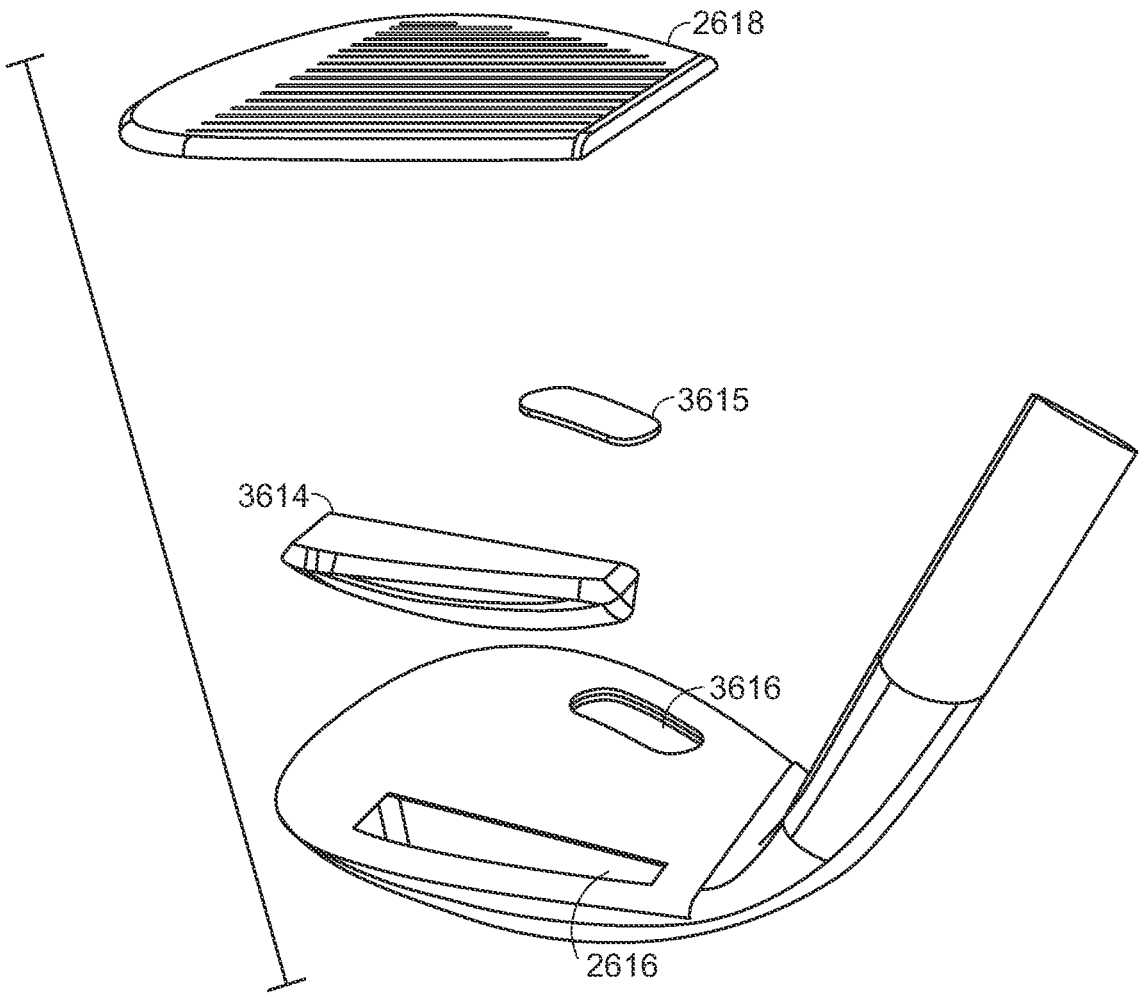
FIG. 36 shows a cross-sectional view of a golf club head in accordance with an even further alternative embodiment of the present invention.

FIG. 36 of the accompanying drawings shows an exploded perspective view of a golf club head 3600 in accordance with a further alternative embodiment of the present invention. This embodiment of the present invention is slightly different from the prior discussion in that the heavy density weight adjustment portion 3615 may be placed in a cavity 3616 above the location of the lightweight weight adjustment portion 3614 to achieve a higher center or gravity location without departing from the scope and content of the present invention.

Figure 37:
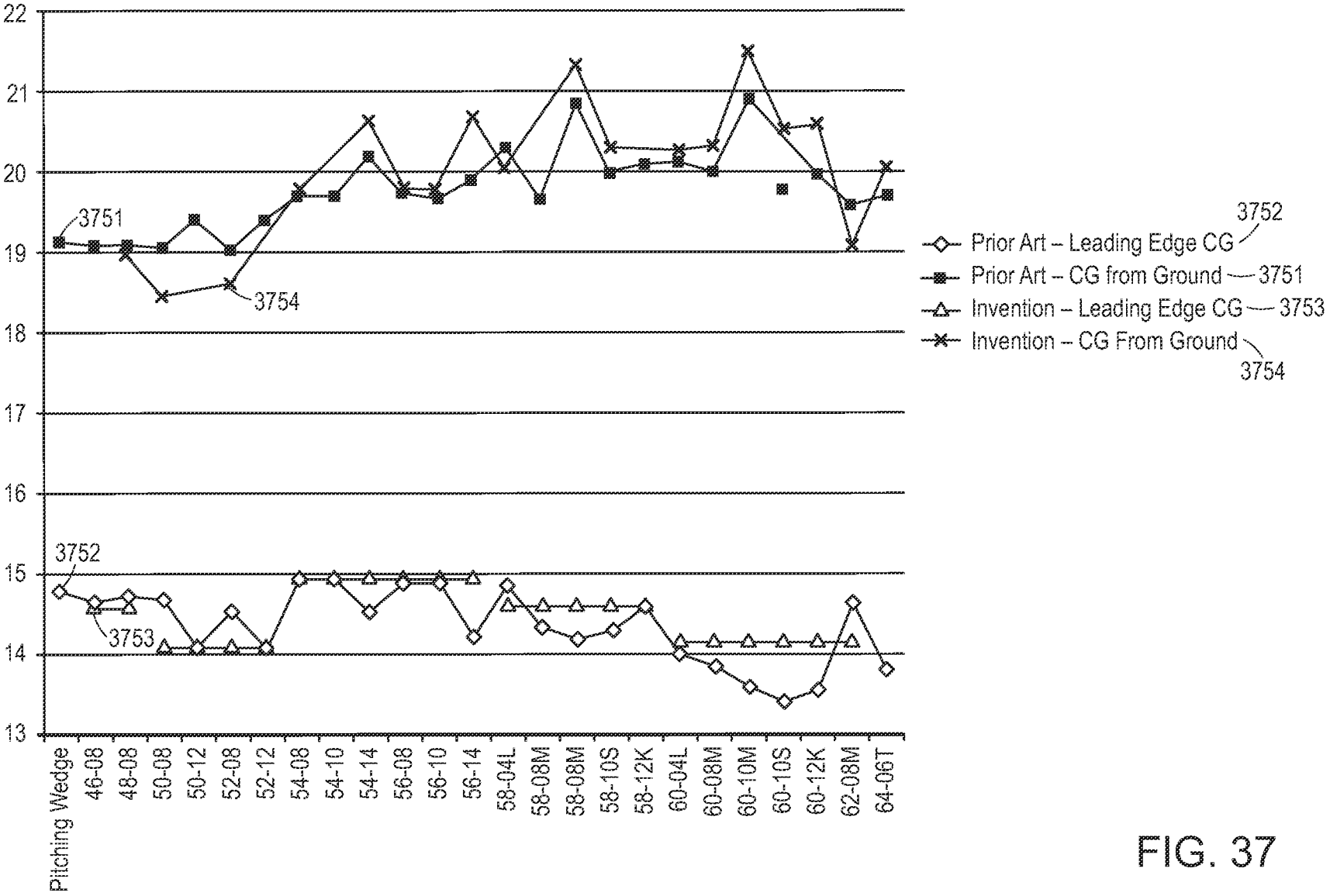
FIG. 37 shows a graphical representation of Center of Gravity (CG) locations of a set of golf club heads having different lofts and bounces in accordance with the present invention.

FIG. 37 of the accompanying drawings shows a graphical chart of the ultimate goal of using these extreme geometries in an iron or wedge to help achieve center of gravity locations that are previously not achievable. In addition to the above, FIG. 37 of the accompanying drawings shows an innovative method of measuring the center of gravity location of a golf club head that yields a more consistent result. The prior art generally determines the center of gravity of a golf club head based on its location relative to the ground plane. This conventional methodology is useful in providing a basis for measuring golf club head characteristics across all platforms. However, in an iron type golf club setting, where the bounce of the golf club head may significantly change the location of the golf club head itself relative to the ground plane, the conventional methodology may yield inconsistent results. Hence, the present invention seeks to eliminate that undesirable variable by creating an innovative method of determining and designing a golf club head center of gravity location by focusing on the leading edge of the golf club head.

Referring back to FIG. 37, we can see that CG location line 3751 refers to the prior art CG location of a golf club head through different lofts and different bounces relative to the ground plane. Although the data series forms a general trend, different sole bounces create significant outlier in the data, making it undesirable. However, looking at the same set of golf club heads by measuring the CG location relative to the leading edge 3752 yields even more inconsistency. Hence, in order to address this issue of inconsistency, the present invention seeks to maintain the CG location of a golf club head relative to the ground plane consistent throughout a specific loft, irrespective of bounce. Achievement of this goal is generally accomplished by using the construction described above in FIGS. 1-36, and will yield a CG location chart shown by data series 3753 shown in FIG. 37. As it can be seen in FIG. 37, the 46 degree wedge will maintain its CG location irrespective of the sole bounce profile, and the same thing goes throughout the entire set of wedges up to loft 64. It should be noted that some lofts that are similar to one another will preserve the same CG height location relative to the leading edge as its neighboring lofts to create a consistency irrespective of which wedge combination the golfer selects. Alternatively speaking, it can be said that if the first loft and the second loft are substantially the same, then the first CG height location from the leading edge and the second CG height location from the leading edge are also the same. FIG. 37 also shows data series 3754, illustrating how the design intent of the current invention will yield a result under the conventional measurement methodology, but that obsolete measurement method is no longer a concern of the present invention.

Figure 38:
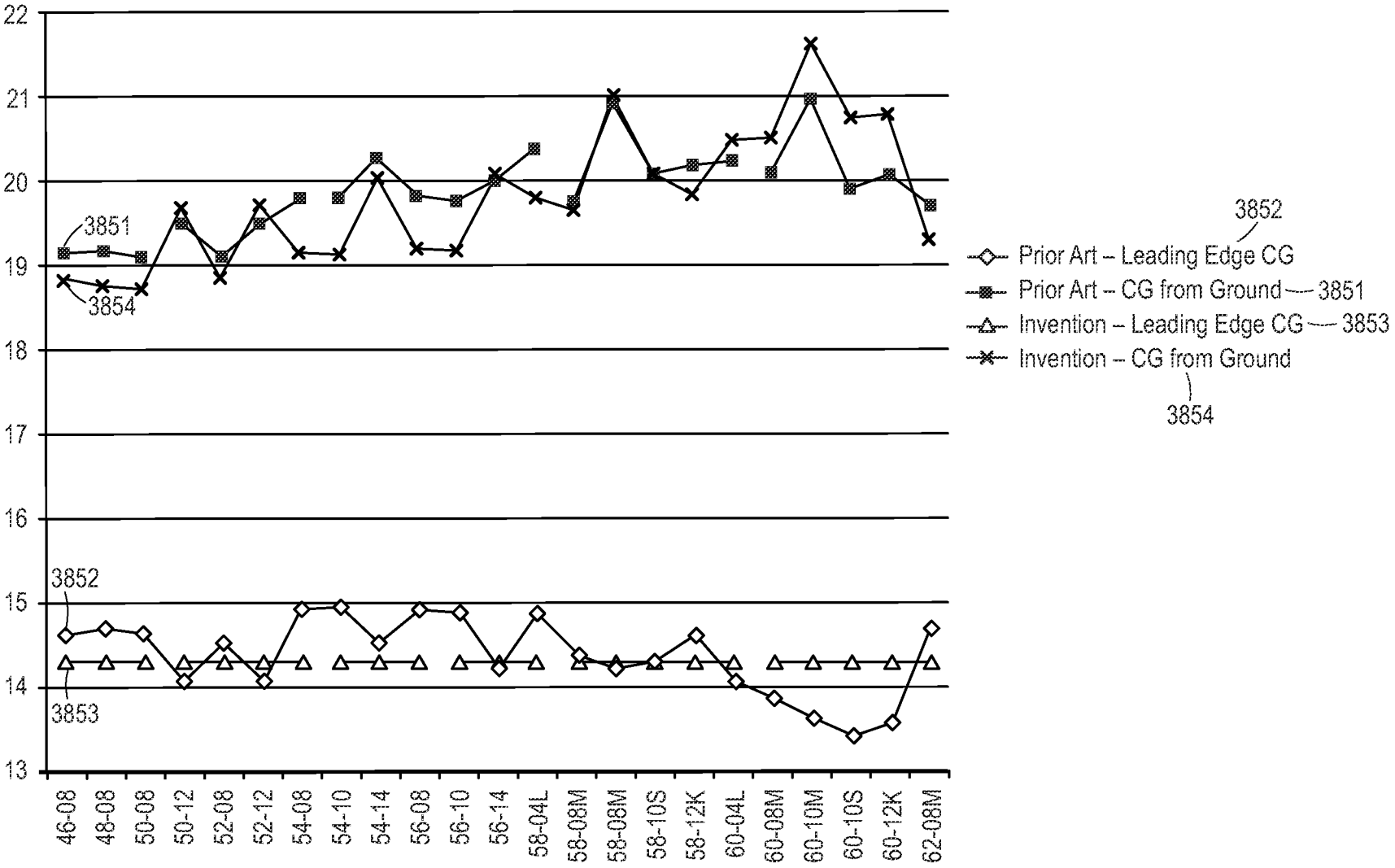
FIG. 38 shows a graphical representation of Center of Gravity (CG) locations of a set of golf club heads having different loft and bounces in accordance with an alternative embodiment of the present invention.

FIG. 38 of the accompanying drawings shows a graphical representation of a CG locations throughout a set of high lofted golf club heads in accordance with a further alternative embodiment of the present invention. Similar to the previous discussion in FIG. 37, this embodiment further improves upon the previous premise that controlling the CG of a golf club head is important, but measuring and controlling that number from the correct reference point is even more crucial. In the previous embodiment of the present invention we have already established that the measurement of the CG from the leading edge is a dramatic improvement over the measurement of the CG from the ground plane. In addition to the above, the discussion regarding FIG. 37 also established that if the CG location relative to the leading edge can be controlled when offering golf clubs of the same bounce, it greatly improves consistency of performance.

The present invention takes that premise even further in order to create a set of golf clubs with a consistent CG location relative to the leading edge throughout the entire set of golf clubs. Focusing the attention on FIG. 38 we can see that the current inventive golf club head has data series 3853 showing that the CG location relative to the leading edge plane is constant irrespective of the loft and bounce angle of the golf club head. More specifically, all golf clubs in accordance with the present invention will have a CG to leading edge height of between about 14.0 mm to about 15.0 mm, more specifically between 14.0 mm to about 14.5 mm, and more specifically about 14.2 mm. With this being the controlling variable, the CG location relative to the ground plane of the current invention is shown by data series 3854 and jumps randomly throughout the set. This is a significant improvement over the prior art golf club heads, where data series 3851 and 3852 shows the CG locations relative to ground and leading edge respectively, because no attention has been paid to the relationship of CG locations throughout a set of golf clubs.

Having a consistent CG location relative to the leading edge throughout a set of golf clubs is beneficial, as it will yield consistent results for the golfer irrespective of which club they choose. However, even more important than creating this consistency throughout the set of clubs is the ability to calibrate that consistency off the correct reference point. In the present invention, data series 3853 reflects this new innovative approach, and has created a consistent CG height relative to the leading edge of the golf club head irrespective of the golf club head loft and bounce angle. Alternatively speaking, it can be said that the set of golf clubs can be comprised out of two or more golf clubs, wherein the CG height location relative to the leading edge is the same irrespective of the loft and or bounce angle of the golf club head.

Figure 39:
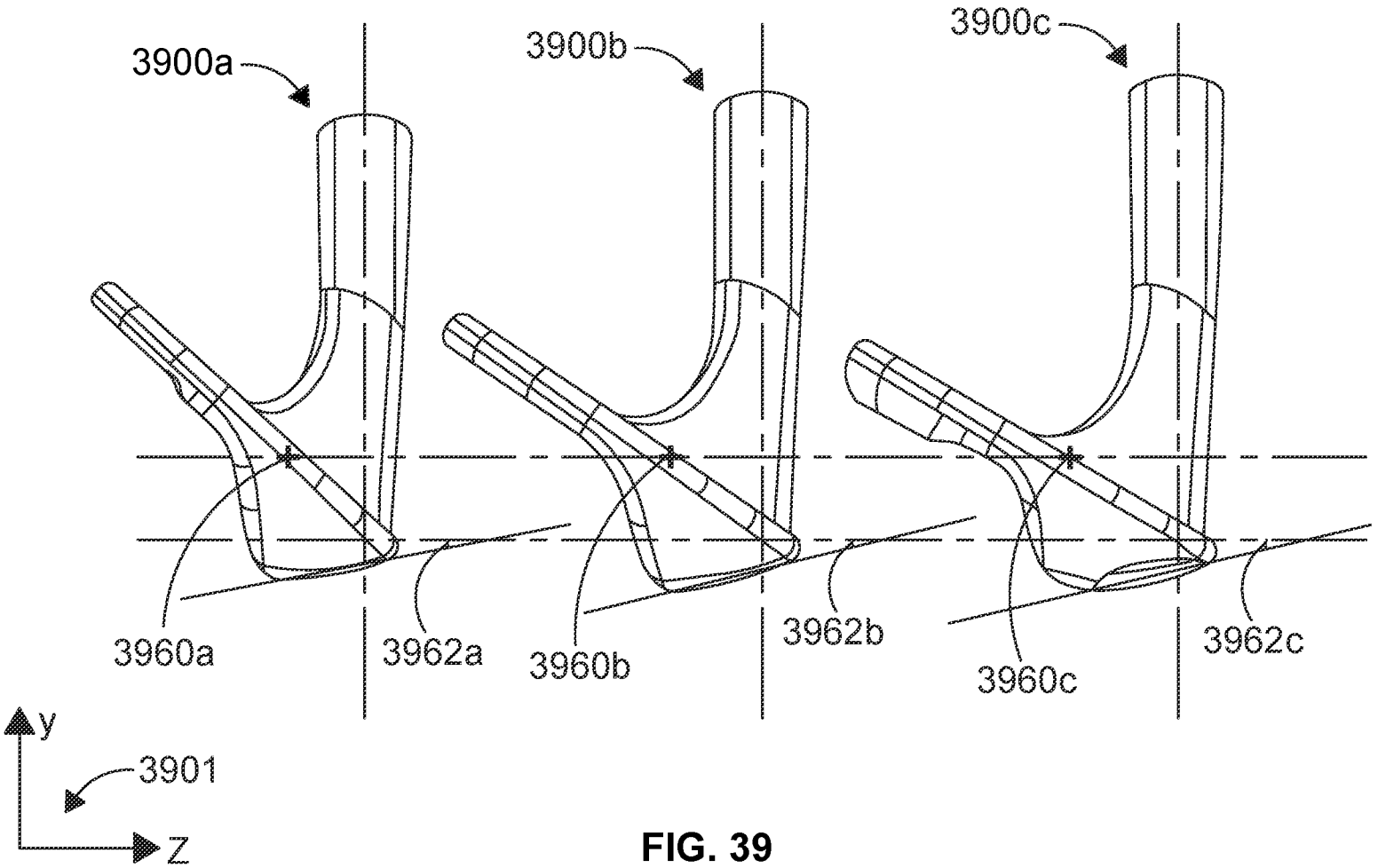
FIG. 39 shows a side by side comparison of a set of golf clubs having different lofts and bounce angles in accordance with an alternative embodiment of the present invention.

FIG. 39 of the accompanying drawings shows a side profile view of a set of golf club heads in accordance with the embodiment of the present invention shown in FIG. 38. More specifically, golf club head 3900*a* is illustrative of a low lofted wedge type golf club head 3900*a* having a loft of 48 degrees, a bounce angle 3962*a* of 10 degrees, and a CG height (in the y-axis along the coordinate system 3901) from the leading edge height of between about 14.0 mm to about 15.0 mm. Golf club head 3900*b*, is shown right next to golf club head 3900*a*, and is illustrative of a mid-lofted wedge type golf club head 3900*b* having a loft of 56 degrees, a bounce angle 3962*b* of 14 degrees, and a CG height (in the y-axis along the coordinate system 3901) from the leading edge height of between about 14.0 mm to about 15.0 mm. Golf club head 3900*c*, is shown right next to golf club head 3900*b*, and is illustrative of a high-lofted wedge type golf club head 3900*c* having a loft of 60 degrees, a bounce angle 3962*c* of 8 degrees, and a CG height (in the y-axis along the coordinate system 3901) from the leading edge height of between about 14.0 mm to about 15.0 mm.

It should be noted here that in despite the differences in loft angle and bounce angle, the CG height (in the y-axis along the coordinate system 3901) from the leading edge is maintained to be consistent throughout a set of golf clubs, which is illustrated in FIG. 38 by the numerous data points that call out different models of wedges with different loft angles and bounce angles.

Figure 40:
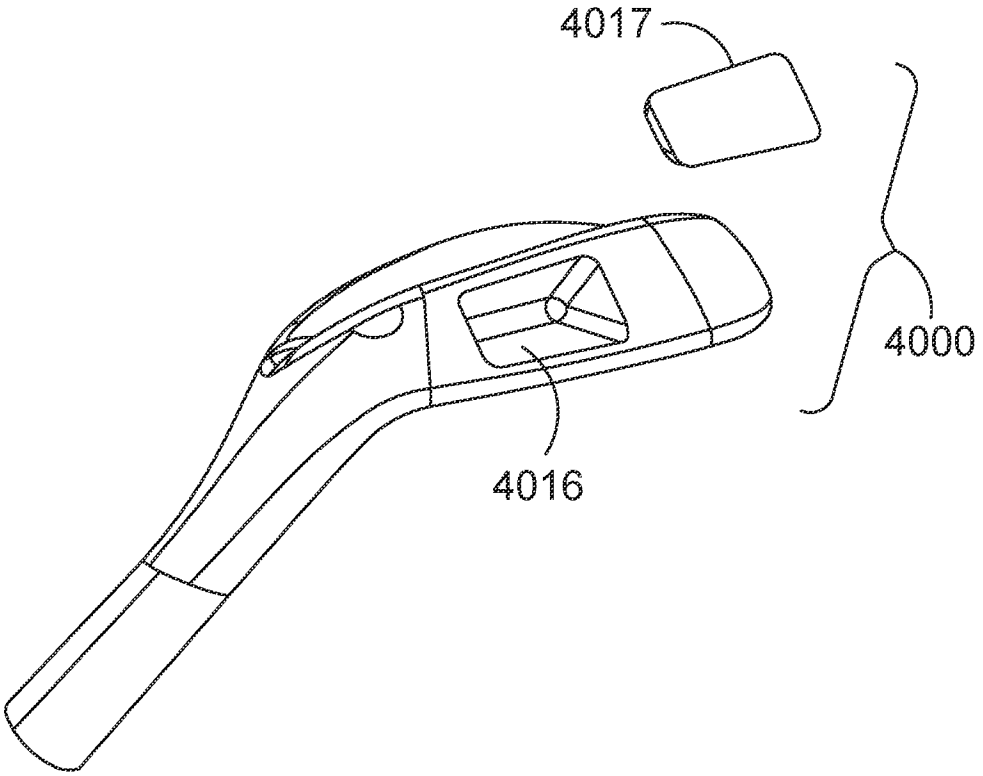
FIG. 40 shows an exploded sole perspective view of a golf club head in accordance with an even further alternative embodiment of the present invention.

FIG. 40 of the accompanying drawings shows an exploded perspective view of a golf club head 4000 in accordance with a further alternative embodiment of the present invention. In this embodiment of the present invention, the golf club head 4000 may have a sole cavity 4016 that opens towards the sole portion of the golf club head 4000 and located near the center of the sole in a heel to toe direction. This sole cavity 4016 is slightly different from the various cavities described in previous embodiments because it only opens towards the sole portion of the golf club head 4000, allowing mass to be removed from the bottom of the golf club head 4000 without departing from the scope and content of the present invention. The sole cavity 4016 in this embodiment is covered up by a cap 4017, creating a hollow sole cavity 4016 to help remove mass from the bottom portion of the golf club head 4000. In order to illustrate the relationship between the sole cavity 4016 and the cap 4017, a cross-sectional view of the golf club head 4000 is provided in FIG. 41.

Figure 41:
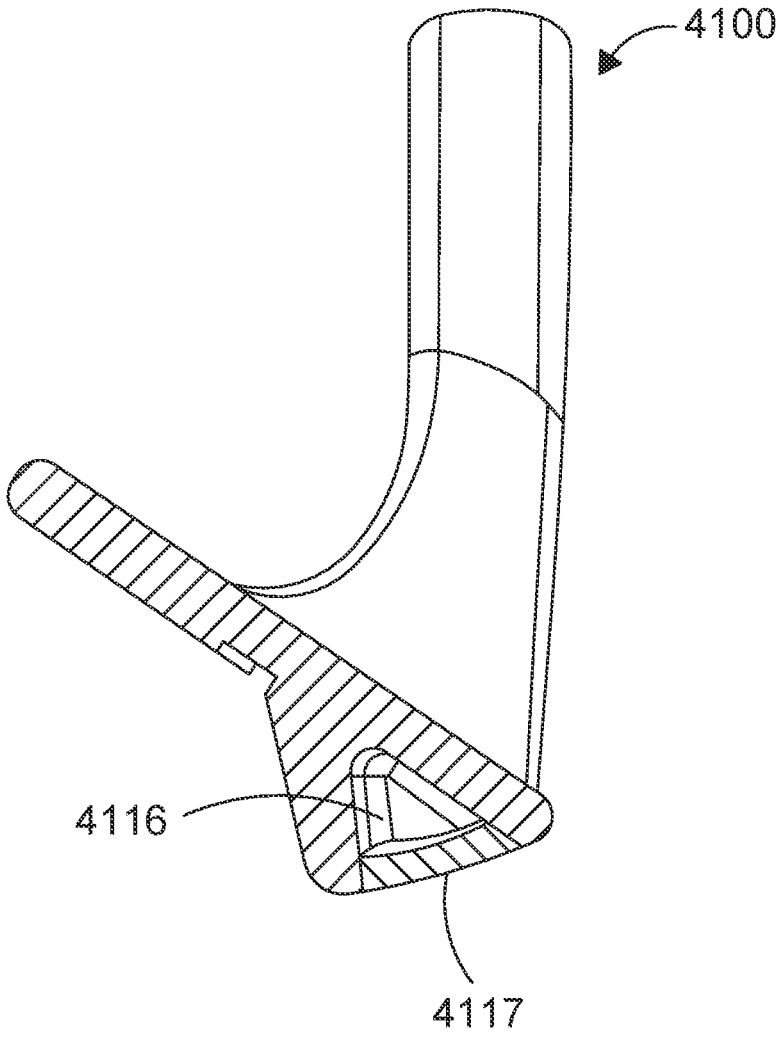
FIG. 41 shows a cross-sectional view of a golf club head in accordance with this further alternative embodiment of the present invention.

FIG. 41 of the accompanying drawings is shows a cross-sectional view of a golf club head 4100 in accordance with a further alternative embodiment of the present invention. In this cross-sectional view of the golf club head 4100 it can be seen that the cap 4117 completely covers the opening created by the sole cavity 4116, but ensures that there is an empty chamber near the sole of the golf club head 4100. This sole cavity 4116, as previously discussed, allows the golf club head to remove mass from the bottom sole portion of the golf club head 4100 and redistributed to alternate locations within the golf club head 4100 to create a center of gravity location/progression within different golf club heads 4100 in the a of golf clubs to achieve the performance goals desired. The progression of the center of gravity of the golf club head is to be discussed later.

Finally, it is worth noting that this particular construction of having an empty sole cavity 4116 being covered by a cap 4117 is generally reserved for a golf club head 4100 known as a mid-lofted wedge type golf club head 4100. More specifically, mid-lofted wedge type golf club head 4100 may generally refer to golf clubs having a loft of between 52 degrees and about 56 degrees.

Figure 42A:
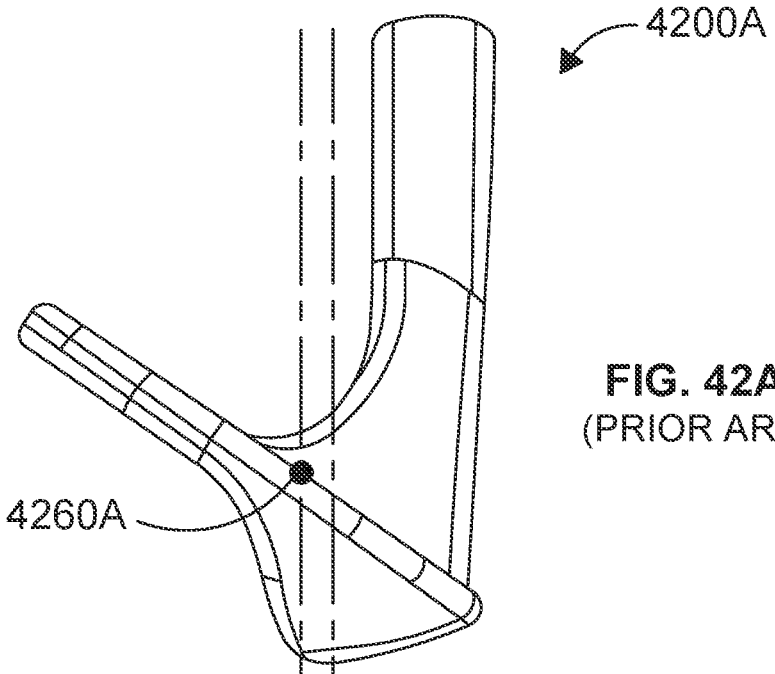
FIG. 42A (PRIOR ART)
FIG. 42A shows a toe view of a prior art golf club head, allowing it to be compared to FIG. 42B.
Figure 42B:
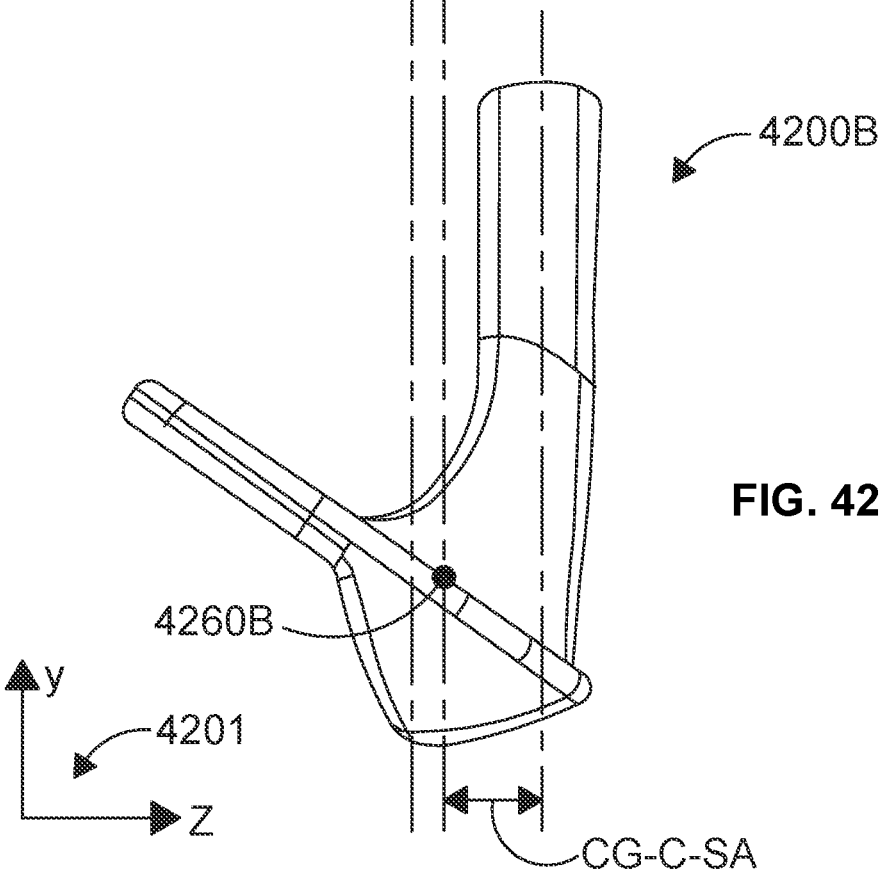
FIG. 42B shows a toe view of a golf club head in accordance with the further alternative embodiment of the present invention, allowing it to be compared to FIG. 42A.

In order to show the result that can be affected by the utilization of this inventive construction of having a sole cavity 4116 together with a cap 4117, FIG. 42 is provided with a comparison of the center of gravity locations 4260A and 4260B comparing a current inventive golf club head 4200B with a prior art golf club head 4200A. Based on the comparison provided, it can be seen that in this current embodiment of the present invention incorporating the hollow sole cavity 4106 (shown in FIG. 41), the mass saved can be used to move the center of gravity further forward along the Z axis as illustrated by the coordinate system 4201. Thus it can be said that a mid-lofted wedge type golf club head 4200B in accordance with an exemplary embodiment of the present invention with a loft of between 52 degree to about 56 degrees, may generally have a CG-C-SA (distance along the Z-axis, measured from the hosel bore axis) of between about 12 mm and about 13 mm, more preferably between about 12.1 mm and about 12.9 mm, and most preferably between about 12.2 mm and about 12.8 mm.

Figure 43:
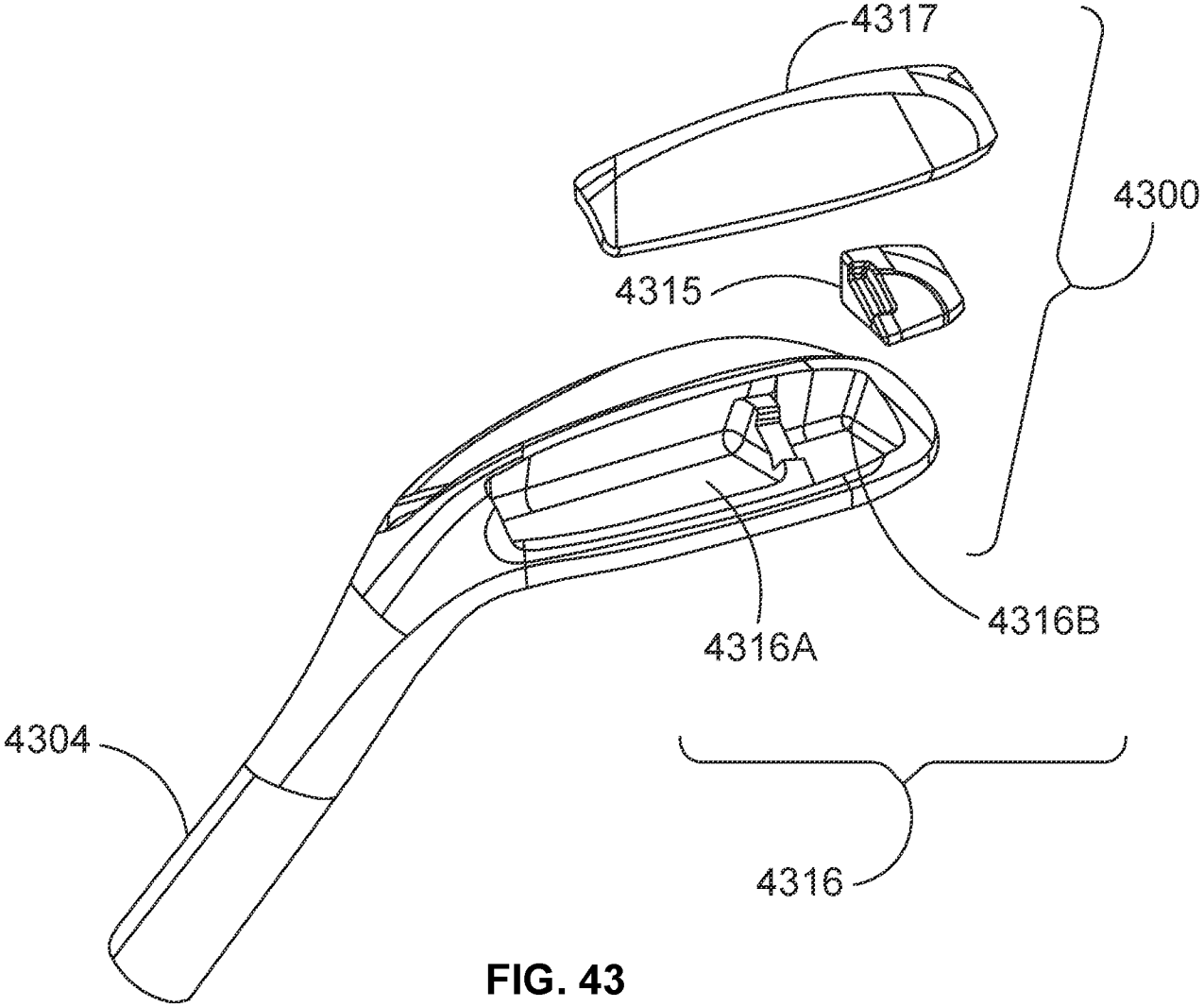
FIG. 43 shows an exploded sole perspective view of a golf club head in accordance with an even further alternative embodiment of the present invention.

FIG. 43 of the accompanying drawings shows an exploded perspective view of a high lofted wedge type golf club head 4300 in accordance with an alternative embodiment of the present invention, wherein a weight adjustment portion 4315 is incorporated into the sole cavity 4316 to further accentuate the movement of the center of gravity without departing from the scope and content of the present invention. In the exploded view of golf club head 4300 shown in FIG. 43, the sole cavity 4316 may be further separated into two sub-cavities, a heel side sole cavity 4316A, and a toe side sole cavity 4316B. As the discussion of FIG. 43 already hinted at, the toe side sole cavity 4316A may be filled with a high density weight adjustment portion 4315 to further manipulate the center of gravity for the golf club head 4300 without departing from the scope and content of the present invention. Having the high density weight adjustment portion 4315 located inside the toe side sole cavity 4316A may help balance the increased mass of the hosel 4304 that is required to manipulate the CG-C-SA number previously mentioned. Finally, like the previous embodiments have shown, a cap 4317 is used to secure and retain the weight adjustment member 4315 as well as cover up the sole cavity 4316. In order to more clearly illustrate the relationship between the various components shown here in this exploded view of FIG. 43, FIG. 44 of the accompanying drawings is provided to give a cross-sectional view of the various components being assembled together.

Figure 44:
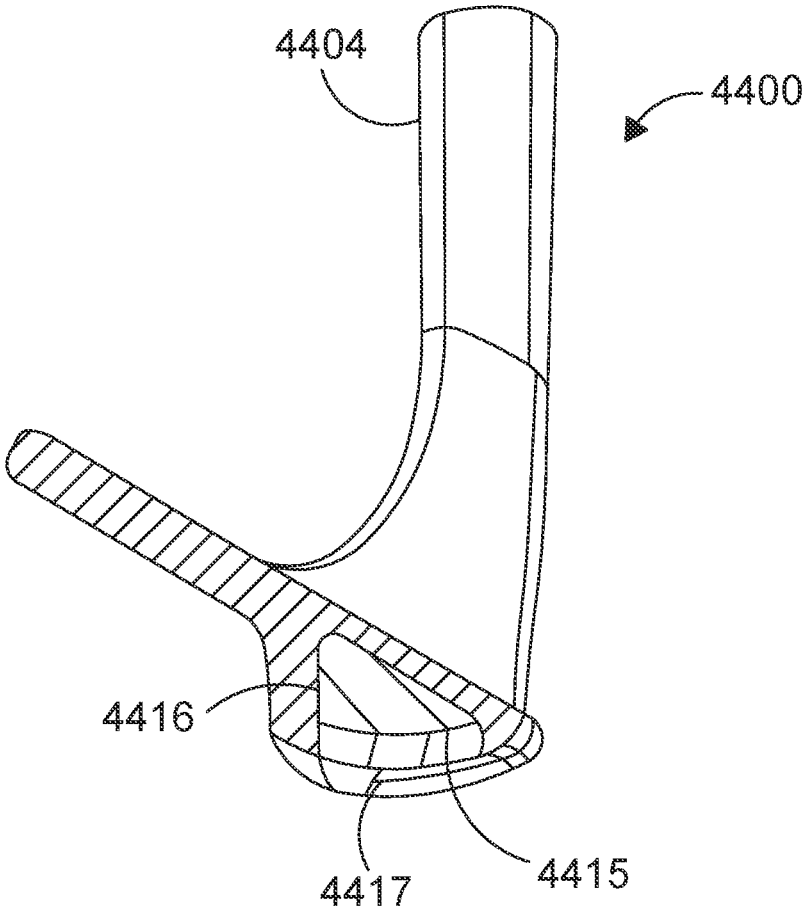
FIG. 44 shows a cross-sectional view of a golf club head in accordance with this further alternative embodiment of the present invention.

FIG. 44 of the accompanying drawings shows a cross-sectional view of a golf club head 4400 in accordance with an alternative embodiment of the present invention, section along the toe portion of the golf club head 4400 to allow the weight adjustment portion 4415 to be shown more clearly. In this cross-sectional view of the golf club head 4400 shown in FIG. 44, it can be seen that the sole cavity 4416 is filled with a weight adjustment portion 4415 that completely encompasses the entirety of the sole cavity 4416 near the toe portion of the golf club head 4400. Similarly as the prior embodiments have shown, a cap 4417 is used to cover up the opening towards a sole of the golf club head 4400 without departing from the scope and content of the present invention. Finally, although not readily apparent in this view, golf club head 4400 shown here generally has an extended hosel portion 4404 that allows the CG-C-SA of the golf club head 4400 to be moved more forward as previously stated.

Figure 45:
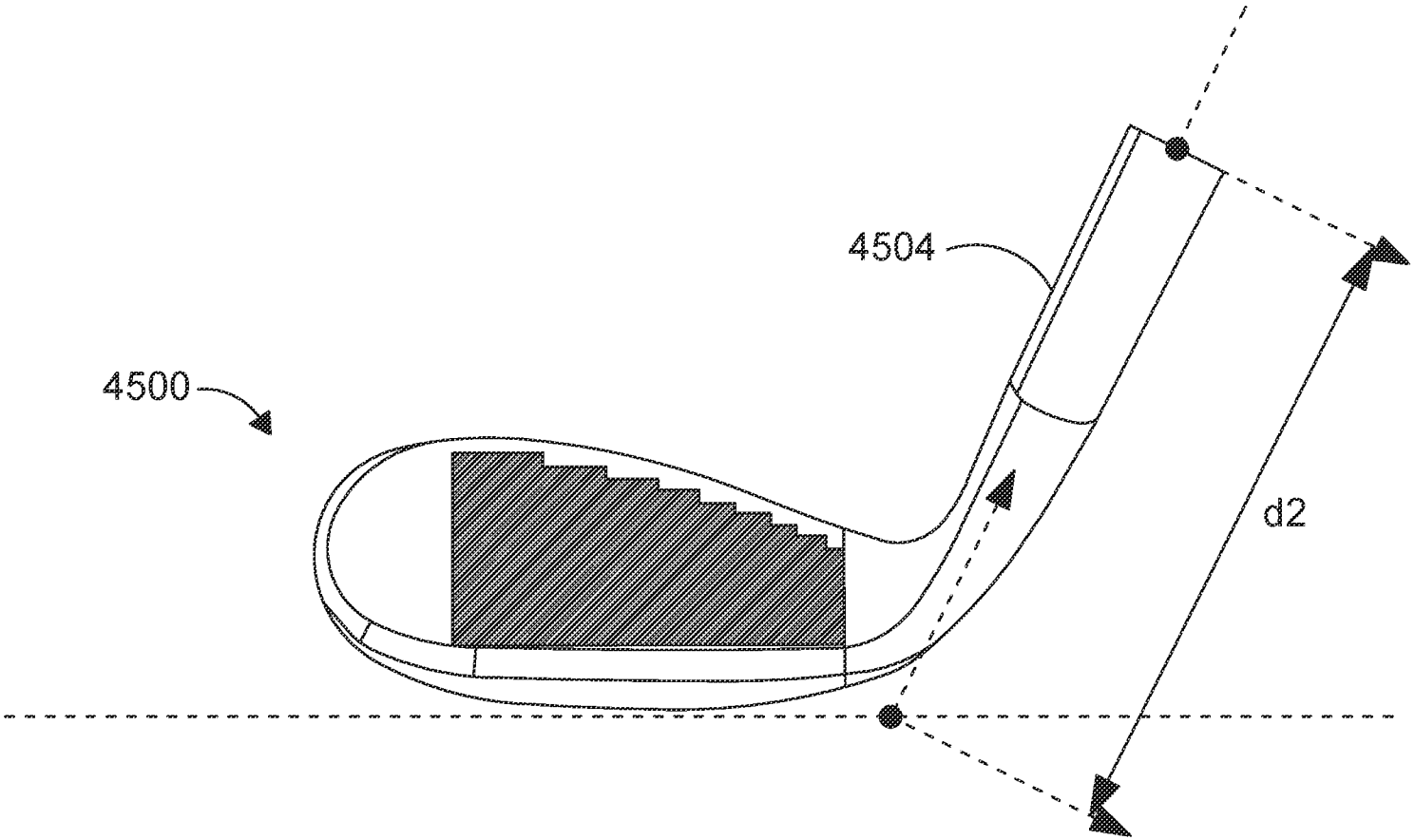
FIG. 45 shows a frontal view of a golf club head in accordance with this further alternative embodiment of the present invention.

FIG. 45 of the accompanying drawings shows a frontal view of a golf club head 4500 in accordance with an alternative embodiment of the present invention wherein the CG-C-SA numbers discussed above are achieved via another design criterion. More specifically, in order to move the center of gravity of the golf club head 4500 more forward, it may be beneficial to increase the length d2 of the hosel 4504 in addition to removing mass from the sole portion of the golf club head 4500. For the purpose of this discussion, the length d2 of the hosel 4504 is defined as the distance of the hosel 4504 as measured from the top of the golf club head 4500 along the lie angle of the golf club head 4500 as it follows the hosel bore axis until it reaches the ground plane. In this embodiment of the present invention, the hosel 4504 may have a length d2 that is greater than about 83.5 mm, more preferably greater than about 85.0 mm, and most preferably greater than about 87.0 mm, all without departing from the scope and content of the present invention.

Figure 46A:
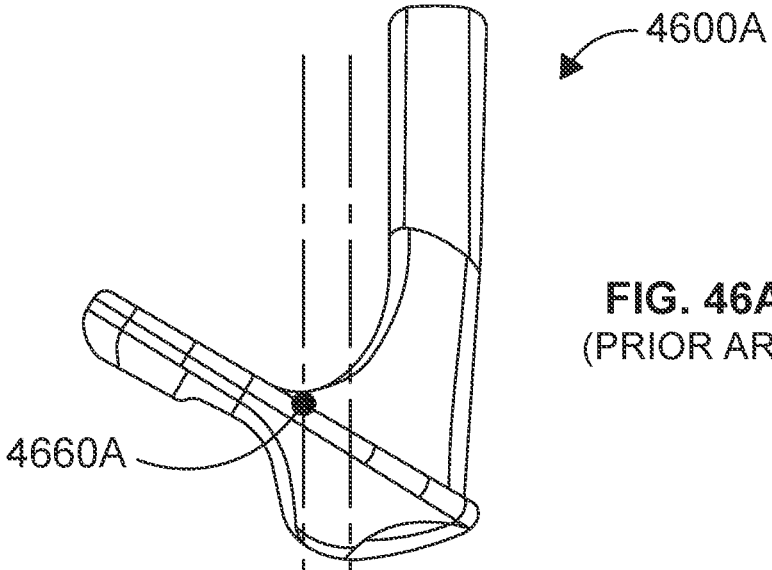
FIG. 46A (PRIOR ART)
FIG. 46A shows a toe view of a prior art golf club head, allowing it to be compared to FIG. 46B.
Figure 46B:
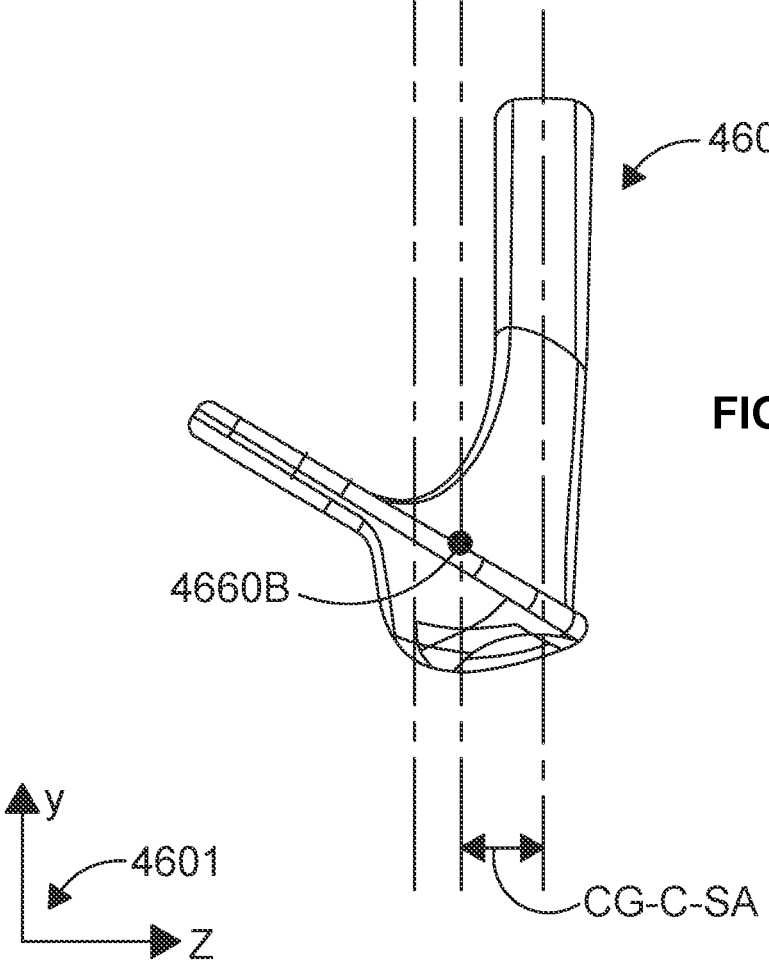
FIG. 46B shows a toe view of a golf club head in accordance with the further alternative embodiment of the present invention, allowing it to be compared to FIG. 46A.

In order to show the result that can be affected by the utilization of this inventive construction of having a sole cavity 4116 together with a cap 4417, FIG. 46 is provided with a comparison of the center of gravity locations 4660A and 4660B comparing a current inventive golf club head 4600B with a prior art golf club head 4600A. Based on the comparison provided, it can be seen that in this current embodiment of the present invention incorporating the hollow sole cavity 4306 (shown in FIG. 43), the mass saved can be used to move the center of gravity further forward along the Z axis as illustrated by the coordinate system 4601. Thus it can be said that a mid-lofted wedge type golf club head 4600B in accordance with an exemplary embodiment of the present invention with a loft of greater than about 56 degrees, may generally have a CG-C-SA (distance along the Z-axis, measured from the hosel bore axis) of between about 13 mm and about 14 mm, more preferably between about 13.1 mm and about 13.9 mm, and most preferably between about 13.2 mm and about 13.8 mm.

Figure 47:
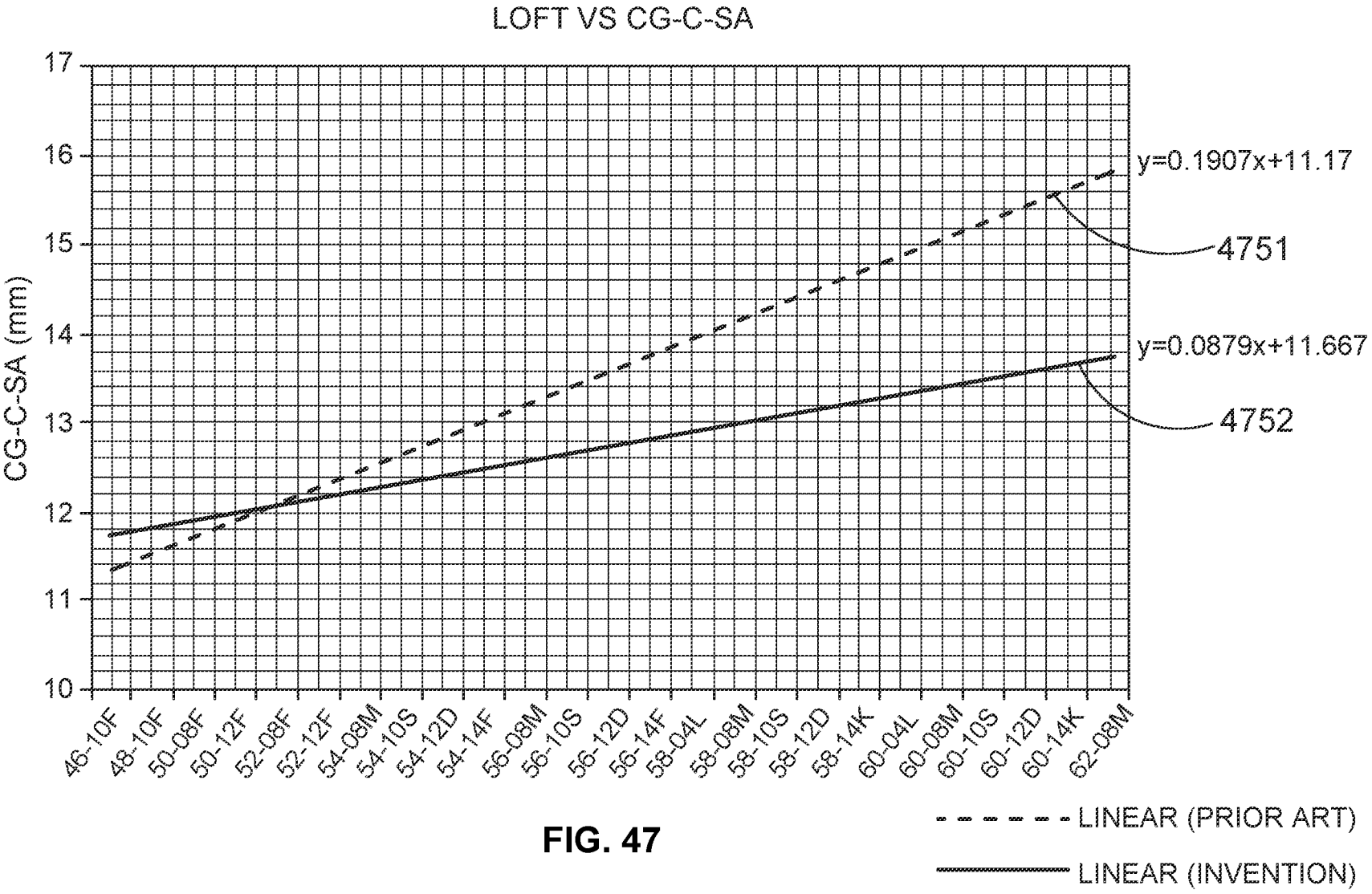
FIG. 47 shows a graphical representation of the Center of Gravity (CG) location of a set of golf club heads as compared to a prior art golf club head.

Finally, FIG. 47 of the accompanying drawings shows a graphical representation of the CG location of a current inventive golf club head compared to a prior art golf club head as a function of loft. More specifically, FIG. 47 shows the CG location along a z-axis of the golf club head moving rearward in the golf club head, as measured from the hosel bore axis, quantified here as CG-C-SA. In the graphical plot shown here in FIG. 47, it can be seen that the prior art golf club's CG-C-SA location as a function of loft is labeled here as 4751, which follows a significantly linear slope defined by Equation (2) below:

$$\text{CG-C-SA}=0.1907*\text{Loft}+11.17 \qquad \text{Eq. (2)}$$

In addition to the CG-C-SA location of the prior art golf club head shown by line 4751, FIG. 47 of the accompanying drawings also shows an additional line 4752 illustrating the CG-C-SA location of the current inventive golf club head as a function of loft. This current inventive golf club head's CG-C-SA location generally follows a significantly linear slope defined by the Equation (3) below:

$$\text{CG-C-SA}=0.0879*\text{Loft}+11.667 \qquad \text{Eq. (3)}$$

Based on the CG-C-SA data shown here, it can be seen that the slope of the progression of CG-C-SA for the current inventive golf club head is less steep than that of a prior art golf club head. In fact, it can be said that the slope of the progression of CG-C-SA for the current golf club head is less than about 0.19, more preferably less than 0.15, and most preferably less than about 0.10. Alternatively speaking, it can be said that assuming a minimum of 1 degree difference between adjacent clubs, the higher lofted club has a CG-C-SA that is at most about 0.19 mm greater than the lower lofted club, more preferably at most about 0.15 mm greater, and at most about 0.10 mm greater than the lower lofted club.

More specifically, it can be said that the golf club head in accordance with an exemplary embodiment of the present invention has a function between CG-C-SA and loft that satisfied equation (4) below, for all golf clubs having a loft of greater than 52 degree:

$$\text{CG-C-SA}<0.1907*\text{Loft}+11.17 \qquad \text{Eq. (4)}$$

In a more preferred embodiment of the present invention, the function between CG-C-SA and loft satisfied equation (5) below, for any and all lofts:

$$\text{CG-C-SA}\leq 0.0879*\text{Loft}+11.667 \qquad \text{Eq. (5)}$$

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the preceding specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting form the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a striking face portion located at a frontal portion of said golf club head defining a loft of said golf club head;

a back portion located aft of said striking face portion;

a topline located at an upper portion of said golf club head between said striking face portion and said back portion;

a sole portion located at a lower portion of said golf club head between said striking face portion and said back portion, and a hosel located near a heel portion of said golf club head adapted to engage a shaft, wherein said sole portion further comprises a hollow sole cavity and a cap, wherein when said loft of said golf club head is greater than 52 degrees, said golf club head has a CG-C-SA relationship with said loft that satisfies the equation below:

$$CG\text{-}C\text{-}SA<0.1907*Loft+11.17,$$

said CG-C-SA defined as a distance measured in millimeters of a center of gravity of said golf club head rearward of a hosel bore axis of said golf club head along a Z-axis, wherein said hollow sole cavity further comprises a heel side cavity portion and a toe side cavity portion, wherein a weight adjustment portion is located within said toe side cavity portion of said hollow sole cavity, wherein said heel side cavity portion is void of material, wherein said heel side cavity portion and said toe side cavity portion are separated by a wall, and wherein said wall has a U-shaped opening extending entirely through said wall in a heel-to-toe direction, said U-shaped opening connecting said heel side cavity portion to said toe side cavity portion.

2. The golf club head of claim 1, wherein when said loft of said golf club head is greater than 52 degrees and less than or equal to about 56 degrees, said CG-C-SA is between about 12 mm and about 13 mm.

3. The golf club head of claim 2, wherein when said loft of said golf club head is greater than 52 degrees and less than or equal to about 56 degrees, said CG-C-SA is between about 12.1 mm and about 12.9 mm.

4. The golf club head of claim 3, wherein when said loft of said golf club head is greater than 52 degrees and less than or equal to about 56 degrees, said CG-C-SA is between about 12.2 mm and about 12.8 mm.

5. The golf club head of claim 1, wherein said golf club head has a CG-C-SA relationship with said loft that satisfies the equation below:

$$CG\text{-}C\text{-}SA\leq 0.0879*Loft+11.667.$$

6. The golf club head of claim 1, wherein said hosel has a length of greater than about 83.5 mm.

* * * * *